US006861160B2

(12) United States Patent
Ando et al.

(10) Patent No.: US 6,861,160 B2
(45) Date of Patent: Mar. 1, 2005

(54) ZINC-BASED PLATED STEEL SHEET AND METHOD FOR MANUFACTURING SAME

(75) Inventors: Satoru Ando, Fukuyama (JP); Masaki Tada, Fukuyama (JP); Yoshiharu Sugimoto, Fukuyama (JP); Masaaki Yamashita, Fukuyama (JP); Junichi Inagaki, deceased, late of Yokohama (JP); by Tomoko Inagaki, legal representative, Yokohama (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 10/452,526

(22) Filed: Jun. 2, 2003

(65) Prior Publication Data

US 2004/0005476 A1 Jan. 8, 2004

Related U.S. Application Data

(63) Continuation of application No. PCT/JP01/09143, filed on Oct. 18, 2001.

(30) Foreign Application Priority Data

| | | |
|---|---|---|
| Dec. 4, 2000 | (JP) | 2000-369174 |
| Dec. 4, 2000 | (JP) | 2000-369185 |
| Jul. 3, 2001 | (JP) | 2001-202156 |
| Jul. 3, 2001 | (JP) | 2001-202419 |

(51) Int. Cl.[7] ..... B32B 15/04; C23C 28/00

(52) U.S. Cl. ..... 428/659; 428/632; 428/626; 427/406; 427/372.2; 427/388.4; 427/419.2

(58) Field of Search ..... 428/609, 632, 428/633, 639, 626, 659; 148/253; 427/435, 406, 383.7, 372.2, 321, 397.7, 388.4, 419.2

(56) References Cited

U.S. PATENT DOCUMENTS

| | | | | | |
|---|---|---|---|---|---|
| 3,810,792 | A | * | 5/1974 | Ries et al. | 148/262 |
| 6,509,099 | B1 | * | 1/2003 | Urata et al. | 428/423.1 |
| 6,562,474 | B1 | * | 5/2003 | Yoshimi et al. | 428/472.3 |
| 2003/0072962 | A1 | * | 4/2003 | Matsuzaki et al. | 428/623 |
| 2003/0219621 | A1 | * | 11/2003 | Sodani et al. | 428/659 |

FOREIGN PATENT DOCUMENTS

| | | | |
|---|---|---|---|
| EP | 0 787 830 | A2 | 8/1997 |
| JP | 4-88196 | A | 3/1992 |
| JP | 4-176878 | A | 6/1992 |
| JP | 8-296058 | A | 11/1996 |
| JP | 9-170084 | A | 6/1997 |
| JP | 11-302862 | A | 11/1999 |

* cited by examiner

*Primary Examiner*—John J. Zimmerman
(74) *Attorney, Agent, or Firm*—Frishauf, Holtz, Goodman & Chick, P.C.

(57) ABSTRACT

The zinc-base plated steel sheet has a steel sheet, a zinc-base plating layer on the steel sheet, and a composite coating film formed on the plating layer, which composite coating layer contains a P ingredient, an N ingredient, and at least one element selected from the group consisting of Mg, Al, Ca, Ti, Fe, Co, Ni, Cu, and Mo, and is prepared by applying an aqueous solution containing a cationic ingredient ($\alpha$) and a phosphoric acid ingredient ($\beta$) onto the surface of plating layer on the zinc-base plated steel sheet, and then drying the applied aqueous solution, without giving washing with water, and which cationic ingredient ($\alpha$) consists essentially of at least one metallic ion selected from the group consisting of Mg, Al, Ca, Ti, Fe, Co, Ni, Cu, Mo, and $NH_4^+$ ions.

20 Claims, 1 Drawing Sheet

ZINC-BASED PLATED STEEL SHEET AND METHOD FOR MANUFACTURING SAME

This application is a continuation application of International Application PCT/JP01/09143 (not published in English) filed Oct. 18, 2001.

TECHNICAL FIELD

The present invention relates to a zinc-base plated steel sheet and a method for manufacturing same.

BACKGROUND ART

Owing to many advantageous characteristics, zinc-base plated steel sheets are widely used as various kinds of rust-preventive steel sheets. For using the zinc-base plated steel sheets as the rust-preventive steel sheets for automobiles, it is important for them to have corrosion resistance and coating adaptability, and further to have performance requested in the automobile body manufacturing process, including excellent press-formability, spot weldability, adhesiveness, and chemical conversion treatment performance.

The zinc-base plated steel sheets, however, generally have a drawback of poor press-formability compared with cold-rolled steel sheets. The inferiority is caused by higher sliding resistance between the zinc-base plated steel sheet and the press-die than that of the case of cold-rolled steel sheet. When the sliding resistance is high, the zinc-base plated steel sheet at sections near the bead portion becomes difficult in incoming into the press-die during pressing, which likely induces fracture of the steel sheet.

A method for applying high viscosity lubricant onto the zinc-base steel sheet is a common practice for improving the press-formability thereof. The method, however, raises problems of generation of coating defects in succeeding coating step caused by insufficient degreasing and of generation of unstable press performance caused by break of lubricant oil film. Consequently, the request for improving press-formability of zinc-base plated steel sheet is strong. Conventionally, the following-described technologies are presented to improve the press-formability of zinc-base plated steel sheet.

(1) JP-A-4-176878, (the term "JP-A" referred herein signifies the "Japanese Patent Laid-Open No."), discloses a zinc-base plated steel sheet having a layer consisting mainly of an oxide and/or a hydroxide of one or more metals selected from the group consisting of Mn, Mo, Co, Ni, Ca, Cr, V, W, Ti, Al, and Zn, and a coating film consisting mainly of an oxygen acid of P and B and/or an oxide colloid of one or more elements selected from the group consisting of Si, Al, and Ti.

(2) JP-A-8-296058 discloses a method for manufacturing zinc-base plated steel sheet containing the steps of activating the surface of the zinc-base plated steel sheet, and of forming an inorganic oxide coating film containing one or more of elements selected from the group consisting of Mn, Mo, Co, Ni, Ca, V, W, P, and B.

(3) JP-A-9-170084 discloses a plated steel sheet having a plating layer on a zinc-base plated steel sheet and an amorphous product generated from a reaction between phosphorus and zinc on the plating layer, and a method for manufacturing the plated steel sheet.

(4) JP-A-4-88196 discloses a zinc-base plated steel sheet having excellent press-formability and chemical conversion treatment performance, containing an amorphous P oxide coating on the zinc-base plated steel sheet.

These technologies described above, however, have problems shown below.

The technology (1) conducts treatment of the zinc-base plating layer using an aqueous solution containing an etching assistant such as sulfuric acid and an oxidizing agent such as nitric acid ion and potassium permanganate. If that type of aqueous solution contacts with the zinc-base plating layer, the zinc in the plating ingredients dissolves in the aqueous solution, thus the zinc likely enters the formed coating film. As a result, the formed coating film secures the adhesiveness at the interface with the plating layer, which allows maintaining the function for covering the plating layer following the deformation of the plating layer. The technology, however, has problems described below. That is, since the coating film as described above covers the zinc-base plating layer, the reaction between the chemical conversion treatment liquid and the zinc cannot fully proceed during the chemical conversion treatment which is given as the pre-coating treatment for automobile, (the term "chemical conversion treatment" referred herein is a phosphate treatment, and is expressed as the "chemical conversion treatment" to differentiate from the treatment applied in the present invention), which induces problems such as generation of coarse crystals or fail in generating crystals. Generally, the chemical conversion treatment liquid contains fluorine ion or the like to improve the etchability of coating film. If, however, that kind of additive is not added to the chemical conversion treatment liquid or if degradation in etchability occurs caused by the presence of impurities, the above-described coating film cannot fully be dissolved or cannot be removed during the chemical conversion treatment, which results in significant appearance of the above-described phenomenon.

The technologies (2) through (4) also have similar problems as given above. That is, the technology (2) has features of increasing the reactivity of plating layer and increasing the bonding force between the plating layer and the inorganic oxide coating film formed on the plating layer. The technology (3) has a feature of forming an amorphous product of the reaction between phosphoric acid and zinc on the surface of the plating layer. The technology (4) has a feature of covering the plated steel surface with an amorphous P oxide which does not dissolve even during the degreasing step. Because of these features, these technologies are difficult to remove the coating film during the chemical conversion treatment under a chemical conversion treatment condition of inferior in etchability, and the insufficient chemical conversion likely occurs.

Furthermore, the technologies (1) through (4) apply the zinc etching to intake the zinc in to the coating film. Generally, when phosphoric acid ion and zinc ion coexist, insoluble phosphate crystals are likely formed. Accordingly, if the zinc-base plated steel sheet is brought into contact with an aqueous solution containing phosphoric acid and having etchability function to dissolve zinc, the zinc which is an ingredient of crystal is successively supplied from the plating layer so that, when nuclei of phosphate crystals are once formed, the crystals are easily grown. For a coating layer containing that type of crystals, these crystal ingredients are removed during press-forming to deposit between the steel sheet and the press-die to degrade the slidability, thus inducing die galling, and may resulting in fracture of the material.

DISCLOSURE OF THE INVENTION

It is an object of the present invention to provide a zinc-base plated steel sheet having both excellent press-formability and excellent chemical conversion treatment performance.

It is another object of the present invention to provide a method for manufacturing stably a zinc-base plated steel sheet having both excellent press-formability and excellent chemical conversion treatment performance.

To attain the objects, the present invention provides a zinc-base plated steel sheet having a steel sheet, a zinc-base plating layer on the steel sheet, and a composite coating film formed on the surface of the plating layer.

The composite coating film contains a P ingredient and at least one element selected from the group consisting of an N ingredient, Mg, Al, Ca, Ti, Fe, Co, Ni, Cu, and Mo, as the ingredients for structuring the coating film.

The composite coating film has a molar ratio (a)/(b) of from 0.2 to 6, where (a) designates the total amount of at least one element selected from the group consisting of an N ingredient, Mg, Al, Ca, Ti, Fe, Co, Ni, Cu, and Mo, and (b) designates the amount of P ingredient. The amount of P ingredient is expressed by $P_2O_5$ conversion value, and the amount of N ingredient is expressed by ammonium conversion value.

The composite coating film has coating weights of from 5 to 300 mg/m$^2$ as the amount of P ingredient.

The composite coating film preferably contains a P ingredient and an N ingredient in a form selected from the group consisting of a nitrogen compound, a phosphorus-base compound, and a nitrogen-phosphorus-base compound.

The composite coating film preferably contains a P ingredient, an N ingredient, and at least one element selected from the group consisting of Mg, Al, Ca, Ti, Fe, Co, Ni, Cu, and Mo, as the ingredients for structuring the coating film.

The composite coating film preferably contains at least Fe as the metallic element. When the composite coating film contains at least Fe as the metallic element, the composite coating film preferably has a molar ratio (c)/(b) of 0.2 or more and less than 0.95, where (b) designates the amount of P ingredient, and (c) designates the amount of Fe.

The composite coating film preferably contains at least Al as the metallic element.

The composite coating film may further contain silica. In that case, the composite coating film has molar a ratio (d)/(b) of from 0.01 to 50, where (b) designates the amount of P ingredient, and (d) designates the amount of silica (d). The amount of silica is expressed by $SiO_2$ conversion value, and the amount of P ingredient is expressed by $P_2O_5$, conversion value.

The composite coating film may further contain a resin selected from the group consisting of a water-soluble resin and a water-dispersible resin, in an amount of from 0.01 to 1000 mg/m$^2$ in the coating film.

Furthermore, the present invention provides a method for manufacturing zinc-base plated steel sheet, comprising the steps of: applying an aqueous solution containing a cationic ingredient ($\alpha$) and a phosphoric acid ingredient ($\beta$) onto the surface of plating layer on the zinc-base plated steel sheet; and drying the applied aqueous solution, without giving washing with water, to form a coating film.

The cationic ingredient ($\alpha$) consists essentially of at least one metallic ion selected from the group consisting of Mg, Al, Ca, Ti, Fe, Co, Ni, Cu, Mo, and $NH_4^+$ ions.

The aqueous solution has a molar ratio ($\alpha$)/($\beta$) of from 0.2 to 6, where ($\alpha$) designates the sum of the amount of cationic ingredients and ($\beta$) designates the amount of phosphoric acid ingredient. The phosphoric acid is expressed by $P_2O_5$ conversion value.

The aqueous solution is preferably an aqueous solution belonging to any one of the following (1) through (3).

(1) The aqueous solution contains at least $NH_4^+$ as the cationic ingredient.

(2) The aqueous solution contains at least Fe as the cationic ingredient.

(3) The aqueous solution contains at least Al as the cationic ingredient.

For the case of (3), the aqueous solution preferably has a molar ratio ($\delta$)/($\beta$) of 1/10 or more and less than 2/3, where ($\beta$) designates the molar amount of phosphoric acid, and ($\delta$) designates the amount of Al. The phosphoric acid is expressed by $P_2O_5$ conversion value.

The aqueous solution may further contain silica ($\gamma$). In that case, the aqueous solution preferably has a molar ratio ($\gamma$)/($\beta$) of from 0.01 to 50, where ($\beta$) designates the amount of phosphoric acid ingredient, and ($\gamma$) designates the amount of silica. The silica is expressed by $SiO_2$ conversion value, and phosphoric acid is expressed by $P_2O_5$ conversion value.

The aqueous solution may further contain at least one resin selected from the group consisting of a water-soluble resin and a water-dispersible resin.

The aqueous solution may further contain carboxylic acid. The carboxylic acid is preferably oxycarboxylic acid. The oxycarboxylic acid is preferably citric acid.

EMBODIMENTS FOR CARRYING OUT THE INVENTION

Embodiment 1

Figure 1:
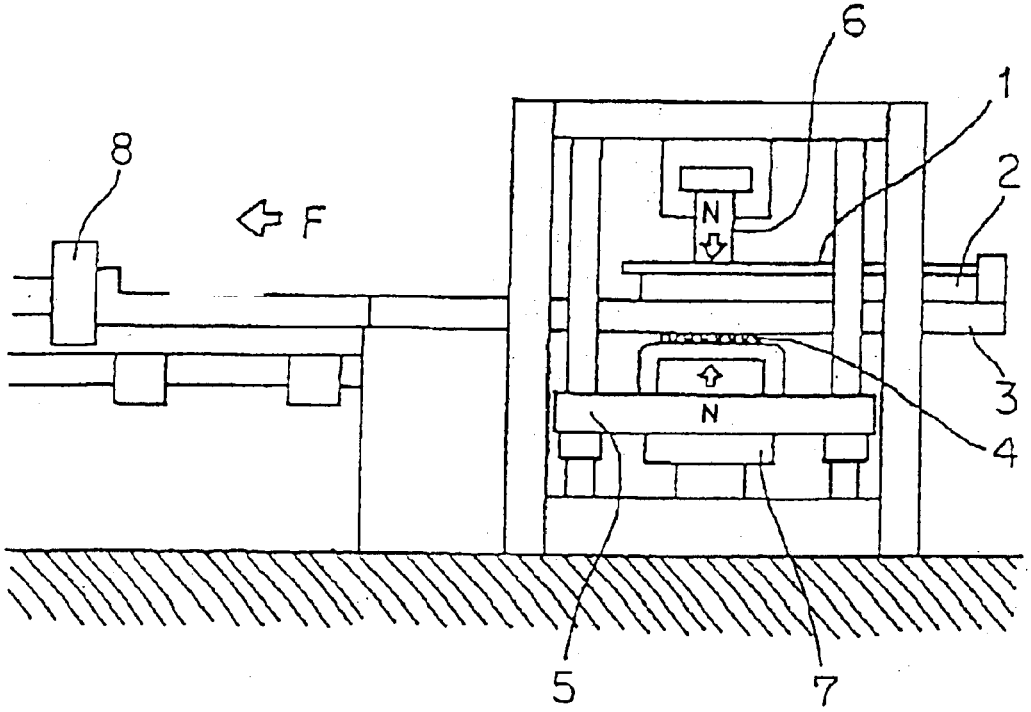
FIG. 1 is a front view of a friction tester used in the example.

The inventors of the present invention found that a zinc-base plated steel sheet having both excellent press-formability and excellent chemical conversion treatment performance is obtained by forming a metallic-element-laid phosphorus-base coating film having adequate kinds of ingredients and adequate range of composition onto the surface of plating layer of the zinc-base plated steel sheet, and found that that type of zinc plated steel sheet having both excellent press-formability and excellent chemical conversion treatment performance is stably attained by forming a coating film by applying a phosphoric acid-base aqueous solution having adequate kinds of ingredients and adequate range of composition onto the surface of plating layer of the zinc-base plated steel sheet.

The present invention was completed based on the above-described findings. The features of the present invention are the following.

[1] A zinc-base plated steel sheet having both excellent press-formability and excellent chemical conversion treatment performance is prepared by forming a metallic-element-laid phosphorus-acid-base oxide coating film on the surface of a plating layer on a zinc-base plated steel sheet, which coating film contains at least one element selected from the group consisting of Mg, Al, Ca, Ti, Fe, Co, Ni, Cu, and Mo, and a phosphorus-base oxide, as the ingredients for structuring the coating film, has molar ratios (a)/(b) of from 0.2 to 6, where (a) designates the sum of the amount of the metallic elements, and (b) designates the amount of the phosphorus-base oxide, (the amount of phosphorus-base oxide is expressed by $P_2O_5$ conversion value), and has coating weights of from 5 to 300 mg/m$^2$ as the P amount.

[2] A zinc-base plated steel sheet having both excellent press-formability and excellent chemical conversion treatment performance according to [1], wherein the metallic-element-laid phosphorus-base oxide coating film further contains silica, and has molar ratios (c)/(b) of from 0.01 to 50, where (c) designates the amount of silica, and (b) designates the amount of phosphorus-base oxide, (the amount of silica is expressed by $SiO_2$ conversion value, and the amount of phosphorus-base oxide is expressed by $P_2O_5$ conversion value).

[3] A zinc-base plated steel sheet having both excellent press-formability and excellent chemical conversion treatment performance according to [1] or [2], wherein the metallic-element-laid phosphorus-base oxide coating film further contains a water-soluble resin or a water-dispersible resin, at quantities of from 0.01 to 1000 mg/$m^2$ in the coating film.

[4] A zinc-base plated steel sheet having both excellent press-formability and excellent chemical conversion treatment performance according to any one of [1] through [3], wherein the metallic-element-laid phosphorus oxide coating film contains at least Al as the metallic element.

[5] A zinc-base plated steel sheet having both excellent press-formability and excellent chemical conversion treatment performance according to [4], wherein the molar ratio (d)/(b) is 1/10 or more and less than 2/3, which (b) designates the amount of phosphorus-base oxide, (the amount of phosphorus-base oxide is expressed by $P_2O_5$ conversion value), and (d)designates the amount of Al, existing in the metallic-element-laid phosphorus-base oxide coating film.

[6] A zinc-base plated steel sheet having both excellent press-formability and excellent chemical conversion treatment performance according to any one of [1] through [5], wherein the metallic-element-laid phosphorus-base oxide coating film contains at least Fe as the metallic element.

[7] A method for manufacturing zinc-base plated steel sheet having both excellent press-formability and excellent chemical conversion treatment performance comprising the steps of: applying an aqueous solution containing a cationic ingredient (α) and a phosphoric acid ingredient (β) onto the surface of plating layer on a zinc-base plated steel sheet; and drying the applied aqueous solution, without giving washing with water, to form a coating film, which cationic ingredient (β) consists essentially of at least one metallic ion selected from the group consisting of Mg, Al, Ca, Ti, Fe, Co, Ni, Cu, and Mo, and which aqueous solution has molar ratios (α)/(β) of from 0.2 to 6, where (α) designates the sum of the amount of cationic ingredients and (β) designates the amount of phosphoric acid ingredient, (the phosphoric acid is expressed by $P_2O_5$ conversion value).

[8] A method for manufacturing zinc-base plated steel sheet having both excellent press-formability and excellent chemical conversion treatment performance according to [7], wherein the molar ratio (α)/(β) is of from 0.4 to 6, where (α) designates the sum of the amount of cationic ingredients and (β) designates the amount of phosphoric acid ingredient, (the phosphoric acid is expressed by $P_2O_5$ conversion value).

[9] A method for manufacturing zinc-base plated steel sheet having both excellent press-formability and excellent chemical conversion treatment performance according to [7] or [8], wherein the aqueous solution applied onto the surface of plating layer further contains silica (γ), and the molar ratio (γ)/(β) is of from 0.01 to 50, where (γ) designates the amount of silica, (the silica is expressed by $SiO_2$ conversion value), and (β) designates the amount of phosphoric acid ingredient, (the phosphoric acid is expressed by $P_2O_5$ conversion value).

[10] A method for manufacturing zinc-base plated steel sheet having both excellent press-formability and excellent chemical conversion treatment performance according to any one of [7] through [9], wherein the aqueous solution applied onto the surface of plating layer further contains a water-soluble resin or a water-dispersible resin.

[11] A method for manufacturing zinc-base plated steel sheet having both excellent press-formability and excellent chemical conversion treatment performance according to any one of [7] through [10], wherein the aqueous solution applied onto the surface of plating layer contains at least Al as the cationic ingredient.

[12] A method for manufacturing zinc-base plated steel sheet having both excellent press-formability and excellent chemical conversion treatment performance according to [11], wherein the aqueous solution applied onto the surface of plating layer has molar ratios (δ)/(β) of 1/10 or more and less than 2/3, where (β) designates the amount of phosphoric acid ingredient, (the phosphoric acid is expressed by $P_2O_5$ conversion value), and (δ) designates the amount of Al as the cationic ingredient.

[13] A method for manufacturing zinc-base plated steel sheet having both excellent press-formability and excellent chemical conversion treatment performance according to any one of [7] through [12], wherein the aqueous solution applied onto the surface of plating layer contains at least Fe as the cationic ingredient.

[14] A method for manufacturing zinc-base plated steel sheet having both excellent press-formability and excellent chemical conversion treatment performance according to any one of [7] through [13], wherein the aqueous solution applied onto the surface of plating layer further contains carboxylic acid.

[15] A method for manufacturing zinc-base plated steel sheet having both excellent press-formability and excellent chemical conversion treatment performance according to [14], wherein the carboxylic acid in the aqueous solution applied onto the surface of plating layer is oxycarboxylic acid.

[16] A method for manufacturing zinc-base plated steel sheet having both excellent press-formability and excellent chemical conversion treatment performance according to [14], wherein the oxycarboxylic acid is citric acid.

The zinc-base plated steel sheet (zinc-base plated steel sheet as the mother material for coating treatment) according to the present invention is a plated steel sheet which is prepared by forming a zinc-base plating layer on the surface of a steel sheet using hot-dip plating process, electroplating process, or chemical vapor deposition process. Examples of the composition of zinc-base plating layer are a plating layer consisting of pure zinc, a single layer of, and a plurality of layers of one or more substances selected from the group consisting of a metal such as Fe, Ni, Co, Mn, Cr, Al, Mo, Ti, Si, W, Sn, Pb, Nb, and Ta, an oxide of the metal, and an organic compound of the metal. Those kinds of zinc-base plating layer may further contain oxide fine particles of $SiO_2$, $Al_2O_3$, and the like, or one or more of organic resin. The zinc-base plated steel sheet may be a multilayer plated steel sheet having plurality of plating layers having different plating compositions in each layer, or may be a functionally gradient plated steel sheet in which the compositions of plating layers are varied in a gradient pattern in the layer-thickness direction.

Examples of the zinc-base plated steel sheet are: hot-dip galvanized steel sheet; vapor deposition galvanized steel sheet; iron-zinc alloyed hot-dip galvanized steel sheet; zinc-aluminum-base hot-dip plated steel sheet (for example, Zn-5% Al alloy hot-dip plated steel sheet and Zn-55% Al alloy hot-dip plated steel sheet); alloyed hot-dip galvanized steel sheet in which only the plating layer near the steel sheet is alloyed, (generally called the "half-alloy"); plated steel sheet, one face of which consists of iron-zinc alloyed hot-dip zinc plating layer, while the other face of which consists of hot-dip zinc plating layer; plated steel sheet in which the plating layer on each of above-described steel sheets is further subjected to vapor deposition process or the like to form an alloy plating layer consisting of zinc or consisting mainly of zinc; and dispersion plated steel sheet having a plating layer having a matrix made by zinc and containing dispersed fine particles of $SiO_2$ or the like.

The zinc-base plated steel sheet according to the present invention is prepared by forming a metallic-element-laid phosphorus-base oxide coating film having an adequate range of ingredients and composition on the surface of plating layer on the above-described base material plated steel sheet, thus providing the zinc-base plated steel sheet having excellent chemical conversion treatment performance and excellent press-formability.

The detail of the present invention is described in the following along with the reasons of limiting the conditions.

Generally, conventional zinc-base plated steel sheets are inferior in the press-formability to the cold-rolled steel sheets. The reason of inferiority is the increase in the sliding resistance owing to the adhesion phenomenon appeared under a high face pressure between press-die and zinc having low melting point and having soft property. To avoid the drawback, it is effective to form a coating film having higher hardness and higher melting point than those of zinc or zinc alloy plating layer on the surface of the plating layer of zinc-base plated steel sheet.

To achieve the measures, the present invention forms a metallic-element-laid phosphorus-base coating film having high hardness and high melting point, containing specified metallic element ingredient and phosphorus-base oxide as the film-structuring ingredients, while controlling the composition ratio of the metallic element ingredient to the phosphorus-base oxide to a specific range, (hereinafter referred to simply as the "phosphorus-base oxide coating film"), on the surface of the plating layer. Since the phosphorus-base oxide coating film contains the specific metallic element ingredient and phosphorus-base oxide at a specific composition ratio, highly uniform covering on the surface of zinc-base plated steel sheet is available, and direct contact between zinc and die can be prevented even with a thin film. The availability of that uniform coating film owes to the functions of metallic element ingredient which structures the phosphorus-base oxide coating film.

The method for forming the phosphorus-base coating film is not specifically limited. Generally, however, the phosphorus-base coating film is formed by applying and drying an aqueous solution containing film ingredients. When the film ingredients are solely the phosphorus-base oxide, the etching action thereof induces the dissolution of zinc in the plating layer, and the dissolved zinc is caught as a coating film ingredient. In that case, zinc and phosphoric acid react to each other to likely yield a crystalline phosphate. When that type of crystalline phosphate is generated, the uniformity of coating film degrades, and the complete covering over the plating layer in a thin film state becomes difficult. To the contrary, for the case of phosphorus-base oxide coating film in which specific metallic-element-laid ingredient specified by the present invention exists, the reaction between the phosphoric acid and the zinc during the film-forming stage is suppressed, and the metallic element ingredient and the phosphorus-base oxide form a network coating film. That type of function is attained when the metallic element ingredient is one or more elements selected from the group consisting of Mg, Al, Ca, Ti, Fe, Co, Cu, Mo, and Ni, and when the molar ratio (a)/(b) is in a specified range, thus allowing forming uniform coating film, where (a) designates the total amount of these metallic elements, and (b) designates the amount of phosphorus-base oxide, (the amount of phosphorus-base oxide is expressed by $P_2O_5$ conversion value).

Although the mechanisms that the presence of above-described metallic element ingredients contributes to the formation of uniform network coating film are not fully analyzed, presumable mechanisms include that the reaction between the phosphoric acid ingredient and the zinc in plating layer is suppressed during film-forming step, thus suppressing the generation of above-described crystalline ingredients, and that the above-described metallic element ingredients and the phosphorus-base oxide form an inorganic polymer.

The following is the description of the relation between the above-described phosphorus-base oxide coating film and the chemical conversion treatment performance.

In usual practice, degreasing step is adopted as a pretreatment of chemical conversion treatment step to remove the press oil applied in the press working step. Since the phosphorus-base coating film containing metallic element, formed on the surface of plating layer according to the present invention, is easily dissolved by an alkali degreasing liquid, most part of the coating film is removed in the degreasing step. As a result, the chemical conversion treatment step is carried out in a state that the coating film is almost dissolved and removed, thus favorable phosphoric acid crystals are formed on the plating surface. In addition, even when insufficient removal of phosphorus-base oxide coating film (dissolving to remove the coating film) during the degreasing step resulted to give a remained coating film in a part thereof caused by insufficient flow-in of degreasing liquid because of the degradation of degreasing liquid or depending on the positions, the zinc-base plated steel sheet according to the present invention can provide favorable chemical conversion treatment performance. The reason of the availability is that the coating film has satisfactory dissolving property not only in the degreasing liquid but also in the chemical conversion treatment liquid because the specified metallic element ingredients are adopted as the film-structuring ingredients and because the composition ratio thereof is limited to a specified range.

That is, the dissolving property of above-described coating film, (film-removability), differs with the ratio of the metallic element ingredients to the phosphorus-base oxide, both of which structure the coating film. Generally, increase in the amount of phosphorus-base oxide compared with the amount of metallic element ingredients increases the dissolving property of the coating film itself. Since, however, the formation of a coating film containing large amount of phosphorus-base oxide needs to apply and dry an aqueous solution containing large amount of ingredient such as phosphoric acid having high etchability, the amount of zinc caught by the coating film increases, thus degrading the dissolving property of the coating film. Therefore, it is necessary for the amount of phosphorus-base oxide and the amount of metallic element ingredients to be balanced between the securing dissolving property of coating film itself and the effect to suppress the intake of zinc by etching. When the amount of metallic element ingredients becomes extremely excessive against the amount of phosphorus-base oxide, the performance of the coating film to form network degrades. In that case, formation of uniform coating film becomes difficult, though the dissolving property of the coating film increases, thus the excellent press-formability also becomes difficult to attain.

The above-described phosphorus-base oxide coating film contains zinc which unavoidably enters from the plating layer. The phosphorus-base oxide coating film according to the present invention does not specially limit the amount of existing zinc because excellent chemical conversion treatment performance is available even when the coating film contains zinc owing to the existence of metallic element ingredients and the phosphorus-base oxide at a specific ratio.

The following is the description of the ingredients of phosphorus-base oxide coating film and the reasons for limiting them according to the present invention.

The phosphorus-base coating film contains a phosphorus-base oxide, and further one or more metallic elements selected from the group consisting of Mg, Al, Ca, Ti, Fe, Co, Ni, Cu, and Mo, as the ingredient to provide the coating film with dissolving property. The existing form of the metallic element ingredient is not specifically limited, and may be in a form of metal, oxide, or compound with phosphoric acid ingredient. Metallic element ingredients other than those given above are preferably not existed, as far as possible, excluding the zinc which unavoidably enters the coating film. Consequently, the phosphorus-base oxide coating film according to the present invention preferably consists essentially of one or more metallic element ingredients specified above, a phosphorus-base oxide, and, silica and an organic resin which are added at need as described later, with balance of inevitable impurities such as zinc.

The molar ratio (a)/(b) is 0.2 to 6, where (a) designates the sum of the amount of above-described metallic elements, and (b) designates the amount of phosphorus-base oxide in the phosphorus-base oxide coating, (the amount of phosphorus-base oxide is expressed by $P_2O_5$ conversion value). If the molar ratio (a)/(b) is less than 0.2, the rate of the phosphorus-base oxide becomes excessive, which likely results in non-uniform coating film, further likely induces degradation of press-formability. Furthermore, since the phosphorus-base oxide film becomes difficult to be removed during the chemical conversion treatment, the chemical conversion treatment performance also degrades. On the other hand, if the molar ratio (a)/(b) exceeds 6, the rate of the metallic element ingredients becomes excessive, which also degrades the uniformity of coating film, and thin film portion and thick film portion likely become coexist. As a result, during the chemical conversion treatment which is the pre-coating treatment in the automobile manufacturing process, the reaction with treatment liquid is hindered at the thick film portion, which results in difficulty in generating favorable phosphoric acid crystals to induce insufficient chemical conversion treatment. In addition, the degradation in the uniformity of coating film gives less effect of improving the press-formability. Furthermore, since the stability of coating film is low, under the storage in humid environment or in condensation environment, a part of the coating film dissolves to act as an electrolyte to induce corrosion of the zinc-base plated steel sheet.

Further preferable molar ratio (a)/(b) is 0.2 or more and less than 1, where (a) designates the total amount of these metallic elements, and (b) designates the amount of phosphorus-base oxide, (the amount of phosphorus-base oxide is expressed by $P_2O_5$ conversion value). If the molar ratio (a)/(b) becomes 1 or more, the metallic element ingredient and the phosphoric acid ingredient likely react to each other to generate crystalline property, which is disadvantage in forming uniform coating film and which gives degradation in press-formability to some extent. Most preferable lower limit of the molar ratio (a)/(b) is 0.4.

As of the above-described metallic element ingredients, more preferable ones are Al, Fe, and Co. If the coating film contains these preferable metallic element ingredients, the coating film more easily dissolves in the chemical conversion treatment liquid to provide better chemical conversion treatment performance.

Among these preferable metallic element ingredients, Al specifically improves the coating film in terms of uniform covering and film-removability (dissolving property). Although the reason is not fully analyzed, a presumable one is the high network-forming performance owing to the combination of Al with phosphoric acid ingredient. For the case of Al, the film-removability in the pretreatment of the chemical conversion treatment is particularly favorable compared with other metallic elements. In addition, the dissolving property of coating film in the chemical conversion treatment liquid is high, and excellent chemical conversion treatment performance is attained even when the film-removal is insufficient during degreasing step. Since Al has high network-forming property with the phosphoric acid ingredient, when aqueous solution containing Al ion and phosphorus ingredient is heated to 80° C. to 120° C. and then dried, a gel compound is readily obtained, thus the coating film having high uniformity should be attained. Furthermore, since the phosphoric acid ingredient and the Al ingredient likely form a gel compound in the drying step, the amount of zinc etching by the phosphoric acid ingredient becomes less. As a result, the amount of zinc entered the coating film should become less, and the coating film becomes a soluble composition. In addition, since Al has high water-retaining property, when the coating film contacts with alkali degreasing liquid, the compound should likely catch water to readily dissolve.

In the case of expecting above-described effect, therefore, it is preferable that the phosphorus-base oxide coating film contains at least Al as the metallic element, and more preferably, sole Al as the metallic element, or Al with Fe (which will be described later) exist in the coating film.

The form of the Al in the coating film is not specifically limited, and it may be in a form of metal, oxide, compound with phosphoric acid ingredient.

When the phosphorus-base oxide coating film contains Al as the metallic element ingredient, the molar ratio (d)/(b) is preferably 1/10 or more and less than 2/3, where (d) designates the amount of Al in the coating film, and (b) designates the amount of phosphorus-base oxide in the coating film (the amount of phosphorus-base oxide is expressed by $P_2O_5$ conversion value). With that range of the molar ratio (d)/(b), the press-formability and the chemical conversion treatment performance are further improved. A presumable reason of the improvement is that the coating film uniformity and the coating film dissolving property are further improved in that molar ratio range. The molar ratio (d)/(b)=2/3 corresponds to the composition of aluminum primary phosphate ($Al(H_2PO_4)_3$). If the molar ratio (d)/(b) becomes 2/3 or more, the amount of Al becomes excessive, which should likely induce the generation of crystalline ingredient and bring the coating film insoluble.

When the phosphorus-base oxide coating film contains Fe as the metallic element ingredient, the growth of phosphate crystals is very little hindered during the chemical conversion treatment so that specifically superior chemical conversion treatment performance is attained. Although the reason of the superiority is not fully analyzed, it is confirmed that, when the phosphorus-base oxide coating film contains Fe, the chemical conversion crystals are generated even when the coating film is left during the chemical conversion treatment. The film-removability of the phosphorus-base oxide coating film during the degreasing step significantly differs with the state of alkali degreasing liquid and the condition of degreasing. Under a condition of extremely degraded degreasing liquid or of not applying strong degreasing such as spray degreasing, sufficient degreasing may not be performed. In such a case, the phosphorus-base oxide coating film containing Fe effectively functions to attain the chemical conversion treatment performance.

Generally, automobile use and household electric appliances use adopt the joining steel sheets using adhesives to increase the corrosion resistance. In that case, the presence of coating film which was added to increase the lubrication characteristic may significantly degrade the adhesiveness of joining parts. Conventional lubrication coating film containing phosphoric acid particularly shows the tendency, and the improvement has been wanted. To that kind of issue, the above-described phosphorus-base oxide coating film shows significant improvement in the compatibility with adhesives by adding Fe as the metallic element ingredient to the phosphorus-base oxide coating film.

Consequently, when the above-given effect is expected, it is preferred that the phosphorus-base oxide coating film contains at least Fe as the metallic element, and more preferably contains sole Fe or Fe with above-described Al.

The form of the Fe in the coating film is not specifically limited, and it may be in a form of metal, oxide, or compound with phosphoric acid ingredient.

The phosphorus-base oxide coating film according to the present invention may further contain silica. By adding silica to the phosphorus-base oxide coating film, the sliding performance is further improved. A presumable reason of improvement in slidability is that the silica ingredient has an effect to increase the water-retaining capacity and that the silica ingredient acts as a lubricant in a dry friction state. Furthermore, when a film-forming method applying aqueous solution and drying the solution is adopted, the addition of silica to the coating film improves the wetting property of the zinc-base plating film with the aqueous solution, which allows forming uniform coating film on the plating layer.

When silica is added to the phosphorus-base oxide coating film, the effect of silica becomes significant at a range of 0.01 to 50 of the molar ratio (c)/(b), where (c) designates the amount of silica in the coating film (the amount of silica is expressed by $SiO_2$ conversion value), and (b) designates the amount of phosphorus-base oxide in the coating film (the amount of phosphorus-base oxide is expressed by $P_2O_5$, conversion value). If the molar ratio (c)/(b) is less than 0.1, the effect of silica addition cannot fully be attained. If the molar ratio (c)/(b) exceeds 50, the amount of silica becomes excessive, which results in chipping the silica ingredient during press-forming to cause surface defects and galling.

Applicable silica may be silica sol or dry silica such as fumed silica. Examples of silica sol are "Snowtex" (trade mark: O, OS, OUP, AK, N, 20, 30, 40) (manufactured by Nissan Chemical Industries, Ltd.), "Cataloid" (trade name: S, SI, SA, SN) (manufactured by CATALYSTS & CHEMICALS IND. CO., LTD.), and "Adelite" (trade name: AT-20, AT-50, AT-20N, AT-300, AT-300S, AT-20Q). (manufactured by Asahi Denka Kogyo K. K.) As of these silica sols, the type of neutralized in surface potential by ammonium ion is particularly preferable. Examples of fumed silica are "AEROSIL 200" and "AEROSIL 300" (manufactured by Nippon Aerosil Co., Ltd.)

The phosphorus-base oxide coating film according to the present invention may further contain an organic resin ingredient to improve the lubrication performance. A preferable organic resin is water-soluble resin and/or water-dispersible resin, which can coexist with other inorganic ingredient in aqueous solution. Examples of the organic resin are epoxy resin, acrylic resin, acrylic-ethylene copolymer, acrylic-styrene copolymer, alkyd resin, polyester resin, polyurethane resin, polybutadiene resin, or polyamide resin. Adding to these resins, coexistence of cross-linking agent is effective, which cross-linking agent includes water-soluble epoxy resin, water-soluble phenol resin, water-soluble butadiene rubber (SBR, NBR, MBR), melamine resin, block isocyanate, and oxazoline compound.

A preferred coating weight of the organic resin added to the phosphorus-base oxide coating film is 0.01 to 1000 $mg/m^2$. If the amount of organic resin is less than 0.01 $mg/m^2$, the effect cannot fully be attained. If the amount thereof exceeds 1000 $mg/m^2$, the coating film thickness increases to likely induce the film separation, which fails in attaining satisfactory effect.

The zinc-base plated steel sheet according to the present invention specifies the coating weight of the phosphorus-base oxide coating film formed on the plating layer to a range of from 5 to 300 $mg/m^2$ as the P amount, preferably from 10 to 150 $mg/m^2$, and more preferably from 30 to 120 $mg/m^2$. If the coating weight is small, the effect to improve the press-formability cannot fully be attained. If the coating weight is excessive, the chemical conversion treatment performance degrades.

The phosphorus-base oxide coating film according to the present invention may be in either form of crystalline or amorphous if only the film-removability and the uniform covering of the coating film are secured. Furthermore, the coating film allows existence of $H_2O$ ingredient as the water of crystallization accompanied with the crystalline ingredient, and of $H_2O$ ingredient existing in amorphous film.

The following is the description of the method for manufacturing zinc-base plated steel sheet having the above-described phosphorus-base oxide coating film.

The phosphorus-base oxide coating film on the zinc-base plated steel sheet according to the present invention is prepared, for example, by applying an aqueous solution containing cationic ingredient of above-described metallic element and phosphoric acid ion onto the surface of plating layer, followed by drying the aqueous solution. In that case, the ratio of the cationic ingredient and the phosphoric acid ingredient in the aqueous solution may be varied responding to the composition of the coating film.

According to the method for manufacturing zinc-base plated steel sheet of the present invention, an aqueous solution containing a cationic ingredient ($\alpha$) and a phosphoric acid ingredient ($\beta$) as the anionic ingredient are applied onto the surface of plating layer on the zinc-base plated steel sheet, and the applied aqueous solution is dried, without giving washing with water, to form the coating film, which cationic ingredient ($\alpha$) consists essentially of at least one metallic ion selected from the group consisting of Mg, Al, Ca, Ti, Fe, Co, Ni, Cu, and Mo, and which aqueous solution has specific range of molar ratio ($\alpha$)/($\beta$) of from 0.2 to 6. As a result, a hard and thin coating film having high melting point, containing specified metallic element and phosphorus-base oxide, is formed uniformly and densely on the surface of the zinc-base plating coating film.

In common practice, to form a coating film containing phosphorus, such as the phosphate coating film on the surface of zinc-base plated steel sheet, the treatment of, for example, immersing the plated steel sheet in an aqueous solution containing phosphoric acid ion is applied. Generally, the phosphate containing cation other than alkali metal makes the aqueous solution acidic because that type of phosphate is not soluble in alkali domain. Furthermore, the aqueous solution of these cationic ingredients and the phosphoric acid likely generates precipitation. Normally the aqueous solution is stable when the phosphoric acid ion exists in excess amount compared with the cationic ingredient. In that kind of aqueous solution with excess amount of phosphoric acid, the zinc in the plating layer is easily etched, and the eluted zinc tends to react with the phosphoric acid ion to form crystals or to form a reaction layer containing zinc at the interface. As described before, when crystalline ingredients exist in excessive amount in the coating film, these crystalline ingredients are separated during press-forming to deposit between the coating film and the die to degrade the sliding performance, which likely induces die-galling and other defects. In addition, since zinc and coating film form a reaction layer, the film removal during the chemical conversion treatment becomes difficult to occur, which results in insufficient chemical conversion treatment performance.

To the contrary, the aqueous solution for film-forming according to the present invention specifies the ratio of the amount of cationic ingredient to the amount of phosphoric acid ingredient, and keeps the phosphoric acid ion concentration low compared with the cationic ingredient concentration, thus suppresses the reactivity of the treated liquid to minimize the etching of zinc in the plating layer. As a result, the treatment according to the present invention allows obtaining zinc-base plated steel sheet which shows excellent press-formability without degrading the chemical conversion treatment performance.

The following is more detail description of the present invention.

Degreasing step for removing press-oil is generally applied as the preliminary treatment of the chemical conversion treatment. For the coating film which is formed by the treatment according to the present invention, the formation of a layer reacting with zinc is suppressed, and the interface to the zinc-base plating layer is likely dissolved by the alkali degreasing liquid, thus most part of the coating film is removed during the degreasing step. Consequently, the coating film is almost completely dissolved during the chemical conversion treatment to form favorable phosphate crystals. With that type of function, even when the film-removability is insufficient during the degreasing step to result in remained coating film in a part thereof caused by insufficient flow-in of degreasing liquid because of the degradation of degreasing liquid or depending on the positions, the zinc-base plated steel sheet according to the present invention can provide favorable chemical conversion treatment performance.

Presumable main reasons for the zinc-base plated steel sheet according to the present invention to show favorable chemical conversion treatment performance are the following.

(1) As described later, since a dense and uniform coating film is formed on the surface of the plating layer, satisfactory press-formability is attained even with very thin coating film. Therefore, the coating film does not become thick one to hinder the reaction with the chemical conversion treatment liquid.

(2) Since the formation of a layer reacting with zinc is suppressed, the separation of coating film in the chemical conversion treatment liquid likely occurs.

According to the present invention, the molar ratio of the cationic ingredient ($\alpha$) (cationic ingredient consists of one or more metallic ions selected from the group consisting of Mg, Al, Ca, Ti, Fe, Co, Ni, Cu, and Mo) in the aqueous solution to the phosphoric acid ion ($\beta$) in the aqueous solution for forming the coating film is specified to a specific range. As a result, uniform and dense thin coating film is formed, and furthermore, as described above, the zinc etching in the plating layer is minimized to suppress the formation of the layer reacting with zinc. A presumable reason of forming the uniform and dense coating film is that, as described above, the cationic ingredient reacts with the phosphoric acid to generate an insoluble compound during the drying step after applying the aqueous solution, which insoluble compound contributes to the formation of dense coating film to cover the plating layer uniformly. Although the reason that the ratio of the cationic ingredient ($\alpha$) in the aqueous solution to the phosphoric acid ion ($\beta$) in the aqueous solution gives influence on the coating form is not fully determined, a presumable reason is that the etchability of the treatment liquid and the dissolving property of the treatment liquid vary with the ratio of these ingredients so that these variations induce the changes in coating film form. That is, when the amount of phosphoric acid ion ($\beta$) is excessive, the etchability of the treatment liquid increases, and the crystalline ingredient is likely formed by the reaction with zinc, thus the coating film form becomes aggregate of lumpy crystalline ingredients, rather than thin film. On the other hand, if the amount of cationic ingredient ($\alpha$) is excessive, the dissolving property of the treatment liquid increases, and the coating film is difficult to gel during the drying step, thus uniform coating film is difficult to be formed.

The ratio of the cationic ingredient ($\alpha$) consisting of one or more metallic ions selected from the group consisting of Mg, Al, Ca, Ti, Fe, Co, Ni, Cu, and Mo to the phosphoric acid ion ($\beta$) (the phosphoric acid is expressed by $P_2O_5$ conversion value) is specified to a range of from 0.2 to 6. If the molar ratio ($\alpha$)/($\beta$) is less than 0.2, the amount of phosphoric acid ion becomes excessive, and the crystalline ingredient of zinc and phosphoric acid is likely formed, which is difficult to attain excellent slidability. Furthermore, since the coating film becomes difficult to be removed during the chemical conversion treatment, the chemical conversion treatment performance degrades. If the molar ratio ($\alpha$)/($\beta$) exceeds 6, the formed coating film becomes non-uniform so that the thin film portion and the thick film portion likely become coexist. As a result, during the chemical conversion treatment as the pre-coating treatment in the automobile manufacturing process, the reaction with the treatment liquid is hindered by the thick portion of the coating film, and the favorable phosphate crystals are difficult to be formed, which results in insufficient chemical conversion treatment. In addition, since the uniformity of the coating film degrades, the effect to improve the press-formability becomes small. Furthermore, since the dissolving property of the coating film increases, under the storage in humid environment or in condensation environment, a part of the coating film dissolves to act as an electrolyte to induce corrosion of the zinc-base plated steel sheet. More preferable range of molar ratio ($\alpha$)/($\beta$) is 0.2 or more and less than 1. If the molar ratio ($\alpha$)/($\beta$) becomes 1 or more, the metallic element ingredient and the phosphoric acid ingredient likely react with each other to generate crystalline property, which is disadvantage in forming uniform coating film and which gives degradation in press-formability to some extent. More preferable lower limit of the molar ratio ($\alpha$)/($\beta$) is 0.4.

As of the above-described metallic ions, more preferable ones are Al, Fe, and Co. If the coating film contains these preferable metallic ions, the coating film more easily dissolves in the chemical conversion treatment liquid to provide better chemical conversion treatment performance.

Among these preferable metallic ions, Al specifically improves the coating film in terms of uniform covering and film-removability (dissolving property). Although the reason is not fully analyzed, a presumable one is the high network-forming performance owing to the combination of Al with phosphoric acid ingredient. For the case of Al, the film-removability in the pretreatment of the chemical conversion treatment is particularly favorable compared with other metallic elements. In addition, the dissolving property of coating film in the chemical conversion treatment liquid is high, and excellent chemical conversion treatment performance is attained even when the film-removal is insufficient during degreasing step. Since Al has high network-forming property with the phosphoric acid ingredient, when aqueous solution containing Al ion and phosphorus ingredient is heated to 80° C. to 120° C. and then dried, a gel compound is readily obtained, thus the coating film having high uniformity should be attained. Furthermore, since the phosphoric acid ingredient and the Al ingredient likely form a gel compound in the drying step, the amount of zinc etching by the phosphoric acid ingredient becomes less. As a result, the amount of zinc entered the coating film should become less, and the coating film becomes a soluble composition. In addition, since Al has high water-retaining property, when the coating film contacts with alkali degreasing liquid, the compound should likely catch water to readily dissolve.

In the case of expecting above-described effect, therefore, it is preferable that the phosphorus-base oxide coating film contains at least Al as the metallic ion, and more preferably, sole Al as the metallic ion, or Al with Fe (which will be described later) are existed in the coating film.

When the aqueous solution for forming the coating film contains Al as the metallic ion, the molar ratio $(\delta)/(\beta)$ is preferably $1/10$ or more and less than $2/3$, where $(\delta)$ designates the amount of Al, and $(\beta)$ designates the amount of phosphoric acid ingredient (the amount of phosphoric acid is expressed by the $P_2O_5$ conversion value). With that range of the molar ratio $(\delta)/(\beta)$, the press-formability and the chemical conversion treatment performance are further improved. A presumable reason of the improvement is that the coating film uniformity and the coating film dissolving property are further improved in that molar ratio range. If the molar ratio $(\delta)/(\beta)$ becomes $2/3$ or more, the amount of Al becomes excessive, which should likely induce the generation of crystalline ingredient and bring the coating film insoluble.

When the aqueous solution for forming coating film contains Fe as the metallic ion, the growth of phosphate crystals is very little hindered during the chemical conversion treatment so that specifically superior chemical conversion treatment performance is attained. Although the reason of the superiority is not fully analyzed, when the aqueous solution contains Fe, the chemical conversion crystals are generated even when the coating film is left during the chemical conversion treatment. The film-removability of the phosphorus-base oxide coating film during the degreasing step significantly differs with the state of alkali degreasing liquid and the condition of degreasing. Under a condition of extremely degraded degreasing liquid or of not applying strong degreasing such as spray degreasing, sufficient degreasing may not be performed. In such a case, the aqueous solution containing Fe effectively functions to attain the chemical conversion treatment performance.

Generally, automobile use and household electric appliances use adopt the joining steel sheets using adhesives to increase the corrosion resistance. In that case, the presence of coating film which was added to increase the lubrication characteristic may significantly degrade the adhesiveness of joining parts. Conventional lubrication coating film containing phosphoric acid particularly shows the tendency, and the improvement has been wanted. To that kind of issue, the above-described phosphorus-base oxide coating film shows significant improvement in the compatibility with adhesives by adding Fe as the metallic ion to the aqueous solution.

Consequently, when the above-given effect is expected, it is preferred that the aqueous solution contains at least Fe as the metallic ion, and more preferably contains sole Fe or Fe with above-described Al.

A preferable aqueous solution for forming the coating film according to the present invention is a mixture of an oxide or a hydroxide of above-described cationic ingredients (one or more metallic ions selected from the group consisting of Mg, Al, Ca, Ti, Fe, Co, Ni, Cu, and Mo) and phosphoric acid to establish a specified rate of the cationic ingredient because the aqueous solution does not contain other anionic ingredient and because no soluble ingredient is left in the coating film. Furthermore, it is more preferable to use an aqueous solution in which the metallic cationic ingredient and the phosphoric acid ingredient react with each other at a specified temperature and for a specified period to minimize the amount of free phosphoric acid because the networking performance of the coating film further increases.

The metallic ions of one or more element selected from the group consisting of Mg, Al, Ca, Ti, Fe, Co, Ni, Cu, and Mo may be added in a form of, other than phosphate, water-soluble metallic salt such as nitrate, sulfate, and acetate.

When a metallic salt other than phosphate is used, if the anionic ingredients other than phosphoric acid exist in excessive amount, these ingredients act as the water-soluble ingredients in the coating film after dried, thus the added amount of these ingredients is preferably minimized.

Since the phosphoric acid ion in the aqueous solution for forming the coating film varies its own form depending on the pH of aqueous solution, the degree of polymerization of the added phosphoric acid, the oxidized state, and the like, the existence form of the phosphoric acid ion is not specifically limited. Accordingly, the phosphoric acid ion may be the ion of arbitrary form such as condensed phosphoric acid such as ortho phosphoric acid, diphosphoric acid, tripolyphosphoric acid, tetrapolyphosphoric acid, and hexametaphosphoric acid, phosphorous acid, and phosphinic acid.

The phosphoric acid ion added to the aqueous solution may be in a form of ammonium phosphate, phosphoric acid, diphosphoric acid, tripolyphosphoric acid, tetrapolyphosphoric acid, hexametaphosphoric acid, phosphorous acid, phosphinic acid, or their ammonium salt.

The cationic ingredient $(\alpha)$ contained in the aqueous solution for forming the coating film according to the present invention consists essentially of one or more metallic elements selected from the group consisting of Mg, Al, Ca, Ti, Fe, Co, Cu, and Mo, and no other cationic ingredient is added except for the cationic ingredients existing as impurities.

In particular, alkali metal is not preferable because the alkali metal likely induces leaving a soluble ingredient in the coating film. Zinc ion is also not preferable because the zinc ion likely forms crystalline coating film.

As for the anionic ingredients, when cationic ingredient is added to the aqueous solution in a form of oxide of nitrate, sulfate, acetate, or the like, hydroxide, or salt other than phosphate, anionic ingredient such as nitric acid ion, sulfuric acid ion, and acetic acid ion may be existed. The aqueous solution for forming coating film according to the present invention may further contain an adequate amount of silica (γ). The addition of silica (γ) allows forming a coating film having further preferable press-formability and chemical conversion treatment performance. The addition of silica (γ) further provides more significant effect to improve the press-formability with thin coating film. A presumable reason of the effect is that the added silica improves the wetting property of aqueous solution for forming coating film, thus forming uniform coating film giving no microscopic water-repellence on the plating layer. Since further significant effect to improve the press-formability is provided even for that thin coating film, the removal of coating film during the chemical conversion treatment easily occurs to improve the chemical conversion treatment performance.

The amount of added silica (γ) is specified to a range of molar ratio to the phosphoric acid ion (β), (γ)/(β), of from 0.01 to 50, where the amount of silica is expressed by $SiO_2$ conversion value, and the amount of phosphoric acid ion is expressed by $P_2O_5$ conversion value.

If the molar ratio (γ)/(β) is less than 0.01, the effect of silica addition cannot fully be attained. If the molar ratio (γ)/(β) exceeds 50, the silica ingredient exists in excess amount, which chips the silica ingredient during press-forming to induce surface defects such as dents and to induce galling.

As for the silica (γ), silica sol or dry silica such as fumed silica may directly added to the aqueous solution.

Examples of silica sol are "Snowtex" (trade mark: O, OS, OUP, AK, N, 20, 30, 40) (manufactured by Nissan Chemical Industries, Ltd.), "Cataloid" (trade name: S, SI, SA, SN) (manufactured by CATALYSTS & CHEMICALS IND. CO., LTD.), and "Adelite" (trade name: AT-20, AT-50, AT-20N, AT-300, AT-300S, AT-20Q) (manufactured by Asahi Denka Kogyo K. K.) As of these silica sols, the type of neutralized in surface potential by ammonium ion is particularly preferable. Examples of fumed silica are "AEROSIL 200" and "AEROSIL 300" (manufactured by Nippon Aerosil Co., Ltd.)

To the aqueous solution for forming coating film according to the present invention, an adequate amount of organic resin ingredient may further be added. The addition of the organic resin ingredient further improves the lubrication performance of the coating film. A preferable organic resin is water-soluble resin and/or water-dispersible resin, which can coexist with other inorganic ingredient in aqueous solution. Examples of the organic resin are epoxy resin, acrylic resin, acrylic-ethylene copolymer, acrylic-styrene copolymer, alkyd resin, polyester resin, polyurethane resin, polybutadiene resin, or polyamide resin. Adding to these resins, coexistence of cross-linking agent is effective, which cross-linking agent includes water-soluble epoxy resin, water-soluble phenol resin, water-soluble butadiene rubber (SBR, NBR, MBR), melamine resin, s block isocyanate, and oxazoline compound.

The coating weight of the organic resin in the phosphorus-base oxide coating film may be adjusted by varying the concentration of the resin in the aqueous solution for forming coating film. A preferred coating weight of the organic resin added to the phosphorus-base oxide coating film is 0.01 to 1000 $mg/m^2$. If the amount of organic resin is less than 0.01 $mg/m^2$, the effect cannot fully be attained. If the amount thereof exceeds 1000 $mg/m^2$, the coating film thickness increases to likely induce the film separation, which fails in attaining satisfactory effect.

The aqueous solution according to the present invention may further contain carboxylic acid. The addition of carboxylic acid particularly enhances the dissolving property of the coating film during the alkali degreasing before the chemical conversion treatment. A presumable reason of the enhancement is that the applying and drying the aqueous solution containing organic acid such as carboxylic acid makes the coating film soluble, thus allows the coating film to be easily removed or dissolved. Applicable carboxylic acid includes formic acid, acetic acid, lactic acid, oxalic acid, and citric acid. Specifically, oxycarboxylic acid (also called "oxyacid") particularly improves the dissolving property of the coating film. A presumable reason of the improvement is that the phosphoric acid ingredient and the metallic element ingredient are combined with the oxycarboxylic acid to form a glassy coating film which is readily dissolved. A presumable reason of easily dissolving the coating film is that the presence of hydroxyl group in the oxycarboxylic acid enhances the hydrophilic property of the coating film, thus enhancing the penetration of alkali degreasing liquid into the coating film, which improves the film-removal performance, or which makes the coating film itself readily dissolve. Applicable oxycarboxylic acid includes tartaric acid, lactic acid, glyceric acid, malic acid, salicylic acid, and citric acid. As of these, citric acid is particularly effective.

According to the present invention, above-described specific metallic ion is added as the cationic ingredient to the aqueous solution for forming coating film. If, however, the metallic ion concentration in the aqueous solution increases to high pH exceeding 3, the aqueous solution may not exist in stable state. For the case of Fe ion, as an example, coexistence with phosphoric acid ion likely brings the aqueous solution to gelling. In that case, the gelling of aqueous solution can be prevented by adding a carboxylic acid to form a complex with the metallic ion. Examples of applicable carboxylic acid are formic acid, acetic acid, lactic acid, oxalic acid, tartaric acid, and citric acid.

Particularly for the aqueous solution containing Fe ion, the addition of citric acid is especially effective because the combination improves the stability of the aqueous solution to suppress the gelling of the aqueous solution.

Although there is no specific limit on the method to let that kind of carboxylic acid exist in the aqueous solution, generally it is preferable that carboxylic acid or a carboxylic acid salt of various kinds of metal is dissolved in the aqueous solution. In concrete terms, formic acid, acetic acid, lactic acid, oxalic acid, citric acid, tartaric acid, or iron salt such as iron citrate and ammonium iron citrate is dissolved in the aqueous solution.

Preferable concentration of carboxylic acid in the aqueous solution for forming coating film is 0.001 to 5 mole of carboxylic acid to 1 mole of phosphoric acid ingredient (converted to $P_2O_5$) in the aqueous solution. If the concentration of carboxylic acid is less than 0.001 mole, the effect is not satisfactory. If the concentration thereof exceeds 5 mole, the coating film becomes hygroscopic, and corrosion may occur. Particularly preferable range of the concentration of carboxylic acid is 0.01 to 1 mole to 1 mole of phosphoric acid ingredient (converted to $P_2O_5$), and most preferable range thereof is 0.05 to 0.5 mole.

Preferable concentration of cationic ingredient (α), of phosphoric acid ion (β), and of silica (γ) is as follows. A preferable concentration range of cationic ingredient (α) is 0.01 to 3 mol/l, and more preferable range thereof is 0.02 to 2 mol/l. Excessive concentration of cationic ingredient (α) is not preferable because the thickness of coating film becomes irregular. A preferable concentration range of phosphoric acid ion (β) is 0.05 to 2 mol/l, and more preferable range thereof is 0.05 to 1 mol/l. Excessive concentration of phosphoric acid ingredient (β) is not preferable because the reactivity of aqueous solution increases. A preferable concentration range of silica (γ) is 0.0001 to 6 mol/l, and more preferable range thereof is 0.1 to 1.0 mol/l. Excessive concentration of silica (γ) is not preferable because the thickness of coating film becomes irregular.

A preferable range of coating weight (solid matter) of the coating film formed on the surface of plating layer according to the present invention is 5 to 300 mg/m$^2$ as the P amount, more preferably 10 to 150 mg/m$^2$, and most preferably 30 to 120 mg/m$^2$. If the coating weight thereof becomes less than the lower limit, the effect for improving the press-formability cannot fully be attained. If the coating weight thereof exceeds the upper limit, the chemical conversion treatment performance degrades.

The aqueous solution for forming coating film according to the present invention is generally prepared by dissolving the above-described additives in deionized water.

The zinc-base plated steel sheet being applied with the aqueous solution may be subjected to activation treatment or the like before receiving the application of aqueous solution. The activation treatment may be given by immersing the plated steel sheet in an alkaline aqueous solution or an acidic aqueous solution, or by spraying alkaline or acidic aqueous solution.

The method for applying aqueous solution for forming coating film onto the zinc-base plated steel sheet according to the present invention may be application method, immersion method, or spray method. As for the application method, arbitrary means may be adopted such as roll coater (3-roll type, 2-roll type, or the like), squeeze coater, die coater, and bar coater. The application treatment using squeeze coater or the like and the immersion treatment may be given after the spray treatment using air-knife method or roll-squeeze method to adjust the coating amount, to uniformize the appearance, and to uniformize the coating thickness.

After applying the aqueous solution, heating and drying treatment is given without washing by water. The heating and drying treatment may be conducted by dryer, hot air furnace, high frequency induction heating furnace, infrared ray furnace, and the like. A preferable range of ultimate sheet temperature in the heating treatment is 50° C. to 200° C., and more preferably 50° C. to 140° C. If the heating temperature is below 50° C., excessive amount of water is left in the coating film, which likely induces stain defects. If the heating temperature exceeds 140° C., the treatment becomes noneconomic. Furthermore, if the heating temperature exceeds 200° C., the coating film becomes brittle and highly separable.

Although no specific limit is given to the temperature of aqueous solution for forming coating film, a preferable range thereof is 20° C. to 70° C. If the temperature of aqueous solution is below 20° C., the stability of the aqueous solution degrades. If the temperature of aqueous solution exceeds 70° C., facility and energy to maintain the aqueous solution to a high temperature are required to increase the production cost, which is also noneconomic.

EXAMPLE 1

Example 1 used various kinds of zinc-base plated steel sheets given below.

(1) GA: An alloyed hot-dip galvanized steel sheet (10 mass % Fe and balance of Zn) having 45 g/m$^2$ of coating weight on each side thereof.

(2) GI: A hot-dip galvanized steel sheet having 90 g/m$^2$ of coating weight on each side thereof.

(3) EG: An electric zinc-plated steel sheet having 50 g/m$^2$ of coating weight on each side thereof.

(4) Zn—Fe: An electric Zn—Fe alloy plated steel sheet (15 mass % Fe and balance of Zn) having 40 g/m$^2$ Of coating weight on each side thereof.

(5) Zn—Ni: An electric Zn—Ni alloy plated steel sheet (12 mass % Ni and balance of Zn) having 30 g/m$^2$ of coating weight on each side thereof.

(6) Zn—Al: An electric Zn—Al alloy plated steel sheet (5 mass % Al and balance of Zn) having 60 g/m$^2$ of coating weight on each side thereof.

The surface of plating layer on each of the zinc-base plated steel sheets was subjected to the treatment described below. The zinc-base plated steel sheet being treated was preliminarily treated by the solvent degreasing using toluene to remove press-oil from the surface thereof.

Respective treatment liquids were prepared to obtain the respective compositions given in Table 1 through Table 3, namely: ① aqueous solution of phosphate prepared by mixing oxide or hydroxide, containing various cationic ingredients, and orthophosphoric acid, at a specific ratio, in deionized water; ② aqueous solution of phosphate prepared by mixing metallic salt, containing various cationic ingredients, and orthophosphoric acid, at a specific ratio, in deionized water; and ③ one of these aqueous solution of phosphate further containing silica or water-soluble resin (water-soluble epoxy resin).

The silica ingredient was prepared by adding "Snowtex O" (manufactured by Nissan Chemical Industries, Ltd.) to a specified molar concentration.

Each of the treatment liquids (at room temperature) given in Table 1 through Table 3 was applied onto the surface of the above-described zinc-base plated steel sheet using roll coater or bar coater, and was heated to dry to form a coating film. The coating weight of the formed film was adjusted depending on the concentration of the composition and the applying conditions (roll-pressing pressure, rotational speed, count of bar coater, and other variables).

The coating weight of the film was determined by the following-described procedure. For zinc-base plated steel sheets having different coating weight, the plating layer together with the coating film was dissolved to remove using dilute hydrochloric acid. The P concentration in the respective dissolved liquids was quantified by ICP analysis. Before conducting the above-given layer separation, the fluorescent X-ray intensity of P was determined at two positions in the central section of plated steel sheet being subjected to the above-described dissolving and separating treatment. The fluorescent X-ray intensity of P and the above-described P concentration obtained by ICP were compared to derive a correlation formula. Then, the fluorescent X-ray intensity of P on each specimen was determined. Thus observed value was entered to the correlation formula to obtain the coating weight on each specimen.

The molar ratio of metallic element to phosphorus-base oxide (converted to $P_2O_5$) in the coating film was determined by the procedure given below. The phosphorus-base oxide coating film formed on the zinc-base plated steel sheet was dissolved together with the plating layer using dilute hydrochloric acid. Thus dissolved film-structuring elements were quantified. On the other hand, the plating layer on the zinc-base plated steel sheet before forming the phosphorus-base oxide coating film was dissolved using dilute hydrochloric acid, and the film-structuring elements were also quantified. The amount of the latter metallic elements was subtracted from the amount of former metallic elements obtained by dissolving the phosphorus-base oxide coating film together with the plating layer. The resulted value was the amount of elements structuring the coating film. The target area for the quantification was 0.06 $m^2$. Based on thus determined amount of metallic elements, the molar ratio of metallic elements to phosphorus-base oxide (converted to $P_2O_5$) was derived. The amount of organic resin ingredient in the phosphorus-base oxide coating film was determined by quantifying the dissolved liquid prepared by dissolving the coating film ingredients using an acid, applying calorimetric method.

The performance evaluation on thus prepared zinc-base plated steel sheets was given as follows.

(1) Press-Formability

To evaluate the press-formability, friction factor of each specimen was determined using a friction tester shown in FIG. 1. As shown in FIG. 1 giving the front view of the friction tester, a sample table 2 is fixed on a slide table 3 which is movable in the horizontal direction. A sample 1 for determining the friction factor, taken from the specimen, is fixed on the sample table 2. Beneath the slide table 3, a vertically movable slide table support 5 is positioned. Between the slide table 3 and the slide table support 5, there are inserted rollers 4 contacting to each of the slide table 3 and the slide table support 5. A first load cell 7 is attached to the slide table support 5. The first load cell 7 measures the pressing load N of a bead 6 against the sample 1 when the slide table 5 is lifted. A second load cell 8 is attached to an edge of the slide table 3. The second load cell 8 measures the sliding resistance F to move the slide table 3 horizontally under the application of above-described pressing force.

The tests were conducted by applying lubricant "NOX-RUST 550HN" (manufactured by PARKERINDUSTRIES, INC.) onto the surface of sample 1. The friction factor $\mu$ between the sample and the bead 6 was derived by the formula:$\mu$=F/N. The pressing load N was 400 kgf, and the draw-out speed of sample (horizontal moving speed of the slide table 3) was 100 cm/min.

Figure 2:
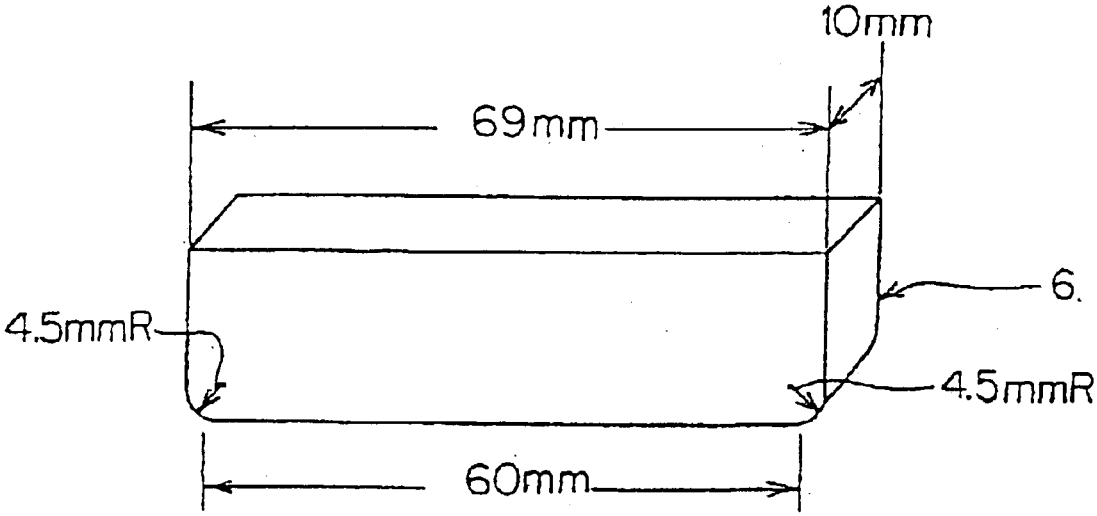
FIG. 2 is a perspective view of bead structuring the apparatus of FIG. 1, giving the shape and the dimensions of the bead.

FIG. 2 shows a perspective view of applied bead 6, giving the shape and the dimensions thereof. The bead 6 slides in a state that the bottom face thereof is pressed against the surface of sample 1. The bead 6 has the dimensions of 10 mm in width, 69 mm in length in the sliding direction, and 4.5 mm in radius of curvature at lower section of both ends in the sliding direction. The bottom face of the bead where the sample is pressed thereto is flat, having 10 mm in width and 60 mm in length in the sliding direction.

(2) Chemical Conversion Treatment Performance

[Evaluation 1]

Assuming the condition of sample after press-formed, the lubricant ("NOX-RUST 550HN" (manufactured by PARKER INDUSTRIES, INC.)) was applied onto each specimen. After that, the chemical conversion treatment was given to the specimen following the steps of [(degreasing under the condition ① given below)→washing with water→drying→surface preparation under the condition given below ②→chemical conversion treatment under the condition ③ or ③' given below→washing with water→drying].

① Degreasing: "FC-4460" (manufactured by Nippon Parkerizing Co., Ltd.) Spray time: 60 seconds (spray pressure: 1 kg/$cm^2$), degreasing liquid temperature: 43° C.

② Surface preparation: "PB-Z" (manufactured by Nippon Parkerizing Co., Ltd.) Liquid concentration: 1.5 g/l, immersion time: 20 seconds, treatment liquid temperature: room temperature.

③ Chemical conversion treatment: "PB-3030" manufactured by Nippon Parkerizing Co., Ltd.) Immersion time: 120 seconds, treatment liquid temperature: 52° C.

③ Chemical conversion treatment: "PB-3020"(fluorine-laid system) (manufactured by Nippon Parkerizing Co., Ltd.) Immersion time: 120 seconds, treatment liquid temperature: 43° C.

The above-given chemical conversion treatments were given to the respective specimens. After the chemical conversion treatments, the configuration of phosphate crystals was observed by SEM, and the evaluation was given on the criteria given below.

◎: Mean size of phosphate crystals is less than 8 im, and the coating film is dense without lack of hiding.

○: Mean size of phosphate crystals is not less than 8 $\mu$m and less than 12 im, and the coating film is dense without lack of hiding.

○-: Mean size of phosphate crystals is not less than 12 $\mu$m, and no lack of hiding is observed.

Δ: Mean size of phosphate crystals is less than 12 $\mu$m, and the coating film has both the portions of dense without lack of hiding and the portions of not forming phosphate crystals.

X: Mean size of phosphate crystals become coarse (giving 12 im or larger crystal sizes) and significant lack of hiding is observed, or phosphate crystals are not grown at all.

[Evaluation 2]

To conduct severer evaluation of chemical conversion treatment performance, a state of insufficient film-removing action during the degreasing step owing to the poor degreasing spray was assumed. The chemical conversion treatment without applying the "degreasing step" in the chemical treatment performance test in the above [Evaluation 1] was carried out. That is, the chemical conversion treatment was conducted by the steps of [(surface preparation under the condition ② given above →chemical conversion treatment under the condition ③ given above→washing with water→drying], without applying the above-given degreasing step ①. The chemical conversion treatment performance test did not give applying press-oil, which was given in the chemical conversion treatment test of [Evaluation 1]. The chemical conversion treatment liquid was PB-3080 (manufactured by Nippon Parkerizing Co., Ltd.)

After conducted the above-given chemical conversion treatment, the configuration of phosphate crystals was observed by SEM, and the evaluation was given on the criteria given below.

◎: Mean size of phosphate crystals is not less than 8 $\mu$m and less than 12 $\mu$m, and the coating film is dense without lack of hiding.

○: Mean size of phosphate crystals is not less than 12 $\mu$m, and no lack of hiding is observed.

α-: The coating film has both the portions of formed phosphate crystals and the portions of not forming phosphate crystals.

Δ: Phosphate crystals are not grown in almost all the domains, but fine crystals are observed in some domains.

X: No phosphate crystals are grown at all.

Table 4 through Table 13 show the treatment conditions of respective specimens and the results of above-described performance evaluation. Compared with Comparative Examples, Examples according to the present invention are superior in chemical conversion treatment performance, or are superior in press-formability, and give less degradation in chemical conversion treatment performance even the treatment is given under different chemical conversion treatment conditions, thus providing both the press-formability and the chemical conversion treatment performance.

TABLE 1

| No. | Cationic ingredient (α) Main cation Kind | Main cation Concentration (mol/l) | Other cation Kind | Other cation Concentration (mol/l) | Total cation concentration (mol/l) | Concentration of phosphoric acid ion (β) [as $P_2O_5$] (mol/l) | Molar ratio of [cation (α)]/[phosphoric acid ion (β)] | Classification |
|---|---|---|---|---|---|---|---|---|
| 1 | Mg | 0.059 | — | — | 0.059 | 0.06 | 0.98 | Example |
| 2 | Mg | 0.11 | — | — | 0.11 | 0.12 | 0.92 | Example |
| 3 | Mg | 0.034 | — | — | 0.034 | 0.08 | 0.43 | Example |
| 4 | Mg | 0.07 | — | — | 0.07 | 0.09 | 0.78 | Example |
| 5 | Mg | 1.2 | — | — | 1.2 | 0.20 | 6.00 | Example |
| 6 | Mg | 1.0 | — | — | 1.0 | 0.14 | 7.14 | Comparative Example |
| 7 | Mg | 0.02 | — | — | 0.02 | 0.20 | 0.10 | Comparative Example |
| 8 | Al | 0.02 | — | — | 0.02 | 0.03 | 0.67 | Example |
| 9 | Al | 0.15 | — | — | 0.15 | 0.28 | 0.54 | Example |
| 10 | Al | 0.12 | — | — | 0.12 | 0.28 | 0.43 | Example |
| 11 | Al | 0.07 | — | — | 0.07 | 0.14 | 0.50 | Example |
| 12 | Al | 0.15 | — | — | 0.15 | 0.09 | 1.67 | Example |
| 13 | Al | 0.22 | — | — | 0.22 | 0.09 | 2.44 | Example |
| 14 | Al | 0.29 | — | — | 0.29 | 0.05 | 5.80 | Example |
| 15 | Al | 0.67 | — | — | 0.67 | 0.09 | 7.44 | Comparative Example |
| 16 | Al | 0.15 | — | — | 0.15 | 0.90 | 0.17 | Comparative Example |
| 17 | Ca | 0.39 | — | — | 0.39 | 0.90 | 0.43 | Example |
| 18 | Ti | 0.15 | — | — | 0.15 | 0.25 | 0.60 | Example |
| 19 | Fe | 0.032 | — | — | 0.032 | 0.08 | 0.40 | Example |
| 20 | Fe | 0.07 | — | — | 0.07 | 0.16 | 0.44 | Example |
| 21 | Fe | 0.05 | — | — | 0.05 | 0.08 | 0.63 | Example |

TABLE 2

| No. | Cationic ingredient (α) Main cation Kind | Main cation Concentration (mol/l) | Other cation Kind | Other cation Concentration (mol/l) | Total cation concentration (mol/l) | Concentration of phosphoric acid ion (β) [as $P_2O_5$] (mol/l) | Molar ratio of [cation (α)]/[phosphoric acid ion (β)] | Concentration of silica (γ) [as $SiO_2$] (mol/l) | Molar ratio of [silica (γ)]/[phosphoric acid ion (β)] | Classification |
|---|---|---|---|---|---|---|---|---|---|---|
| 22 | Fe | 0.032 | Al | 0.01 | 0.042 | 0.04 | 1.05 | — | — | Example |
| 23 | Fe | 0.02 | Mg | 0.02 | 0.04 | 0.03 | 1.33 | — | — | Example |
| 24 | Fe | 0.03 | Co | 0.01 | 0.04 | 0.05 | 0.80 | — | — | Example |
| 25 | Fe | 0.05 | — | — | 0.05 | 0.50 | 0.10 | — | — | Comparative Example |
| 26 | Co | 0.06 | — | — | 0.06 | 0.08 | 0.75 | — | — | Example |
| 27 | Co | 0.03 | — | — | 0.03 | 0.07 | 0.43 | — | — | Example |
| 28 | Co | 0.20 | — | — | 0.20 | 0.21 | 0.95 | — | — | Example |
| 29 | Co | 0.03 | — | — | 0.03 | 0.50 | 0.06 | — | — | Comparative Example |
| 30 | Cu | 0.05 | — | — | 0.05 | 0.08 | 0.63 | — | — | Example |
| 31 | Mo | 0.02 | — | — | 0.02 | 0.05 | 0.40 | — | — | Example |
| 32 | Mo | 0.04 | — | — | 0.04 | 0.09 | 0.44 | — | — | Example |
| 33 | Al | 0.07 | — | — | 0.07 | 0.14 | 0.50 | 0.001 | 0.007 | Example |
| 34 | Al | 0.07 | — | — | 0.07 | 0.14 | 0.50 | 0.002 | 0.014 | Example |
| 35 | Al | 0.15 | — | — | 0.15 | 0.11 | 1.36 | 0.5 | 4.5 | Example |
| 36 | Al | 0.07 | — | — | 0.07 | 0.17 | 0.41 | 0.1 | 0.6 | Example |
| 37 | Al | 0.07 | — | — | 0.07 | 0.17 | 0.41 | 2 | 11.8 | Example |
| 38 | Al | 0.03 | — | — | 0.03 | 0.07 | 0.43 | 5 | 71.4 | Example |
| 39 | Al | 0.03 | — | — | 0.03 | 0.07 | 0.43 | 6 | 85.7 | Example |
| 40 | Na | 0.30 | — | — | 0.30 | 0.15 | 2.00 | — | — | Comparative Example |
| 41 | Mn | 0.50 | — | — | 0.50 | 0.83 | 0.60 | — | — | Comparative Example |
| 42 | Zn | 0.40 | — | — | 0.40 | 0.80 | 0.50 | — | — | Comparative Example |

TABLE 3

| No. | Cationic ingredient (α) Main cation Kind | Main cation Concentration (mol/l) | Other cation Kind | Other cation Concentration (mol/l) | Total cation concentration (mol/l) | Concentration of phosphoric acid ion (β) [as $P_2O_5$] (mol/l) | Molar ratio of [cation (α)]/[phosphoric acid ion (β)] | Organic resin ingredient [percentage of solid matter in aqueous solution] (mass %) | Classification |
|---|---|---|---|---|---|---|---|---|---|
| 43 | Mg | 0.059 | — | — | 0.059 | 0.27 | 0.22 | — | Example |
| 44 | Al | 0.05 | — | — | 0.05 | 0.077 | 0.65 | — | Example |
| 45 | Al | 0.04 | — | — | 0.04 | 0.18 | 0.22 | — | Example |
| 46 | Fe | 0.032 | — | — | 0.032 | 0.14 | 0.23 | — | Example |
| 47 | Al | 0.02 | — | — | 0.02 | 0.03 | 0.67 | 1 | Example |
| 48 | Al | 0.02 | — | — | 0.02 | 0.03 | 0.67 | 15 | Example |
| 49 | Al | 0.02 | — | — | 0.02 | 0.03 | 0.67 | 0.1 | Example |
| 50 | Mn | 1.1 | — | — | 1.1 | 0.89 | 1.24 | — | Example |
| 51 | Mn | 0.13 | Al | 0.03 | 0.14 | 0.08 | 1.82 | — | Example |

TABLE 4

| No. | Base sheet being treated *1 | Treatment liquid *2 | Drying temp. (° C.) *3 | Metallic element in coating film | Molar ratio of ingredients in coating film *5 | Coating weight ($mg/m^2$) *4 | Press-formability (friction factor) | Chemical conversion treatment performance (Evaluation 1) PB 3030 | PB 3020 | Chemical conversion treatment performance (Evaluation 2) | Classification |
|---|---|---|---|---|---|---|---|---|---|---|---|
| 1 | GI | 1 | 80 | Mg | 0.98 | 24 | 0.150 | ○ | ○ | ○− | Example |
| 2 | GI | 2 | 80 | Mg | 0.92 | 43 | 0.146 | ○ | ○ | ○− | Example |
| 3 | GI | 3 | 80 | Mg | 0.43 | 90 | 0.172 | ○− | ○ | ○− | Example |
| 4 | GI | 4 | 80 | Mg | 0.78 | 78 | 0.163 | ○ | ○ | ○− | Example |
| 5 | GI | 5 | 80 | Mg | 6.00 | 210 | 0.211 | ○− | ○ | ○− | Example |
| 6 | GI | 6 | 80 | Mg | 7.14 | 250 | 0.305 | X | X | X | Comparative Example |
| 7 | GI | 7 | 80 | Mg | 0.10 | 20 | 0.255 | X | X | X | Comparative Example |
| 8 | GI | 8 | 80 | Al | 0.67 | 20 | 0.150 | ⊙ | ⊙ | ○− | Example |
| 9 | GI | 9 | 80 | Al | 0.54 | 190 | 0.180 | ○ | ⊙ | ⊙ | Example |
| 10 | GI | 10 | 80 | Al | 0.43 | 80 | 0.156 | ○ | ⊙ | ⊙ | Example |
| 11 | GI | 11 | 80 | Al | 0.50 | 145 | 0.154 | ○ | ⊙ | ⊙ | Example |
| 12 | GI | 12 | 80 | Al | 1.67 | 80 | 0.155 | ⊙ | ⊙ | ○− | Example |
| 13 | GI | 13 | 80 | Al | 2.44 | 75 | 0.177 | ○− | ○ | ○− | Example |

*1 GI: Hot-dip galvanized steel sheet GA: Alloyed hot-dip galvanized steel sheet
*2 Treatment liquid No. given in Tables 1 through 3
*3 Ultimate sheet temperature
*4 P coating weight
*5 Molar ratio of the sum of the amount of metallic elements (one or more of Mg, Al, Ca, Ti, Fe, Co, Ni, Cu, and Mo) in coating film (a) to the amount of phosphorus-base oxide (b), (amount of phosphorus-base oxide is expressed by $P_2O_5$ conversion value)

TABLE 5

| No. | Base sheet being treated *1 | Treatment liquid *2 | Drying temp. (° C.) *3 | Metallic element in coating film | Molar ratio of ingredients in coating film *5 | Coating weight ($mg/m^2$) *4 | Press-formability (friction factor) | Chemical conversion treatment performance (Evaluation 1) PB 3030 | PB 3020 | Chemical conversion treatment performance (Evaluation 2) | Classification |
|---|---|---|---|---|---|---|---|---|---|---|---|
| 14 | GI | 14 | 80 | Al | 5.80 | 50 | 0.212 | ○− | ○− | ○− | Example |
| 15 | GI | 15 | 80 | Al | 7.44 | 70 | 0.177 | X | X | X | Comparative Example |

TABLE 5-continued

| No. | Base sheet being treated *1 | Treatment liquid *2 | Drying temp. (° C.) *3 | Metallic element in coating film | Molar ratio of ingredients in coating film *5 | Coating weight (mg/m$^2$) *4 | Press-formability (friction factor) | Chemical conversion treatment performance (Evaluation 1) PB 3030 | PB 3020 | Chemical conversion treatment performance (Evaluation 2) | Classification |
|---|---|---|---|---|---|---|---|---|---|---|---|
| 16 | GI | 16 | 80 | Al | 0.17 | 245 | 0.311 | X | X | X | Comparative Example |
| 17 | GI | 17 | 80 | Ca | 0.43 | 210 | 0.201 | ○– | ○ | ○– | Example |
| 18 | GI | 18 | 80 | Ti | 0.60 | 86 | 0.177 | ○ | ○ | ○– | Example |
| 19 | GI | 19 | 80 | Fe | 0.40 | 25 | 0.165 | ○ | ◎ | ◎ | Example |
| 20 | GI | 20 | 80 | Fe | 0.44 | 80 | 0.166 | ○ | ◎ | ◎ | |
| 21 | GI | 21 | 80 | Fe | 0.63 | 33 | 0.165 | ◎ | ◎ | ◎ | Example |
| 22 | GI | 22 | 80 | Fe, Al | 1.05 | 55 | 0.155 | ◎ | ◎ | ○ | Example |
| 23 | GI | 23 | 80 | Fe, Mg | 1.33 | 40 | 0.154 | ◎ | ◎ | ○ | Example |
| 24 | GI | 24 | 80 | Fe, Co | 0.80 | 45 | 0.145 | ○ | ◎ | ○ | Example |
| 25 | GI | 25 | 80 | Fe | 0.10 | 85 | 0.315 | X | X | X | Comparative Example |
| 26 | GI | 26 | 80 | Co | 0.75 | 45 | 0.149 | ○ | ◎ | ○ | Example |

*1 GI: Hot-dip galvanized steel sheet GA: Alloyed hot-dip galvanized steel sheet
*2 Treatment liquid No. given in Tables 1 through 3
*3 Ultimate sheet temperature
*4 P coating weight
*5 Molar ratio of the sum of the amount of metallic elements (one or more of Mg, Al, Ca, Ti, Fe, Co, Ni, Cu, and Mo) in coating film (a) to the amount of phosphorus-base oxide (b), (amount of phosphorus-base oxide is expressed by $P_2O_5$ conversion value)

TABLE 6

| No. | Base sheet being treated *1 | Treatment liquid *2 | Drying temp. (° C.) *3 | Metallic element in coating film | Molar ratio of ingredients in coating film *5 | Coating weight (mg/m$^2$) *4 | Press-formability (friction factor) | Chemical conversion treatment performance (Evaluation 1) PB 3030 | PB 3020 | Chemical conversion treatment performance (Evaluation 2) | Classification |
|---|---|---|---|---|---|---|---|---|---|---|---|
| 27 | GI | 27 | 80 | Co | 0.43 | 30 | 0.156 | ○ | ◎ | ○ | Example |
| 28 | GI | 28 | 80 | Co | 0.95 | 85 | 0.157 | ○ | ◎ | ○ | Example |
| 29 | GI | 29 | 80 | Co | 0.06 | 95 | 0.305 | X | X | X | Comparative Example |
| 30 | GI | 30 | 80 | Cu | 0.63 | 45 | 0.166 | ○– | ○ | ○– | Example |
| 31 | GI | 31 | 80 | Mo | 0.40 | 37 | 0.159 | ○– | ○ | ○– | Example |
| 32 | GI | 32 | 80 | Mo | 0.44 | 260 | 0.177 | ○ | ○ | ○– | Example |
| 33 | GI | 33 | 80 | Al | 0.50 | 45 | 0.156 | ○ | ◎ | ◎ | Example |
| 34 | GI | 34 | 80 | Al | 0.50 | 43 | 0.157 | ◎ | ◎ | ◎ | Example |
| 35 | GI | 35 | 80 | Al | 1.36 | 42 | 0.156 | ◎ | ◎ | ○ | Example |
| 36 | GI | 36 | 80 | Al | 0.41 | 71 | 0.149 | ◎ | ◎ | ◎ | Example |
| 37 | GI | 37 | 80 | Al | 0.41 | 65 | 0.155 | ◎ | ◎ | ◎ | Example |
| 38 | GI | 38 | 80 | Al | 0.43 | 50 | 0.149 | ◎ | ◎ | ◎ | Example |
| 39 | GI | 39 | 80 | Al | 0.43 | 45 | 0.139 | ○– | ○ | ○ | Example |

*1 GI: Hot-dip galvanized steel sheet GA: Alloyed hot-dip galvanized steel sheet
*2 Treatment liquid No. given in Tables 1 through 3
*3 Ultimate sheet temperature
*4 P coating weight
*5 Molar ratio of the sum of the amount of metallic elements (one or more of Mg, Al, Ca, Ti, Fe, Cc, Ni, Cu, and Mo) in coating film (a) to the amount of phosphorus-base oxide (b), (amount of phosphorus-base oxide is expressed by $P_2O_5$ conversion value)

TABLE 7

| No. | Base sheet being treated *1 | Treatment liquid *2 | Drying temp. (° C.) *3 | Metallic element in coating film | Molar ratio of ingredients in coating film *5 | Coating weight ($mg/m^2$) *4 | Press-formability (friction factor) | Chemical conversion treatment performance (Evaluation 1) PB 3030 | PB 3020 | Chemical conversion treatment performance (Evaluation 2) | Classification |
|---|---|---|---|---|---|---|---|---|---|---|---|
| 40 | GI | 40 | 120 | Na | 2.00 | 40 | 0.221 | Δ | Δ | Δ | Comparative Example |
| 41 | GI | 41 | 120 | Mn | 0.60 | 195 | 0.201 | X | Δ | X | Comparative Example |
| 42 | GI | 42 | 120 | Zn | 0.50 | 230 | 0.301 | X | Δ | X | Comparative Example |
| 43 | GI | 1 | 120 | Mg | 0.98 | 24 | 0.150 | ○ | ◎ | ○ | Example |
| 44 | GI | 8 | 120 | Al | 0.67 | 20 | 0.150 | ◎ | ◎ | ○− | Example |
| 45 | GI | 33 | 120 | Al | 0.50 | 45 | 0.156 | ○ | ◎ | ◎ | Example |
| 46 | GA | 1 | 80 | Mg | 0.98 | 28 | 0.149 | ○ | ○ | ○ | Example |
| 47 | GA | 2 | 80 | Mg | 0.92 | 45 | 0.150 | ○ | ○ | ○ | Example |
| 48 | GA | 3 | 80 | Mg | 0.43 | 92 | 0.169 | ○− | ○ | ○ | Example |
| 49 | GA | 4 | 80 | Mg | 0.78 | 79 | 0.155 | ○ | ○ | ○ | Example |
| 50 | GA | 5 | 80 | Mg | 6.00 | 225 | 0.201 | ○− | ○ | ○ | Example |
| 51 | GA | 6 | 80 | Mg | 7.14 | 265 | 0.295 | X | X | X | Comparative Example |
| 52 | GA | 7 | 80 | Mg | 0.10 | 35 | 0.245 | X | X | X | Comparative Example |

*1 GI: Hot-dip galvanized steel sheet GA: Alloyed hot-dip galvanized steel sheet
*2 Treatment liquid No. given in Tables 1 through 3
*3 Ultimate sheet temperature
*4 P coating weight
*5 Molar ratio of the sum of the amount of metallic elements (one or more of Mg, Al, Ca, Ti, Fe, Co, Ni, Cu, and Mo) in coating film (a) to the amount of phosphorus-base oxide (b), (amount of phosphorus-base oxide is expressed by $P_2O_5$ conversion value)

TABLE 8

| No. | Base sheet being treated *1 | Treatment liquid *2 | Drying temp. (° C.) *3 | Metallic element in coating film | Molar ratio of ingredients in coating film *5 | Coating weight ($mg/m^2$) *4 | Press-formability (friction factor) | Chemical conversion treatment performance (Evaluation 1) PB 3030 | PB 3020 | Chemical conversion treatment performance (Evaluation 2) | Classification |
|---|---|---|---|---|---|---|---|---|---|---|---|
| 53 | GA | 8 | 80 | Al | 0.67 | 20 | 0.155 | ◎ | ◎ | ○− | Example |
| 54 | GA | 9 | 80 | Al | 0.54 | 185 | 0.179 | ○ | ◎ | ◎ | Example |
| 55 | GA | 10 | 80 | Al | 0.43 | 89 | 0.155 | ○ | ◎ | ◎ | Example |
| 56 | GA | 11 | 80 | Al | 0.50 | 155 | 0.152 | ○ | ◎ | ◎ | Example |
| 57 | GA | 12 | 80 | Al | 1.67 | 87 | 0.145 | ◎ | ◎ | ○− | Example |
| 58 | GA | 13 | 80 | Al | 2.44 | 75 | 0.179 | ○− | ○ | ○− | Example |
| 59 | GA | 14 | 80 | Al | 5.80 | 53 | 0.205 | ○− | ○− | ○− | Example |
| 60 | GA | 15 | 80 | Al | 7.44 | 69 | 0.179 | X | X | X | Comparative Example |
| 61 | GA | 16 | 80 | Al | 0.17 | 255 | 0.315 | X | X | X | Comparative Example |
| 62 | GA | 17 | 80 | Ca | 0.43 | 225 | 0.199 | ○− | ○ | ○− | Example |
| 63 | GA | 18 | 80 | Ti | 0.60 | 85 | 0.178 | ○ | ○ | ○− | Example |
| 64 | GA | 19 | 80 | Fe | 0.40 | 29 | 0.162 | ○ | ◎ | ◎ | Example |
| 65 | GA | 20 | 80 | Fe | 0.44 | 85 | 0.161 | ○ | ◎ | ◎ | Example |

*1 GI: Hot-dip galvanized steel sheet GA: Alloyed hot-dip galvanized steel sheet
*2 Treatment liquid No. given in Tables 1 through 3
*3 Ultimate sheet temperature
*4 P coating weight
*5 Molar ratio of the sum of the amount of metallic elements (one or more of Mg, Al, Ca, Ti, Fe, Ca, Ni, Cu, and Mo) in coating film (a) to the amount of phosphorus-base oxide (b), (amount of phosphorus-base oxide is expressed by $P_2O_5$ conversion value)

TABLE 9

| No. | Base sheet being treated *1 | Treatment liquid *2 | Drying temp. (° C.) *3 | Metallic element in coating film | Molar ratio of ingredients in coating film *5 | Coating weight (mg/m$^2$) *4 | Press-formability (friction factor) | Chemical conversion treatment performance (Evaluation 1) PB 3030 | PB 3020 | Chemical conversion treatment performance (Evaluation 2) | Classification |
|---|---|---|---|---|---|---|---|---|---|---|---|
| 66 | GA | 21 | 80 | Fe | 0.63 | 43 | 0.163 | ◎ | ◎ | ◎ | Example |
| 67 | GA | 22 | 80 | Fe, Al | 1.05 | 52 | 0.145 | ◎ | ◎ | ○ | Example |
| 68 | GA | 23 | 80 | Fe, Mg | 1.33 | 38 | 0.151 | ◎ | ◎ | ○ | Example |
| 69 | GA | 24 | 80 | Fe, Co | 0.80 | 43 | 0.143 | ○ | ◎ | ○ | Example |
| 70 | GA | 25 | 80 | Fe | 0.10 | 82 | 0.325 | X | X | X | Comparative Example |
| 71 | GA | 26 | 80 | Co | 0.75 | 40 | 0.142 | ○ | ◎ | ○ | Example |
| 72 | GA | 27 | 80 | Co | 0.43 | 35 | 0.155 | ○ | ◎ | ○ | Example |
| 73 | GA | 28 | 80 | Co | 0.95 | 82 | 0.154 | ○ | ◎ | ○ | Example |
| 74 | GA | 29 | 80 | Co | 0.06 | 96 | 0.302 | X | X | X | Comparative Example |
| 75 | GA | 30 | 80 | Cu | 0.63 | 43 | 0.159 | ○− | ○ | ○− | Example |
| 76 | GA | 31 | 80 | Mo | 0.40 | 38 | 0.154 | ○− | ○ | ○− | Example |
| 77 | GA | 32 | 80 | Mo | 0.44 | 244 | 0.182 | ○ | ○ | ○− | Example |

*1 GI: Hot-dip galvanized steel sheet GA: Alloyed hot-dip galvanized steel sheet
*2 Treatment liquid No. given in Tables 1 through 3
*3 Ultimate sheet temperature
*4 P Coating weight
*5 Molar ratio of the sum of the amount of metallic elements (one or more of Mg, Al, Ca, Ti, Fe, Co, Ni, Cu, and Mo) in coating film (a) to the amount of phosphorus-base oxide (b), (amount of phosphorus-base oxide is expressed by $P_2O_5$ conversion value)

TABLE 10

| No. | Base sheet being treated *1 | Treatment liquid *2 | Drying temp. (° C.) *3 | Metallic element in coating film | Molar ratio of ingredients in coating film *5 | Coating weight (mg/m$^2$) *4 | Press-formability (friction factor) | Chemical conversion treatment performance (Evaluation 1) PB 3030 | PB 3020 | Chemical conversion treatment performance (Evaluation 2) | Classification |
|---|---|---|---|---|---|---|---|---|---|---|---|
| 78 | GA | 33 | 80 | Al | 0.50 | 49 | 0.155 | ○ | ◎ | ◎ | Example |
| 79 | GA | 34 | 80 | Al | 0.50 | 50 | 0.153 | ◎ | ◎ | ◎ | Example |
| 80 | GA | 35 | 80 | Al | 1.36 | 52 | 0.155 | ◎ | ◎ | ○− | Example |
| 81 | GA | 36 | 80 | Al | 0.41 | 80 | 0.141 | ◎ | ◎ | ◎ | Example |
| 82 | GA | 37 | 80 | Al | 0.41 | 67 | 0.144 | ◎ | ◎ | ◎ | Example |
| 83 | GA | 38 | 80 | Al | 0.43 | 52 | 0.142 | ◎ | ◎ | ◎ | Example |
| 84 | GA | 39 | 80 | Al | 0.43 | 48 | 0.132 | ○− | ○ | ○ | Example |
| 85 | GA | 40 | 120 | Na | 2.00 | 42 | 0.221 | Δ | Δ | Δ | Comparative Example |
| 86 | GA | 41 | 120 | Mn | 0.60 | 200 | 0.201 | X | Δ | X | Comparative Example |
| 87 | GA | 42 | 120 | Zn | 0.50 | 215 | 0.301 | X | Δ | X | Comparative Example |
| 88 | GA | 1 | 120 | Mg | 0.98 | 24 | 0.150 | ○ | ◎ | ○− | Example |
| 89 | GA | 8 | 120 | Al | 0.67 | 18 | 0.150 | ◎ | ◎ | ○− | Example |
| 90 | GA | 33 | 120 | Al | 0.50 | 50 | 0.155 | ○ | ◎ | ◎ | Example |

*1 GI: Hot-dip galvanized steel sheet GA: Alloyed hot-dip galvanized steel sheet
*2 Treatment liquid No. given in Tables 1 through 3
*3 Ultimate sheet temperature
*4 P Coating weight
*5 Molar ratio of the sum of the amount of metallic elements (one or more of Mg, Al, Ca, Ti, Fe, Go, Ni, Cu, and Mo) in coating film (a) to the amount of phosphorus-base oxide (b), (amount of phosphorus-base oxide is expressed by $P_2O_5$ conversion value)

TABLE 11

| No. | Base sheet being *1 | Treatment liquid *2 | Drying temp. (° C.) *3 | Metallic element in coating film | Molar ratio of ingredients in coating film *5 | Coating weight (mg/m²) *4 | Press-formability (friction factor) | Chemical conversion treatment performance (Evaluation 1) PB 3030 | PB 3020 | Chemical conversion treatment performance (Evaluation 2) | Classification |
|---|---|---|---|---|---|---|---|---|---|---|---|
| 91 | EG | 1 | 80 | Mg | 0.98 | 32 | 0.179 | ○ | ◎ | ○− | Example |
| 92 | EG | 8 | 80 | Al | 0.67 | 20 | 0.181 | ○ | ◎ | ○− | Example |
| 93 | EG | 19 | 80 | Fe | 0.40 | 29 | 0.171 | ○ | ◎ | ◎ | Example |
| 94 | EG | 26 | 80 | Co | 0.75 | 38 | 0.169 | ○ | ◎ | ○ | Example |
| 95 | EG | 33 | 80 | Al | 0.50 | 52 | 0.161 | ○ | ◎ | ◎ | Example |
| 96 | EG | 38 | 80 | Al | 0.43 | 45 | 0.159 | ○ | ◎ | ◎ | Example |
| 97 | Zn—Fe | 8 | 80 | Al | 0.67 | 25 | 0.165 | ○ | ○ | ○− | Example |
| 98 | Zn—Ni | 8 | 80 | Al | 0.67 | 20 | 0.155 | ○ | ○ | ○− | Example |
| 99 | Zn—Al | 8 | 80 | Al | 0.67 | 19 | 0.142 | ○ | ○ | ○− | Example |
| 100 | GA | | | (not treated) | | | 0.252 | ○ | ○ | ○ | Comparative Example |
| 101 | GI | | | (not treated) | | | 0.276 | ○ | ○ | ○ | Comparative Example |
| 102 | EG | | | (not treated) | | | 0.300 | ◎ | ◎ | ◎ | Comparative Example |

*1 GI: Hot-dip galvanized steel sheet GA: Alloyed hot-dip galvanized steel sheet EG: Electric zinc-plated steel sheet Zn—Fe: Electric Zn—Fe alloy plated steel sheet Zn—Ni: Electric Zn—Ni alloy plated steel sheet Zn—Al: Electric Zn—Al alloy plated steel sheet
*2 Treatment liquid No. given in Tables 1 through 3
*3 Ultimate sheet temperature
*4 P coating weight
*5 Molar ratio of the sum of the amount of metallic elements (one or more of Mg, Al, Ca, Ti, Fe, Co, Ni, Cu, and Mo) in coating film (a) to the amount of phosphorus-base oxide (b), (amount of phosphorus-base oxide is expressed by $P_2O_5$ conversion value)

TABLE 12

| No. | Base sheet being treated *1 | Treatment liquid *2 | Drying temp. (° C.) *3 | Metallic element in coating film | Molar ratio of ingredients in coating film *5 | Coating weight (mg/m²) *4 | Amount of resin in coating film (mg/m²) | Press-formability (friction factor) | Chemical conversion treatment performance (Evaluation 1) PB 3030 | PB 3020 | Chemical conversion treatment performance (Evaluation 2) | Classification |
|---|---|---|---|---|---|---|---|---|---|---|---|---|
| 103 | GI | 43 | 80 | Mg | 0.22 | 45 | — | 0.156 | ○ | ○ | ○− | Example |
| 104 | GI | 44 | 80 | Al | 0.65 | 30 | — | 0.15 | ◎ | ◎ | ◎ | Example |
| 105 | GI | 45 | 80 | Al | 0.22 | 45 | — | 0.154 | ○ | ○ | ○− | Example |
| 106 | GI | 46 | 80 | Fe | 0.23 | 40 | — | 0.165 | ○ | ◎ | ◎ | Example |
| 107 | GI | 47 | 120 | Al | 0.67 | 20 | 20 | 0.148 | ◎ | ◎ | ○− | Example |
| 108 | GI | 48 | 120 | Al | 0.67 | 20 | 1100 | 0.21 | ○ | ○ | X | Comparative Example |
| 109 | GI | 49 | 120 | Al | 0.67 | 20 | 0.03 | 0.155 | ◎ | ◎ | ○− | Example |
| 110 | GI | 50 | 80 | Mn | 1.24 | 420 | — | 0.166 | ○ | ○ | X | Comparative Example |
| 111 | GI | 51 | 80 | Mn, Al | 1.82 | 30 | — | 0.156 | ○ | ○ | X | Comparative Example |

*1 GI: Hot-dip galvanized steel sheet
*2 Treatment liquid No. given in Tables 1 through 3
*3 Ultimate sheet temperature
*4 P coating weight
*5 Molar ratio of the sum of the amount of metallic elements (one or more of Mg, Al, Ca, Ti, Fe, Co, Ni, Cu, and Mo) in coating film (a) to the amount of phosphorus-base oxide (b), (amount of phosphorus-base oxide is expressed by $P_2O_5$ conversion value)

TABLE 13

| No. | Base sheet being treated *1 | Treatment liquid *2 | Drying temp. (° C.) *3 | Metallic element in coating film | Molar ratio of ingredients in coating film *5 | Coating weight (mg/m²) *4 | Amount of resin in coating film (mg/m²) | Press-formability (friction factor) | Chemical conversion treatment performance (Evaluation 1) PB 3030 | PB 3020 | Chemical conversion treatment performance (Evaluation 2) | Classification |
|---|---|---|---|---|---|---|---|---|---|---|---|---|
| 112 | GA | 43 | 80 | Mg | 0.22 | 50 | — | 0.155 | ○ | ○ | ○− | Example |
| 113 | GA | 44 | 80 | Al | 0.65 | 35 | — | 0.154 | ◎ | ◎ | ◎ | Example |
| 114 | GA | 45 | 80 | Al | 0.22 | 45 | — | 0.157 | ○ | ○ | ○− | Example |
| 115 | GA | 46 | 80 | Fe | 0.23 | 50 | — | 0.161 | ○ | ◎ | ◎ | Example |
| 116 | GA | 47 | 120 | Al | 0.67 | 20 | 20 | 0.144 | ◎ | ◎ | ○− | Example |
| 117 | GA | 48 | 120 | Al | 0.67 | 20 | 1100 | 0.221 | ○ | ○ | X | Comparative Example |
| 118 | GA | 49 | 120 | Al | 0.67 | 20 | 0.03 | 0.145 | ◎ | ◎ | ○− | Example |
| 119 | GA | 50 | 80 | Mn | 1.24 | 420 | — | 0.166 | ○ | ○ | X | Comparative Example |
| 120 | GA | 51 | 80 | Mn, Al | 1.82 | 30 | — | 0.156 | ○ | ○ | X | Comparative Example |

*1 GA: Hot-dip galvanized steel sheet
*2 Treatment liquid No. given in Tables 1 through 3
*3 Ultimate sheet temperature
*4 F coating weight
*5 Molar ratio of the sum of the amount of metallic elements (one or more of Mg, Al, Ca, Ti, Fe, Co, Ni, Cu, and Mo) in coating film (a) to the amount of phosphorus-base oxide (b), (amount of phosphorus-base oxide is expressed by $P_2O_5$ conversion value)

EXAMPLE 2

Example 2 used zinc-base plated steel sheets given below.

(1) GA: An alloyed hot-dip galvanized steel sheet (10 mass % Fe and balance of Zn) having 45 g/m² of coating weight on each side thereof.

(2) GI: A hot-dip galvanized steel sheet having 90 g/m² of coating weight on each side thereof.

The surface of plating layer on each of the zinc-base plated steel sheets was subjected to the treatment described below. The zinc-base plated steel sheet being treated was preliminarily treated by the alkali degreasing to remove press-oil from the surface thereof.

As of the aqueous solutions for forming coating film, the ones which contained Fe ion as the metallic ion were prepared to have the respective compositions given in Table 14 by adding sulfuric ion-laid iron (II)phosphate and citric acid to an aqueous solution which was prepared by dissolving iron(II)sulfate and orthophosphoric acid in deionized water to a specific concentration thereeach. The aqueous solutions which contained Fe ion and Al ion as the metallic ions were prepared to have the respective compositions given in Table 14 by mixing an aqueous solution prepared from iron(II) sulfate and orthophosphoric acid with an aqueous solution prepared from aluminum hydroxide and orthophosphoric acid to a specific concentration the reach. Each of the treatment liquids (at room temperature) given in Table 14 was applied onto the surface of the above-described zinc-base plated steel sheet using roll coater or bar coater, and was heated to dry to form a coating film. The coating weight of the formed film was adjusted depending on the concentration of the composition and the applying conditions (roll-pressing pressure, rotational speed, count of bar coater, and other variables).

The determination of coating weight and the determination of molar ratio of the metallic element to the phosphorus-base oxide in the coating film were conducted in the same procedure as that of Example 1.

As Comparative Examples, conventional application type prephosphate treatment was given to the surface of zinc-base plated steel sheets varying the coating weight. The coating weight of prephosphate of application type was determined by dissolving the coating film in a solution prepared by dissolving 20 g of ammonium dichromate and 490 g of 25% ammonia water in 1 liter of ion-exchanged water, then by calculating the weight change before and after dissolving. The P amount in the coating film was determined by FX in the same procedure with that used in the evaluation of film-removability described later.

The performance evaluation on thus prepared zinc-base plated steel sheets was given as follows.

(1) Press-Formability

The procedure of evaluation was the same with that in Example 1.

(2) Chemical Conversion Treatment Performance

The procedure of evaluation was the same with that in Example 1

(3) Film-removability during degreasing Each sample (150 mm×70 mm) of the zinc-base plated steel sheets of Examples (according to the present invention) and of Comparative Examples was treated by applying press-oil "NOX-RUST 550HN" (manufactured by PARKER INDUSTRIES, INC.) onto the surface thereof. After that, the sample was treated by alkali-degreasing under the condition given below. The P amount in the coating film of the tested sample was determined by FX on separate pieces, each having 48 mm in diameter, taken from the positions sandwiching the tested sample, and by calculating the average value of the two separate pieces.

After degreasing the sample, a portion of 48 mm in diameter at near center of the sample was cut to quantify the P amount at that portion by FX. From the above-described original P amount and the P amount after degreasing, the film-removal rate was calculated using the formula given below.

Film-removal rate=1[(P amount after degreasing)/(Original P value)]

Condition of Alkali Degreasing

Assuming the state of degradation in degreasing liquid, immersion method was applied to conduct degreasing using the alkali degreasing liquid "FC4480" (manufactured by Nihon Parkerizing Co., Ltd.) with the addition of 5 g/l of rust-preventive oil "NOX-RUST 550HN" (manufactured by Nihon Parkerizing Co., Ltd.) The immersion time was 120 seconds, and the temperature of degreasing liquid was 43° C. The degreasing was carried out by the immersion treatment using a 30 liter cylindrical vessel with propeller agitator (300 rpm).

(4) Adhesiveness

After removing the rust-preventive oil from the sample (25 mm×200 mm) by solvent degreasing, the rinse-oil "PRETON R352L" (manufactured by SUGIMURA Chemical Industrial Co., Ltd.) was applied thereon. Two pieces of the sample were paired to prepare a set. A polyvinylchloride hemming adhesive was applied onto each sample over a range of 25 mm×140 mm, (not applying to 50 mm distance from sample edge). After that, two sample pieces were adhered to each other via a spacer having 0.15 mm in thickness. The adhered pair of samples was dried at 160° C. for 10 minutes, then was allowed to stand at normal temperature for 24 to 72 hours. Then, the adhered pair of samples was tested by a tensile tester until they were separated from the T-shape state, and the average strength of the sample under tension was determined.

Table 15 shows the treatment condition of each specimen and the result of above-described performance evaluation. Compared with Comparative Examples, Examples (according to the present invention) are superior not only in chemical conversion treatment performance and press-formability but also in film-removability and adhesiveness.

TABLE 14

| | Cationic ingredient (α) | | | | | Concentration of phosphoric acid ion (β) | Molar ratio of [cation (α)]/ | | | |
|---|---|---|---|---|---|---|---|---|---|---|
| | Main cation | | Other cation | | Total cation | | | Carboxylic acid | | |
| No. | Kind | Concentration (mol/l) | Kind | Concentration (mol/l) | concentration (mol/l) | [as $P_2O_5$] (mol/l) | [phosphoric acid ion (β)] | Kind | Concentration (mol/l) | Classification |
| 1 | Fe | 0.11 | — | — | 0.11 | 0.28 | 0.4 | Citric acid | 0.11 | Example |
| 2 | Fe | 0.11 | — | — | 0.11 | 0.28 | 0.4 | Citric acid | 0.06 | Example |
| 3 | Fe | 0.07 | — | — | 0.07 | 0.18 | 0.4 | Citric acid | 0.07 | Example |
| 4 | Fe | 0.07 | — | — | 0.07 | 0.18 | 0.4 | Citric acid | 0.03 | Example |
| 5 | Fe | 0.11 | Al | 0.02 | 0.13 | 0.28 | 0.5 | Citric acid | 0.03 | Example |
| 6 | Fe | 0.11 | — | — | 0.11 | 0.28 | 0.4 | Oxalic acid | 0.02 | Example |

TABLE 15

| No. | Base sheet being treated *1 | Treatment liquid *2 | Drying temp. (° C.) *3 | Metallic element in coating film | Molar ratio of ingredients in coating film *5 | Coating weight ($mg/m^2$) *4 | Press-formability (friction factor) |
|---|---|---|---|---|---|---|---|
| 1 | GA | 1 | 80 | Fe | 0.4 | 63 | 0.154 |
| 2 | GA | 2 | 80 | Fe | 0.4 | 55 | 0.154 |
| 3 | GA | 3 | 80 | Fe | 0.4 | 43 | 0.157 |
| 4 | GA | 4 | 80 | Fe | 0.4 | 42 | 0.155 |
| 5 | GA | 5 | 80 | Fe, Al | 0.5 | 72 | 0.153 |
| 6 | GA | 6 | 80 | Fe | 0.4 | 70 | 0.152 |
| 7 | GI | 1 | 80 | Fe | 0.4 | 61 | 0.153 |
| 8 | GI | 2 | 80 | Fe | 0.4 | 60 | 0.155 |
| 9 | GI | 3 | 80 | Fe | 0.4 | 50 | 0.155 |
| 10 | GI | 4 | 80 | Fe | 0.4 | 39 | 0.156 |
| 11 | GI | 5 | 80 | Fe, Al | 0.5 | 71 | 0.153 |
| 12 | GI | 6 | 80 | Fe | 0.4 | 82 | 0.155 |
| 13 | GA | Application type prephosphate (coating weight: 0.5 $g/m^2$, P amount: 49 $mg/m^2$) | | | | | 0.154 |
| 14 | GA | Application type prephosphate (coating weight: 1.0 $g/m^2$, P amount: 103 $mg/m^2$) | | | | | 0.155 |
| 15 | GI | Application type prephosphate (coating weight: 0.5 $g/m^2$, P amount: 51 $mg/m^2$) | | | | | 0.168 |

TABLE 15-continued

| No. | Chemical conversion treatment performance (Evaluation 1) PB 3030 | PB 3020 | Chemical conversion treatment performance (Evaluation 2) | Film-removability (film-removal rate) | Adhesiveness (kgf/25 mm) | Classification |
|---|---|---|---|---|---|---|
| 1 | ◎ | ◎ | ◎ | 0.62 | 10.2 | E |
| 2 | ◎ | ◎ | ◎ | 0.53 | 10.3 | E |
| 3 | ◎ | ◎ | ◎ | 0.56 | 10.6 | E |
| 4 | ◎ | ◎ | ◎ | 0.62 | 10.8 | E |
| 5 | ◎ | ◎ | ◎ | 0.57 | 10.2 | E |
| 6 | ◎ | ◎ | ◎ | 0.48 | 10.3 | E |
| 7 | ◎ | ◎ | ◎ | 0.85 | 10.6 | E |
| 8 | ◎ | ◎ | ◎ | 0.88 | 10.5 | E |
| 9 | ◎ | ◎ | ◎ | 0.82 | 10.5 | E |
| 10 | ◎ | ◎ | ◎ | 0.82 | 10.6 | E |
| 11 | ◎ | ◎ | ◎ | 0.76 | 10.3 | E |
| 12 | ◎ | ◎ | ◎ | 0.53 | 10.9 | E |
| 13 | ○ | ○ | Δ | 0.16 | 3.5 | C |
| 14 | Δ | ○ | X | 0.22 | 2.9 | C |
| 15 | ○ | ○ | Δ | 0.39 | 3.6 | C |

E: Example
C: Comparative example
*1 GI: Hot-dip galvanized steel sheet GA: Alloyed hot-dip galvanized steel sheet
*2 Treatment liquid No. given in Table 14
*3 Ultimate sheet temperature
*4 P coating weight
*5 Molar ratio of the sum of the amount of metallic elements (one or more of Mg, Al, Ca, Ti, Fe, Co, Ni, Cu, and Mo) in coating film (a) to the amount of phosphorus-base oxide (b), (amount of phosphorus-base oxide is expressed by $P_2O_5$ conversion value)

Embodiment 2

The inventors of the present invention found that a zinc-base plated steel sheet having both excellent press-formability and excellent chemical conversion treatment performance is obtained by forming a composite coating film containing N ingredient and P ingredient at respective adequate range of composition on the surface of plating layer on a zinc-base plated steel sheet, and that that type of zinc plated steel sheet having both excellent press-formability and excellent chemical conversion treatment performance is stably attained by forming a coating film by applying a phosphoric acid-base aqueous solution having an adequate range of components and of composition onto the surface of plating layer of the zinc-base plated steel sheet.

The present invention was completed based on the above-described findings. The features of the present invention are the following.

[1] A zinc-base plated steel sheet having both excellent press-formability and excellent chemical conversion treatment performance is prepared by forming a composite coating film on the surface of a plating layer on a zinc-base plated steel sheet, which coating film contains N ingredient and P ingredient in a form selected from the group consisting of nitrogen-base compound, phosphorus-base oxide, and nitrogen-phosphorus-base compound, as the film-structuring ingredients, has molar ratio (a)/(b) of from 0.2 to 6, where (a) designates the amount of N ingredient, (the amount of N ingredient is expressed by ammonium conversion value), and (b) designates the amount of P ingredient, (the amount of P ingredient is expressed by $P_2O_5$ conversion value), and has coating weights of from 5 to 300 mg/m$^2$ as the P amount.

[2] A zinc-base plated steel sheet having both excellent press-formability and excellent chemical conversion treatment performance according to [1], wherein the composite coating film further contains at least one metallic element selected from the group consisting of Mg, Al, Ca, Ti, Mn, Fe, Co, Ni, Cu, and Mo, and has molar ratios (a')/(b) of from 0.2 to 6, where (a') designates the sum of the amount of the N ingredient and above-given metallic element, and (b) designates the amount of the P ingredient, (the amount of N ingredient is expressed by ammonium conversion value, and the amount of P ingredient is expressed by $P_2O_5$ conversion value).

[3] A zinc-base plated steel sheet having both excellent press-formability and excellent chemical conversion treatment performance according to [1] or [2], wherein the composite coating film contains at least Fe as the metallic element.

[4] A zinc-base plated steel sheet having both excellent press-formability and excellent chemical conversion treatment performance according to any one of [1] through [3], where the composite coating film further contains silica, and has molar ratio (c)/(b) of from 0.01 to 50, wherein (c) designates the amount of silica, and (b) designates the amount of P ingredient, (the amount of silica is expressed by $SiO_2$ conversion value, and the amount of P ingredient is expressed by $P_2O_5$ conversion value).

[5] A zinc-base plated steel sheet having both excellent press-formability and excellent chemical conversion treatment performance according to any one of [1] through [4], wherein the composite coating film further contains a water-soluble resin and/or a water-dispersible resin at quantities of from 0.01 to 1000 mg/m$^2$ in the coating film.

[6] A method for manufacturing zinc-base plated steel sheet comprising the steps of: applying an aqueous solution containing a cationic ingredient ($\alpha$) consisting essentially of $NH_5^+$ and a phosphoric acid ingredient ($\beta$) (phosphoric acid is expressed by $P_2O_5$ conversion value),at molar ratios ($\alpha$)/($\beta$) of from 0.2 to 6, onto the surface of plating layer on a zinc-base plated steel sheet; and drying the applied aqueous solution, without giving washing with water, to form a coating film.

[7] A method for manufacturing zinc-base plated steel sheet comprising the steps of: applying an aqueous solution containing a cationic ingredient (α) consisting essentially of $NH_4^+$ and one or more metallic ions selected from the group consisting of Mg, Al, Ca, Ti, Mn, Fe, Co, Ni, Cu, and Mo, and a phosphoric acid ingredient (β), at ratios (α)/(β) of from 0.2 to 6, (phosphoric acid is expressed by $P_2O_5$ conversion value), onto the surface of plating layer on a zinc-base plated steel sheet; and drying the applied aqueous solution, without giving washing with water, to form a coating film.

[8] A method for manufacturing zinc-base plated steel sheet having both excellent press-formability and excellent chemical conversion treatment performance according to [6] or [7], where the molar ratio (α)/(β) is of from 0.4 to 6, wherein (α) designates the sum of the amount of cationic ingredients and (β) designates the amount of phosphoric acid ingredient, in the aqueous solution applied onto the surface of the plating layer, (the phosphoric acid is expressed by $P_2O_5$ conversion value).

[9] A method for manufacturing zinc-base plated steel sheet according to any one of [6] through [8], where the aqueous solution applied onto the surface of plating layer further contains silica (γ), and the molar ratio (γ)/(β) is from 0.01 to 50, where (γ) designates the amount of silica, (the silica is expressed by $SiO_2$ conversion value), and (β) designates the amount of phosphoric acid ingredient, (the phosphoric acid is expressed by $P_2O_5$ conversion value).

[10] A method for manufacturing zinc-base plated steel sheet having both excellent press-formability and excellent chemical conversion treatment performance according to any one of [6] through [9], wherein the aqueous solution applied onto the surface of plating layer further contains a water-soluble resin and/or a water-dispersible resin.

[11] A method for manufacturing zinc-base plated steel sheet having both excellent press-formability and excellent chemical conversion treatment performance according to any one of [6] through [10], wherein the aqueous solution applied onto the surface of plating layer contains at least Fe as the cationic ingredient.

[12] A method for manufacturing zinc-base plated steel sheet having both excellent press-formability and excellent chemical conversion treatment performance according to any one of [6] through [11], wherein the aqueous solution applied onto the surface of plating layer further contains carboxylic acid.

[13] A method for manufacturing zinc-base plated steel sheet having both excellent press-formability and excellent chemical conversion treatment performance according to [12], wherein the carboxylic acid in the aqueous solution applied onto the surface of plating layer is oxycarboxylic acid.

[14] A method for manufacturing zinc-base plated steel sheet having both excellent press-formability and excellent chemical conversion treatment performance according to [14], wherein the oxycarboxylic acid is citric acid.

The zinc-base plated steel sheet (zinc-base plated steel sheet as the mother material for coating treatment) according to the present invention is a plated steel sheet which is prepared by forming a zinc-base plating layer on the surface of a steel sheet using hot-dip plating process, electroplating process, or chemical vapor deposition process. Examples of the composition of zinc-base plating layer are a plating layer consisting of pure zinc, a single layer of, and a plurality of layers of one or more substances selected from the group consisting of metals such as Fe, Ni, Co, Mn, Cr, Al, Mo, Ti, Si, W, Sn, Pb, Nb, and Ta, an oxide of these metals, and an organic compound of these metals. Those kinds of zinc-base plating layer may further contain oxide fine particles of $SiO_2$, $Al_2O_3$, and the like, or one or more of organic resin. The zinc-base plated steel sheet may be a multilayer plated steel sheet having plurality of plating layers having different plating compositions in each layer, or may be a functionally gradient plated steel sheet in which the compositions of plating layers are varied in a gradient pattern in the layer-thickness direction.

Examples of the zinc-base plated steel sheet are: hot-dip galvanized steel sheet; vapor deposition galvanized steel sheet; iron-zinc alloyed hot-dip galvanized steel sheet; zinc-aluminum-base hot-dip plated steel sheet (for example, Zn-5% Al alloy hot-dip plated steel sheet and Zn-55% Al alloy hot-dip plated steel sheet); alloyed hot-dip galvanized steel sheet in which only the plating layer near the steel sheet is alloyed, (generally called the "half-alloy"); plated steel sheet, one face of which consists of iron-zinc alloyed hot-dip zinc plating layer, while the other face of which consists of hot-dip zinc plating layer; plated steel sheet in which the plating layer on each of above-described steel sheets is further subjected to vapor deposition process or the like to form an alloy plating layer consisting of zinc or consisting mainly of zinc; and dispersion plated steel sheet having a plating layer having a matrix made by zinc and containing dispersed fine particles of $SiO_2$ or the like.

The zinc-base plated steel sheet according to the present invention is prepared by forming a composite coating film containing N ingredient (for example, in a form of nitrogen compound) and P ingredient (for example, in a form of phosphorus-base oxide) at an adequate range of composition on the surface of plating layer on the above-described base material plated steel sheet, thus providing the zinc-base plated steel sheet having excellent chemical conversion treatment performance and excellent press-formability.

The detail of the present invention is described in the following along with the reasons of limiting the conditions.

Generally, conventional zinc-base plated steel sheets are inferior in the press-formability to the cold-rolled steel sheets. The reason of inferiority is the increase in the sliding resistance owing to the adhesion phenomenon appeared under a high face pressure between press-die and zinc having low melting point and having soft property. To avoid the drawback, it is effective to form a coating film having higher hardness and higher melting point than those of zinc or zinc alloy plating layer on the surface of the plating layer of zinc-base plated steel sheet.

To achieve the measures, the present invention forms a composite coating film having high hardness and high melting point, containing N ingredient and P ingredient in a form selected from the group consisting of nitrogen-base compound, phosphorus-base oxide, and nitrogen-phosphorus-base compound, as the film-structuring ingredients on the surface of plating layer, at a specified composition ratio. Since the composite coating film contains both the N ingredient and the P ingredient at a specific composition ratio, highly uniform covering on the surface of zinc-base plated steel sheet is available, and direct contact between zinc and die can be prevented even with a thin film. The availability of that uniform coating film owes to the functions of the N ingredient which structures the composite coating film.

The method for forming the composite coating film is not specifically limited. Generally, however, the composite coating film is formed by applying and drying an aqueous solution containing film ingredients. When the film ingredients are solely the phosphorus-base oxide, the etching action thereof induces the dissolution of zinc in the plating layer, and the dissolved zinc is caught as a coating film ingredient. In that case, zinc and phosphoric acid react to each other to likely yield a crystalline phosphate. When that type of crystalline phosphate is generated, the uniformity of coating film degrades, and the complete covering over the plating layer in a thin film state becomes difficult. To the contrary, for the case of existence of the N ingredient in the coating film according to the present invention, the reaction between the phosphoric acid and the zinc during the film-forming stage is suppressed, and the phosphoric acid ingredient is difficult to become crystalline with zinc, thus the N ingredient and the phosphoric acid ingredient (P ingredient) form a network coating film. That type of function is attained when the molar ratio of the amount of N ingredient (a) to the amount of P ingredient (b), (a)/(b), is in a specified range, thus allowing forming uniform coating film.

In addition, when the coating film contains, adding to the N ingredient, one or more metallic elements selected from the group consisting of Mg, Al, Ca, Ti, Mn, Fe, Ni, Co, Cu, and Mo, the uniformity of the coating film particularly improves, and the press-formability becomes favorable. A presumable reason for the improvement is that these metallic elements form a network coating film along with the phosphoric acid ingredient. In particular, the reaction-suppression effect of zinc and phosphoric acid owing to the presence of the N ingredient and the network-forming effect of the above-given metallic elements and the phosphoric acid ingredient give a synergistic effect to provide a coating film having higher uniformity.

The following is the description of the relation between the above-described composite coating film and the chemical conversion treatment performance.

In usual practice, degreasing step is adopted as a pretreatment of chemical conversion treatment step to remove the press oil applied in the press working step. Since the composite coating film formed on the surface of plating layer according to the present invention is easily dissolved by an alkali degreasing liquid, most part of the coating film is removed in the degreasing step. As a result, the chemical conversion treatment step is carried out in a state that the coating film is almost dissolved and removed, thus favorable phosphoric acid crystals are formed on the plating surface. In addition, even when insufficient removal of phosphorus-base oxide coating film (dissolving to remove the coating film) during the degreasing step resulted to give a remained coating film in a part thereof caused by insufficient flow-in of degreasing liquid because of the degradation of degreasing liquid or depending on the positions, the zinc-base plated steel sheet according to the present invention can provide favorable chemical conversion treatment performance. The reason of the availability is that the coating film has satisfactory dissolving property not only in the degreasing liquid but also in the chemical conversion treatment liquid because the N ingredient is adopted as the film-structuring ingredient and because the composition ratio thereof is limited to a specified range.

That is, the dissolving property of above-described coating film, (film-removability), differs with the ratio of the N ingredient to the P ingredient, both of which structure the coating film. Generally, increase in the amount of P ingredient compared with the amount of N ingredients increases the dissolving property of the coating film itself. Since, however, the formation of a coating film containing large amount of P ingredient needs to apply and dry an aqueous solution containing large amount of ingredient such as phosphoric acid having high etchability, the amount of zinc caught by the coating film increases, thus degrading the dissolving property of the coating film. Therefore, it is necessary for the amount of P ingredient and the amount of N ingredients to be balanced between the securing dissolving property of coating film itself and the effect to suppress the intake of zinc by etching. When the amount of N ingredient becomes extremely excessive against the amount of P ingredient, the performance of the coating film to form network degrades. In that case, formation of uniform coating film becomes difficult, though the dissolving property of the coating film increases, thus the excellent press-formability also becomes difficult to attain.

The above-described composite coating film contains zinc which unavoidably enters from the plating layer. The phosphorus-base oxide coating film according to the present invention does not specially limit the amount of existing zinc because excellent chemical conversion treatment performance is available even when the coating film contains zinc owing to the existence of the N ingredient, the specified metallic element ingredient, and the phosphorus-base oxide at a specific ratio.

The following is the description of the composition of composite coating film and the reasons for limiting the composition according to the present invention.

The composite coating film contains an N ingredient (for example, N ingredient in a form of nitrogen-base compound) as the structuring ingredient, along with the P ingredient (for example, P ingredient in a form of phosphorus-base oxide), to provide the coating film with dissolving property. The existing form of the N ingredient and the P ingredient is not specifically limited, and may be in a form of nitrogen-base compound (for example, ammonium phosphate and nitrogen oxide), phosphorus-base oxide, and nitrogen-phosphorus-base compound ($ZnNH_4PO_4$). Consequently, the composite coating film according to the present invention preferably consists essentially of N ingredient and P ingredient, which are in a form selected from the group consisting of nitrogen-base oxide, phosphorus-base compound, and nitrogen-phosphorus-base compound, and, at need, one or more specific metallic element ingredients, silica, and organic resin, which are described later, and balance of inevitable impurities such as zinc.

The molar ratio (a)/(b) is 0.2 to 6, where (a) designates the amount of N ingredient in the composite coating film (the amount of N ingredient is expressed by ammonium conversion value), and (b) designates the amount of P ingredient in the composite coating film (the amount of P ingredient is expressed by $P_2O_5$ conversion value). If the molar ratio (a)/(b) is less than 0.2, the rate of the P ingredient becomes excessive, which likely results in non-uniform coating film, further likely induces degradation of press-formability. Furthermore, since the composite coating film becomes difficult to be removed during the chemical conversion treatment, the chemical conversion treatment performance also degrades. On the other hand, if the molar ratio (a)/(b) exceeds 6, the rate of the N ingredients becomes excessive, which also degrades the uniformity of coating film, and thin film portion and thick film portion likely become coexist. As a result, during the chemical conversion treatment which is the pre-coating treatment in the automobile manufacturing process, the reaction with treatment liquid is hindered at the thick film portion, which results in difficulty in generating favorable phosphoric acid crystals to induce insufficient chemical conversion treatment. In addition, the degradation in the uniformity of coating film gives less effect of improving the press-formability. Furthermore, since the stability of coating film is low, under the storage in humid environment or in condensation environment, a part of the coating film dissolves to act as an electrolyte to induce corrosion of the zinc-base plated steel sheet.

Further preferable molar ratio of the N ingredient (a) to the P ingredient (b), (a)/(b), is 0.4 as the lower limit and 2 as the upper limit, where the amount of N ingredient is expressed by ammonium conversion value, and the amount of P ingredient is expressed by $P_2O_5$ conversion value.

When the composite coating film further contains one or more metallic elements selected from the group consisting of Mg, Al, Ca, Ti, Mn, Fe, Ni, Co, Cu, and Mo, particularly the film-removability (dissolving property) becomes favorable together with the uniform covering property. The effect is obtained presumably by, adding to the improved dissolving property of coating film owing to the coexistence of these metallic elements with the N ingredient, the synergy effect with the suppression of reaction between zinc and phosphoric acid ingredient owing to the coexistence of the metallic element ingredient, thus forming the coating film having higher film-removability.

As of the above-described metallic element ingredients, Al, Mn, Fe, and Co are more preferable ones, and, when these metallic element ingredients exist in the coating film, the coating film more easily dissolves in the chemical conversion treatment liquid so that further superior chemical conversion treatment performance is available.

When the composite coating film contains Fe as the metallic element ingredient, the growth of phosphate crystals is very little hindered during the chemical conversion treatment so that specifically superior chemical conversion treatment performance is attained. Although the reason of that superiority is not fully analyzed, it is confirmed that, when the composite coating film contains Fe, the chemical conversion crystals are generated even when the coating film is left during the chemical conversion treatment. The film-removability of the composite coating film during the degreasing step significantly differs with the state of alkali degreasing liquid and the condition of degreasing. Under a condition of extremely degraded degreasing liquid or of not applying strong degreasing such as spray degreasing, sufficient degreasing may not be performed. In such a case, the composite coating film containing Fe effectively functions to attain the chemical conversion treatment performance.

Generally, automobile use and household electric appliances use adopt the joining steel sheets using adhesives to increase the corrosion resistance. In that case, the presence of coating film which was added to increase the lubrication characteristic may significantly degrade the adhesiveness of joining parts. Conventional lubrication coating film containing phosphoric acid particularly shows the tendency, and the improvement has been wanted. To that kind of issue, the above-described composite coating film shows significant improvement in the compatibility with adhesives by adding Fe as the metallic element ingredient to the composite coating film.

Consequently, when the above-given effect is expected, it is preferred that the composite coating film contains at least Fe as the metallic element, and more preferably contains sole Fe or Fe with above-described Al.

The form of the Fe in the coating film is not specifically limited, and it may be in a form of metal, oxide, compound with phosphoric acid ingredient.

When the composite coating film contains an N ingredient together with one or more metallic elements selected from the group consisting of Mg, Al, Ca, Ti, Mn, Fe, Co, Ni, Cu, and Mo, the molar ratio (a')/(b) is 0.2 to 6, where (a') designates the amount of the sum of the N ingredient and the above-described metallic elements, (the amount of N ingredient is expressed by ammonium conversion value), and (b) designates the amount of P ingredient (the amount of P ingredient is expressed by $P_2O_5$ conversion value). If the molar ratio (a')/(b) is less than 0.2, the rate of the P ingredient becomes excessive, which likely results in non-uniform coating film, further likely induces degradation of press-formability. Furthermore, since the composite coating film becomes difficult to be removed during the chemical conversion treatment, the chemical conversion treatment performance also degrades. On the other hand, if the molar ratio (a')/(b) exceeds 6, the rate of the N ingredient and the metallic element ingredient becomes excessive, which also degrades the uniformity of coating film, and thin film portion and thick film portion likely become coexist. As a result, during the chemical conversion treatment which is the pre-coating treatment in the automobile manufacturing process, the reaction with treatment liquid is hindered at the thick film portion, which results in difficulty in generating favorable phosphoric acid crystals to induce insufficient chemical conversion treatment. In addition, the degradation in the uniformity of coating film gives less effect of improving the press-formability. Furthermore, since the stability of coating film is low, under the storage in humid environment or in condensation environment, a part of the coating film dissolves to act as an electrolyte to induce corrosion of the zinc-base plated steel sheet.

Further preferable molar ratio of the sum of the N ingredient and the metallic elements (a') to the P ingredient (b), (a')/(b), is 0.4 as the lower limit and 2 as the upper limit, where the amount of N ingredient is expressed by ammonium conversion value, and the amount of P ingredient is expressed by $P_2O_5$ conversion value.

The composite coating film according to the present invention may further contain silica. By adding silica to the composite coating film, the sliding performance is further improved. A presumable reason of the improvement in slidability is that the silica ingredient has an effect to increase the water-retaining capacity and that the silica ingredient acts as a lubricant in a dry friction state. Furthermore, when a film-forming method applying aqueous solution and drying the solution is adopted, the addition of silica to the coating film improves the wetting property of the zinc-base plating film with the aqueous solution, which allows forming uniform coating film on the plating layer.

When silica is added to the composite coating film, the effect of silica becomes significant in a range of 0.01 to 50 of the molar ratio (c)/(b), where (c) designates the amount of silica in the coating film (the amount of silica is expressed by $SiO_2$ conversion value) and (b) designates the amount of phosphorus-base oxide in the coating film (the amount of phosphorus-base oxide is expressed by $P_2O_5$ conversion value). If the molar ratio (c)/(b) is less than 0.1, the effect of silica addition cannot fully be attained. If the molar ratio (c)/(b) exceeds 50, the amount of silica becomes excessive, which results in chipping the silica ingredient during press-forming to cause surface defects and galling.

Applicable silica may be silica sol or dry silica such as fumed silica. Examples of silica sol are "Snowtex" (trade mark: O, OS, OUP, AK, N, 20, 30, 40) (manufactured by Nissan Chemical Industries, Ltd.), "Cataloid" (trade name: S, SI, SA, SN) (manufactured by CATALYSTS & CHEMICALS IND. CO., LTD.), and "Adelite" (trade name: AT-20, AT-50, AT-20N, AT-300, AT-300S, AT-20Q) (manufactured by Asahi Denka Kogyo K. K.) As of these silica sols, the type of neutralized in surface potential by ammonium ion is particularly preferable. Examples of fumed silica are "AEROSIL 200" and "AEROSIL 300" (manufactured by Nippon Aerosil Co., Ltd.)

The composite coating film according to the present invention may further contain an organic resin ingredient to improve the lubrication performance. A preferable organic resin is water-soluble resin and/or water-dispersible resin, which can coexist with other inorganic ingredient in aqueous solution. Examples of the organic resin are epoxy resin, acrylic resin, acrylic-ethylene copolymer, acrylic-styrene copolymer, alkyd resin, polyester resin, polyurethane resin, polybutadiene resin, or polyamide resin. Adding to these resins, coexistence of cross-linking agent is effective, which cross-linking agent includes water-soluble epoxy resin, water-soluble phenol resin, water-soluble butadiene rubber (SBR, NBR, MBR), melamine resin, block isocyanate, and oxazoline compound.

A preferred coating weight of the organic resin added to the composite coating film is 0.01 to 1000 $mg/m^2$. If the amount of organic resin is less than 0.01 $mg/m^2$, the effect cannot fully be attained. If the amount thereof exceeds 1000 $mg/m^2$, the coating film thickness increases to likely induce the film separation, which fails in attaining satisfactory effect.

The zinc-base plated steel sheet according to the present invention specifies the coating weight of the composite coating film formed on the plating layer to a range of from 5 to 300 $mg/m^2$ as the P amount, preferably from 10 to 150 $Mg/m^2$, and more preferably from 30 to 120 $mg/m^2$. If the coating weight is small, the effect to improve the press-formability cannot fully be attained. If the coating weight is excessive, the chemical conversion treatment performance degrades.

The composite coating film according to the present invention may be in either form of crystalline or amorphous if only the film-removability and the uniform covering of the coating film are secured. Furthermore, the coating film allows existence of $H_2O$ ingredient as the water of crystallization accompanied with the crystalline ingredient, and of $H_2O$ ingredient existing in amorphous film.

The following is the description of the method for manufacturing zinc-base plated steel sheet having the above-described composite coating film.

The composite coating film on the zinc-base plated steel sheet according to the present invention is prepared, for example, by applying an aqueous solution containing ammonium ion and phosphoric acid ion onto the surface of plating layer, followed by drying the aqueous solution. In that case, the ratio of the cationic ingredient and the phosphoric acid ingredient in the aqueous solution may be varied responding to the composition of the coating film.

According to the method for manufacturing zinc-base plated steel sheet of the present invention, an aqueous solution containing a cationic ingredient (a) consisting essentially of $NH_4^+$ and a phosphoric acid ion ($\beta$) as the anionic ingredient is applied onto the surface of plating layer on the zinc-base plated steel sheet, and the applied aqueous solution is dried, without giving washing with water, to form the coating film, which aqueous solution has specific range of molar ratio ($\alpha$)/($\beta$) of from 0.2 to 6. As a result, a hard and thin coating film having high melting point, containing N ingredient and P ingredient in a form of nitrogen-base compound, phosphorus-base oxide, or nitrogen-phosphorus-base compound is formed uniformly and densely on the surface of the zinc-base plating coating film.

In common practice, to form a coating film containing phosphorus, such as the phosphate coating film on the surface of zinc-base plated steel sheet, the treatment of, for example, immersing the plated steel sheet in an aqueous solution containing phosphoric acid ion is applied. Generally, the phosphate containing cation other than alkali metal makes the aqueous solution acidic because that type of phosphate is not soluble in alkali domain. Furthermore, the aqueous solution of these cationic ingredients and the phosphoric acid likely generates precipitation. Normally the aqueous solution is stable when the phosphoric acid ion exists in excess amount compared with the cationic ingredient. In that kind of aqueous solution with excess amount of phosphoric acid, the zinc in the plating layer is easily etched, and the eluted zinc tends to react with the phosphoric acid ion to form crystals or to form a reaction layer containing zinc at the interface. As described before, when crystalline ingredients exist in excessive amount in the coating film, these crystalline ingredients are separated during press-forming to deposit between the coating film and the die to degrade the sliding performance, which likely induces die-galling and other defects. In addition, since zinc and coating film form a reaction layer, the film removal during the chemical conversion treatment becomes difficult to occur, which results in insufficient chemical conversion treatment performance.

To the contrary, the aqueous solution for film-forming according to the present invention has the features that the cationic ingredient ($\alpha$) consists essentially of ammonium ion, (nevertheless, further specific metallic ion may be added as cationic ingredient ($\alpha$) as described later), and that the ratio of the amount of phosphoric acid ion ($\beta$) to the amount of cationic ingredient ($\alpha$) is specified. With the existence of ammonium ion, the solution does not induce precipitation even when the concentration of phosphoric ion to the cationic ingredient is kept to a low level, thus preparing a solution which minimizes the zinc etching in the plating layer. As a result, the treatment according to the present invention allows obtaining zinc-base plated steel sheet which shows excellent press-formability without degrading the chemical conversion treatment performance.

Degreasing step for removing press-oil is generally applied as the preliminary treatment of the chemical conversion treatment. For the coating film which is formed by the treatment according to the present invention, the formation of a layer reacting with zinc is suppressed, and the interface to the zinc-base plating layer is likely dissolved by the alkali degreasing liquid, thus most part of the coating film is removed during the degreasing step. Consequently, the coating film is almost completely dissolved during the chemical conversion treatment to form favorable phosphate crystals. With that type of function, even when the film-removability is insufficient during the degreasing step to result in remained coating film in a part thereof caused by insufficient flow-in of degreasing liquid because of the degradation of degreasing liquid or depending on the positions, the zinc-base plated steel sheet according to the present invention can provide favorable chemical conversion treatment performance.

Presumable main reasons for the zinc-base plated steel sheet according to the present invention to show favorable chemical conversion treatment performance are the following.

(1) As described later, since a dense and uniform coating film is formed on the surface of the plating layer, satisfactory press-formability is attained even with very thin coating film. Therefore, the coating film does not become thick one to hinder the reaction with the chemical conversion treatment liquid.

(2) Since the formation of a layer reacting with zinc is suppressed, the separation of coating film in the chemical conversion treatment liquid likely occurs.

According to the present invention, the molar ratio of the cationic ingredient (α) (cationic ingredient consisting essentially of ammonium ion) in the aqueous solution to the phosphoric acid ion (β) in the aqueous solution is specified to a specific range. As a result, uniform and dense thin coating film is formed. Although the reason that the ratio of the cationic ingredient (α) in the aqueous solution to the phosphoric acid ion (β) in the aqueous solution gives influence on the coating form is not fully determined, a presumable reason is that the etchability of the treatment liquid and the dissolving property of the treatment liquid vary with the ratio of these ingredients so that these variations induce the changes in coating film form. That is, when the amount of phosphoric acid ion (β) is excessive, the etchability of the treatment liquid increases, and the crystalline ingredient is likely formed by the reaction with zinc, thus the coating film form becomes aggregate of lumpy crystalline ingredients, rather than thin film. On the other hand, if the amount of cationic ingredient (α) is excessive, the dissolving property of the treatment liquid increases, and the coating film is difficult to gel during the drying step, thus uniform coating film is difficult to be formed.

Therefore, the molar ratio of the cationic ingredient (α) consisting essentially of ammonium ion ($NH_4^+$) to the phosphoric acid ion (β), (the phosphoric acid is expressed by $P_2O_5$ conversion value), is from 0.6 to 6, preferably from 0.4 to 6, more preferably from 0.6 to 4, and most preferably from 1 to 4.

If the molar ratio (α)/(β) is less than 0.2, the amount of phosphoric acid ion becomes excessive, and the crystalline ingredient of zinc and phosphoric acid is likely formed, which is difficult to attain excellent slidability. Furthermore, since the coating film becomes difficult to be removed during the chemical conversion treatment, the chemical conversion treatment performance degrades. If the molar ratio (α)/(β) exceeds 6, the formed coating film becomes non-uniform so that the thin film portion and the thick film portion likely become coexist. As a result, during the chemical conversion treatment as the pre-coating treatment in the automobile manufacturing process, the reaction with the treatment liquid is hindered by the thick portion of the coating film, and the favorable phosphate crystals are difficult to be formed, which results in insufficient chemical conversion treatment. In addition, since the uniformity of the coating film degrades, the effect to improve the press-formability becomes small. Furthermore, since the dissolving property of the coating film increases, under the storage in humid environment or in condensation environment, a part of the coating film dissolves to act as an electrolyte to induce corrosion of the zinc-base plated steel sheet.

Applicable ammonium ion being added to the aqueous solution for forming coating film includes, other than the addition in a form of ammonia, in a form of phosphate such as ammonium primary phosphate (ammonium dihydrogenphosphate), ammonium secondary phosphate (diammonium hydrogen phosphate), and ammonium tertiary phosphate (triammonium phosphate), or in a form of ammonium salt such as ammonium nitrate, ammonium sulfate, ammonium acetate, and ammonium citrate. As of these forms, ammonium phosphate may be added by simultaneously phosphoric acid ion and ammonium ion. It is, however, particularly preferable that the mixed addition of ammonium primary phosphate and ammonium secondary phosphate, or the mixed addition of ammonium secondary phosphate and ammonium tertiary phosphate to control the molar ratio of phosphoric acid ion to ammonium ion. When an ammonium salt other than phosphate is adopted, excess amount of anionic ingredient other than phosphoric acid acts as the water-soluble ingredient in the coating film after dried, so that the added amount thereof is preferably minimized.

Since the phosphoric acid ion in the aqueous solution for forming the coating film varies its own form depending on the pH of aqueous solution, the degree of polymerization of the added phosphoric acid, the oxidized state, and the like, the existence form of the phosphoric acid ion is not specifically limited. Accordingly, the phosphoric acid ion may be the ion in arbitrary form such as condensed phosphoric acid such as orthophosphoric acid, diphosphoric acid, tripolyphosphoric acid, tetrapolyphosphoric acid, and hexametaphosphoric acid, and phosphorous acid, and phosphinic acid.

The phosphoric acid ion added to the aqueous solution may be in a form of ammonium phosphate, phosphoric acid, diphosphoric acid, tripolyphosphoric acid, tetrapolyphosphoric acid, hexametaphosphoric acid, phosphorous acid, phosphinic acid, or their ammonium salt.

The aqueous solution for forming coating film according to the present invention may further contain one or more metallic ions, as the cationic ingredient (a), selected from the group consisting of Mg, Al, Ca, Ti, Mn, Fe, Co, Ni, Cu, and Mo.

When these cationic ingredients exist, the press-formability and the chemical conversion treatment performance further improve. Although the reason of the improvement is not fully analyzed, a presumable reason is that an insoluble compound is formed from these metallic ions during the drying step after the aqueous solution was applied, which insoluble compound contributes to the formation of dense coating film that can uniformly cover the plating layer on the zinc-base plated steel sheet. Owing to the more uniform and dense coating film, the press-formability is improved with thin film which does not give influence on the reaction with the treatment liquid during the chemical conversion treatment, thus attaining both the chemical conversion treatment performance and the press-formability at high grade.

Among the above-described metallic ions, Al, Fe, Co, and Mn are more preferred ingredients. With the addition of these preferred metallic ions, the coating film becomes more easily dissolve in the chemical conversion treatment liquid, and further superior chemical conversion treatment performance is attained.

When the aqueous solution for forming coating film contains Fe as the metallic ion, the growth of phosphate crystals is very little hindered during the chemical conversion treatment so that specifically superior chemical conversion treatment performance is attained. Although the reason of that superiority is not fully analyzed, when the aqueous solution contains Fe, the chemical conversion crystals are generated even when the coating film is left during the chemical conversion treatment. The film-removability of the composite coating film during the degreasing step significantly differs with the state of alkali degreasing liquid and the condition of degreasing. Under a condition of extremely degraded degreasing liquid or of not applying strong degreasing such as spray degreasing, sufficient degreasing may not be performed. In such a case, the aqueous solution containing Fe effectively functions to the chemical conversion treatment performance.

Generally, automobile use and household electric appliances use adopt joining steel sheets using adhesives to increase the corrosion resistance. In that case, the presence of coating film which was added to increase the lubrication characteristic may significantly degrade the adhesion of joining parts. Conventional lubrication coating film containing phosphoric acid particularly shows the tendency, and the improvement has been wanted. To that kind of issue, the above-described phosphorus-base oxide coating film shows significant improvement in the compatibility to adhesives by adding Fe as the metallic ion to the aqueous solution.

Consequently, when the above-given effect is expected, it is preferred that the aqueous solution contains at least Fe as the metallic ion, and more preferably contains sole Fe or Fe with above-described Al.

When the cationic ingredient (α) in the aqueous solution consists essentially of ammonium ion ($NH_4^+$) and above-described metallic ion (one or more metallic ions selected from the group consisting of Mg, Al, Ca, Ti, Mn, Fe, Co, Ni, Cu, and Mo), the molar ratio of the sum of the cationic ingredients (α) to the phosphoric acid ion (β), (the phosphoric acid ion is expressed by $P_2O_5$ conversion value), is from 0.2 to 6, preferably from 0.4 to 6, more preferably from 0.6 to 4, and most preferably from 1 to 4.

If the molar ratio (α)/(β) is less than 0.2, the amount of phosphoric acid ion becomes excessive, and the crystalline ingredient of zinc and phosphoric acid is likely formed, which is difficult to attain excellent slidability. Furthermore, since the coating film becomes difficult to be removed during the chemical conversion treatment, the chemical conversion treatment performance degrades. If the molar ratio (α)/(β) exceeds 6, the formed coating film becomes non-uniform so that the thin film portion and the thick film portion likely become coexist. As a result, during the chemical conversion treatment as the pre-coating treatment in the automobile manufacturing process, the reaction with the treatment liquid is hindered by the thick portion of the coating film, and the favorable phosphate crystals are difficult to be formed, which results in insufficient chemical conversion treatment. In addition, since the uniformity of the coating film degrades, the effect to improve the press-formability becomes small. Furthermore, since the dissolving property of the coating film increases, under the storage in humid environment or in condensation environment, a part of the coating film dissolves to act as an electrolyte to induce corrosion of the zinc-base plated steel sheet.

When the aqueous solution for forming the coating film contains Al as the metallic ion, the molar concentration ratio (δ)/(β) is preferably 1/10 or more and less than 2/3, where (δ) designates the amount of Al, and (O) designates the amount of phosphoric acid ingredient (the amount of phosphoric acid is expressed by the $P_2OS$ conversion value). With that range of the molar ratio (δ)/(β), the press-formability and the chemical conversion treatment performance are further improved. A presumable reason of the improvement is that the coating film uniformity and the coating film dissolving property are further improved in the molar concentration ratio range. If the molar ratio (δ)/(β) becomes 2/3 or more, the amount of Al becomes excessive, which should likely induce the generation of crystalline ingredient and bring the coating film insoluble.

The metallic ions of one or more metallic elements selected from the group consisting of Mg, Al, Ca, Ti, Mn, Fe, Co, Ni, Cu, and Mo may be added in a form of, other than phosphate, water-soluble metallic salt such as nitrate, sulfate, and acetate. Alternatively, an aqueous solution prepared by the reaction of an oxide or a hydroxide containing above-given metals with orthophosphoric acid may be used. In the latter case, the molar ratio of cationic ingredient (α) to phosphoric acid ingredient (β) may be adjusted to the above-described range. Furthermore, if an aqueous solution prepared by the reaction between the metallic cationic ingredient and the phosphoric acid ingredient at specific temperature for specific time to minimize the amount of free phosphoric acid is used, the networking performance of the coating film increases.

The cationic ingredient (α) existing in the aqueous solution for forming the coating film according to the present invention consists essentially of ammonium ion ($NH_4^+$) and above-described metallic ion (added at need) (one or more metallic ions selected from the group consisting of Mg, Al, Ca, Ti, Mn, Fe, Co, Ni, Cu, and Mo). Accordingly, other cation, excluding cation existing as impurity, is not added to the aqueous solution.

In particular, alkali metal is not preferable because the alkali metal likely induces leaving a soluble ingredient in the coating film. Zinc ion is also not preferable because the zinc ion likely forms crystalline coating film.

As for the anionic ingredients, when cationic ingredient is added to the aqueous solution in a form of oxide of nitrate, sulfate, acetate, or the like, hydroxide, or salt other than phosphate, anionic ingredient such as nitric acid ion, sulfuric acid ion, and acetic acid ion may be existed. The aqueous solution for forming coating film according to the present invention may further contain an adequate amount of silica (γ) The addition of silica (γ) allows forming a coating film having further preferable press-formability and chemical conversion treatment performance. The addition of silica (γ) further provides more significant effect to improve the press-formability with thin coating film. A presumable reason of the effect is that the added silica improves the wetting property of aqueous solution for forming coating film, thus forming uniform coating film giving no microscopic water-repellence on the plating layer. Since further significant effect to improve the press-formability is provided even for that thin coating film, the removal of coating film during the chemical conversion treatment easily occurs to improve the chemical conversion treatment performance.

The amount of added silica (γ) is specified to a range of molar ratio to the phosphoric acid ion (β), (γ)/(γ), of from 0.01 to 50, where the amount of silica is expressed by $SiO_2$ conversion value, and the amount of phosphoric acid ion is expressed by $P_2O_5$ conversion value.

If the molar ratio (γ)/(β) is less than 0.01, the effect of silica addition cannot fully be attained. If the molar ratio (γ)/(β) exceeds 50, the silica ingredient exists in excess amount, which chips the silica ingredient during press-forming to induce surface defects such as dents and induce galling.

As for the silica (γ), silica sol or dry silica such as fumed silica may directly added to the aqueous solution.

Examples of silica sol are "Snowtex" (trade mark: O, OS, OUP, AK, N, 20, 30, 40) (manufactured by Nissan Chemical Industries, Ltd.), "Cataloid" (trade name: S, SI, SA, SN) (manufactured by CATALYSTS & CHEMICALS IND. CO., LTD.), and "Adelite" (trade name: AT-20, AT-50, AT-20N, AT-300, AT-300S, AT-20Q) (manufactured by Asahi Denka Kogyo K. K.) As of these silica sols, the type of neutralized in surface potential by ammonium ion is particularly preferable. Examples of fumed silica are "AEROSIL 200" and "AEROSIL 300" (manufactured by Nippon Aerosil Co., Ltd.)

To the aqueous solution for forming coating film according to the present invention, an adequate amount of organic resin ingredient may further be added. The addition of the organic resin ingredient further improves the lubrication performance of the coating film. A preferable organic resin is water-soluble resin and/or water-dispersible resin, which can coexist with other inorganic ingredient in aqueous solution. Examples of the organic resin are epoxy resin, acrylic resin, acrylic-ethylene copolymer, acrylic-styrene copolymer, alkyd resin, polyester resin, polyurethane resin, polybutadiene resin, or polyamide resin. Adding to these resins, coexistence of cross-linking agent is effective, which cross-linking-agent includes water-soluble epoxy resin, water-soluble phenol resin, water-soluble butadiene rubber (SBR, NBR, MBR), melamine resin, block isocyanate, and oxazoline compound.

The coating weight of the organic resin in the composite coating film may be adjusted by varying the concentration of the resin in the aqueous solution for forming coating film. A preferred coating weight of the organic resin added to the composite coating film is 0.01 to 1000 mg/n$^2$. If the amount of organic resin is less than 0.01 mg/m$^2$, the effect cannot fully be attained. If the amount thereof exceeds 1000 mg/m$^2$, the coating film thickness increases to likely induce the film separation, which fails in attaining satisfactory effect.

The aqueous solution according to the present invention may further contain carboxylic acid. The addition of carboxylic acid particularly enhances the dissolving property of the coating film during the alkali degreasing before the chemical conversion treatment. A presumable reason of the enhancement is that the applying and drying the aqueous solution containing organic acid such as carboxylic acid makes the coating film soluble, thus allows the coating film to be easily removed, or dissolved. Applicable carboxylic acid includes formic acid, acetic acid, lactic acid, oxalic acid, and citric acid. Specifically, oxycarboxylic acid (also called "oxyacid") particularly improves the dissolving property of the coating film. A presumable reason of the improvement is that the phosphoric acid ingredient and the metallic element ingredient are combined with the oxycarboxylic acid to form a glassy coating film which is readily dissolved. A presumable reason of easily dissolving coating film is that the presence of hydroxyl group in the oxycarboxylic acid enhances the hydrophilic property of the coating film, thus enhancing the penetration of alkali degreasing liquid into the coating film, which improves the film-removal performance, or which makes the coating film itself readily dissolve. Applicable oxycarboxylic acid includes tartaric acid, lactic acid, glyceric acid, malic acid, salicylic acid, and citric acid. As of these, citric acid is particularly effective.

According to the present invention, above-described specific metallic ion is added as the cationic ingredient to the aqueous solution for forming coating film. If, however, the metallic ion concentration in the aqueous solution increases to high pH exceeding 3, the aqueous solution may not exist in stable state. For the case of Fe ion, as an example, coexistence with phosphoric acid ion likely brings the aqueous solution to gelling. In that case, the gelling of aqueous solution can be prevented by adding a carboxylic acid to form a complex with the metallic ion. Examples of applicable carboxylic acid are formic acid, acetic acid, lactic acid, oxalic acid, tartaric acid, and citric acid.

Particularly for the aqueous solution containing Fe ion, the addition of citric acid is especially effective because the combination improves the stability of the aqueous solution to suppress the gelling of the aqueous solution.

Although there is no specific limit on the method to let that kind of carboxylic acid exist in the aqueous solution, generally it is preferable that carboxylic acid or a carboxylic acid salt of various kinds of metal is dissolved in the aqueous solution. In concrete terms, formic acid, acetic acid, lactic acid, oxalic acid, citric acid, tartaric acid, or iron salt such as iron citrate and ammonium iron citrate is dissolved in the aqueous solution.

Preferable concentration of carboxylic acid in the aqueous solution for forming coating film is 0.001 to 5 mole of carboxylic acid to 1 mole of phosphoric acid ingredient (converted to $P_2O_5$) in the aqueous solution. If the concentration of carboxylic acid is less than 0.001 mole, the effect is not satisfactory. If the concentration thereof exceeds 5 mole, the coating film becomes hygroscopic, and corrosion may occur. Particularly preferable range of the concentration of carboxylic acid is 0.01 to 1 mole to 1 mole of phosphoric acid ingredient (converted to $P_2O_5$), and most preferable range thereof is 0.05 to 0.5 mole.

Preferable concentration of cationic ingredient ($\alpha$), of phosphoric acid ion ($\beta$), and of silica ($\gamma$) is as follows. A preferable concentration range of cationic ingredient ($\alpha$) is 0.01 to 3 mol/l, and more preferable range thereof is 0.02 to 2 mol/l. Excessive concentration of cationic ingredient ($\alpha$) is not preferable because the thickness of coating film becomes irregular. A preferable concentration range of phosphoric acid ion ($\beta$) is 0.05 to 2 mol/l, and more preferable range thereof is 0.05 to 1 mol/l. Excessive concentration of phosphoric acid ingredient ($\beta$) is not preferable because the reactivity of aqueous solution increases. A preferable concentration range of silica ($\gamma$) is 0.0001 to 6 mol/l, and more preferable range thereof is 0.1 to 1.0 mol/l. Excessive concentration of silica ($\gamma$) is not preferable because the thickness of coating film becomes irregular.

A preferable range of coating weight (solid matter) of the coating film formed on the surface of plating layer according to the present invention is 5 to 300 mg/m$^2$ as the P amount, more preferably 10 to 150 mg/m$^2$, and most preferably 30 to 120 mg/m$^2$. If the coating weight thereof becomes less than the lower limit, the effect for improving the press-formability cannot fully be attained. If the coating weight thereof exceeds the upper limit, the chemical conversion treatment performance degrades.

The aqueous solution for forming coating film according to the present invention is generally prepared by dissolving the above-described additives in deionized water.

The zinc-base plated steel sheet being applied with the aqueous solution may be subjected to activation treatment or the like before receiving the application of aqueous solution. The activation treatment may be given by immersing the plated steel sheet in an alkaline aqueous solution or an acidic aqueous solution, or by spraying alkaline or acidic aqueous solution.

The method for applying aqueous solution for forming coating film onto the zinc-base plated steel sheet according to the present invention may be application method, immersion method, or spray method. As for the application method, arbitrary means may be adopted such as roll coater (3-roll type, 2-roll type, or the like), squeeze coater, die coater, and bar coater. The application treatment using squeeze coater or the like and the immersion treatment may be given after the spray treatment using air-knife method or roll-squeeze method to adjust the coating amount, to uniformize the appearance, and to uniformize the coating thickness.

After applying the aqueous solution, heating and drying treatment is given without washing by water. The heating and drying treatment may be conducted by dryer, hot air furnace, high frequency induction heating furnace, infrared ray furnace, and the like. A preferable range of ultimate sheet temperature in the heating treatment is 50° C. to 200° C., and more preferably 50° C. to 140° C. If the heating temperature is below 50° C., excessive amount of water is left in the coating film, which likely induces stain defects. If the heating temperature exceeds 140° C., the treatment becomes noneconomic. Furthermore, if the heating temperature exceeds 200° C., the coating film becomes brittle and highly separable.

Although no specific limit is given to the temperature of aqueous solution for forming coating film, a preferable range thereof is 20° C. to 70° C. If the temperature of aqueous solution is below 20° C., the stability of the aqueous solution degrades. If the temperature of aqueous solution exceeds 70° C., facility and energy to maintain the aqueous solution to a high temperature are required to increase the production cost, which is also noneconomic.

EXAMPLE 1

Example 1 used various kinds of zinc-base plated steel sheets given below.

(1) GA: An alloyed hot-dip galvanized steel sheet (10 mass % Fe and balance of Zn) having 45 g/m$^2$ of coating weight on each side thereof.

(2) GI: A hot-dip galvanized steel sheet having 90 g/m$^2$ of coating weight on each side thereof.

(3) EG: An electric zinc-plated steel sheet having 50 g/m$^2$ of coating weight on each side thereof.

(4) Zn—Fe: An electric Zn—Fe alloy plated steel sheet (15 mass % Fe and balance of Zn) having 40 g/m$^2$ of coating weight on each side thereof.

(5) Zn—Ni: An electric Zn—Ni alloy plated steel sheet (12 mass % Ni and balance of Zn) having 30 g/m$^2$ of coating weight on each side thereof.

(6) Zn—Al: An electric Zn—Al alloy plated steel sheet (5 mass % Al and balance of Zn) having 60 g/m$^2$ of coating weight on each side thereof.

The surface of plating layer on each of the zinc-base plated steel sheets was subjected to the treatment described below. The zinc-base plated steel sheet being treated was preliminarily treated by the solvent degreasing using toluene to remove press-oil from the surface thereof.

Respective treatment liquids were prepared to obtain the respective compositions given in Table 16 through Table 18, namely: an aqueous solution of phosphate prepared by mixing one or more of ① aqueous ammonia, ② ammonium primary phosphate (ammonium dihydrogenphosphate), ③ ammonium secondary phosphate (diammonium hydrogen phosphate), and ④ammonium tertiary phosphate (triammonium phosphate) with orthophosphoric acid, and further with, at need, oxide or hydroxide containing various cationic ingredients, at respective specified percentages in deionized water, or an aqueous solution of phosphate prepared by mixing above-given ingredients with metallic salt containing various cationic ingredients, and further with, at need, silica or water-soluble resin (water-soluble epoxy resin), at respective specified percentages.

The silica ingredient was prepared by adding "Snowtex N" (manufactured by Nissan Chemical Industries, Ltd.) to a specified molar concentration.

Each of the treatment liquids (at room temperature) given in Table 16 through Table 18 was applied onto the surface of the above-described zinc-base plated steel sheet using roll coater or bar coater, and was heated to dry to form a coating film. The coating weight of the formed film was adjusted depending on the concentration of the composition and the applying conditions (roll-pressing pressure, rotational speed, count of bar coater, and other variables).

The coating weight of the film was determined by the following-described procedure. For zinc-base plated steel sheets having different coating weight, the plating layer together with the coating film was dissolved to remove using dilute hydrochloric acid. The P concentration in the respective dissolved liquids was quantified by ICP analysis. Before conducting the above-given layer separation, the fluorescent X-ray intensity of P was determined at two positions in the central section of plated steel sheet being subjected to the above-described dissolving and separating treatment. The fluorescent X-ray intensity of P and the above-described P concentration obtained by ICP were compared to derive a correlation formula. Then, the fluorescent X-ray intensity of P on each specimen was determined. Thus observed value was entered to the correlation formula to obtain the coating weight on each specimen.

The amount of N ingredient (converted to ammonium) in the composite coating film was determined by the procedure given below. The composite coating film was dissolved together with the plating layer in aqueous hydrochloric acid. The ammonium in the dissolved solution was isolated by distillation, which was then absorbed by an aqueous alkali solution. The concentration of ammonium in the solution was quantified by the indophenol blue absorptiometry to determine the amount of $NH_4$ in the coating film. The obtained value was converted to the molar concentration of N. The amount of metallic elements and the amount of P ingredient (converted to $P_2O_5$) in the composite coating film were determined by the procedure given below. The composite coating film formed on the zinc-base plated steel sheet was dissolved together with the plating layer in dilute hydrochloric acid. The dissolved film-structuring elements were quantified. On the other hand, the plating layer on the zinc-base plated steel sheet before forming the composite coating film was dissolved in dilute hydrochloric acid, and the film-structuring elements were also quantified. The amount of the latter metallic elements was subtracted from the amount of former metallic elements obtained by dissolving the composite coating film together with the plating layer. The resulted value was the amount of elements structuring the coating film. The target area for the quantification was 0.06 m$^2$. The amount of organic resin ingredient in the composite coating film was determined by quantifying the dissolved liquid prepared by dissolving the coating film ingredients using an acid, applying colorimetric method.

The performance evaluation on thus prepared zinc-base plated steel sheets was given as follows.

(1) Press-Formability

To evaluate the press-formability, friction factor of each specimen was determined using a friction tester shown in FIG. 1.

The tests were conducted by applying lubricant "KNOX-RUST 550HN" (manufactured by PARKER INDUSTRIES, INC.) onto the surface of sample 1. The friction factor $\mu$ between the sample and the bead 6 was derived by the formula:$\mu$=F/N. The pressing load N was 400 kgf, and the draw-out speed of sample (horizontal moving speed of the slide table 3) was 100 cm/min.

FIG. 2 shows a perspective view of applied bead, giving the shape and the dimensions thereof.

(2) Chemical Conversion Treatment Performance

[Evaluation 1]

Assuming the condition of sample after press-formed, the lubricant ("NOX-RUST 550HN" (manufactured by PARKER INDUSTRIES, INC.)) was applied to each specimen. After that, the chemical conversion treatment was applied onto the specimen following the steps of [(degreasing under the condition ① given below)→washing with water→drying→surface preparation under the condition ② given below→chemical conversion treatment under the condition ③ or ③' given below →washing with water→drying].

① Degreasing: "FC-4460" (manufactured by Nippon Parkerizing Co., Ltd.) Spray time: 60 seconds (spray pressure: 1 kg/cm$^2$), degreasing liquid temperature: 43° C.

② Surface preparation: "PL-Z" (manufactured by Nippon Parkerizing Co., Ltd.) Liquid concentration: 1.5 g/l, immersion time: 20 seconds, treatment liquid temperature: room temperature.

③ Chemical conversion treatment: "PB-3030" manufactured by Nippon Parkerizing Co., Ltd.) Immersion time: 120 seconds, treatment liquid temperature: 52° C.

③ Chemical conversion treatment: "PB-3020" (fluorine-laid system) (manufactured by Nippon Parkerizing Co., Ltd.) Immersion time: 120 seconds, treatment liquid temperature: 43° C.

The above-given chemical conversion treatments were given, to the respective specimens. After the chemical conversion treatments, the configuration of phosphate crystals was observed by SEM, and the evaluation was given on the criteria given below.

◎: Mean size of phosphate crystals is less than 8 μm, and the coating film is dense without lack of hiding.

○: Mean size of phosphate crystals is not less than 8 μm and less than 12 μm, and the coating film is dense without lack of hiding.

○-: Mean size of phosphate crystals is not less than 12 im, and no lack of hiding is observed.

Δ: Mean size of phosphate crystals is less than 12 μm, and the coating film has both the portions of dense without lack of hiding and the portions of not forming phosphate crystals.

X: Mean size of phosphate crystals become coarse (giving 12 im or larger crystal sizes) and significant lack of hiding is observed, or phosphate crystals are not grown at all.

[Evaluation 2]

To conduct severer evaluation of chemical conversion treatment performance, a state of insufficient film-removing action during the degreasing step owing to the poor degreasing spray was assumed. The chemical conversion treatment without applying the "degreasing step" in the chemical treatment performance test in the above [Evaluation 1] was carried out. That is, the chemical conversion treatment was conducted by the steps of [(surface preparation under the condition ② given above→chemical conversion treatment under the condition ③' given above→washing with water→drying], without applying the above-given degreasing step ①. The chemical conversion treatment performance test did not give applying press-oil, which was given in the chemical conversion treatment test of [Evaluation 1]. The chemical conversion treatment liquid was PB-3080 (manufactured by Nippon Parkerizing Co., Ltd.)

After conducted the above-given chemical conversion treatment, the configuration of phosphate crystals was observed by SEM, and the evaluation was given on the criteria given below.

◎: Mean size of phosphate crystals is not less than 8 μm and less than 12 μm, and the coating film is dense without lack of hiding.

○: Mean size of phosphate crystals is not less than 12 μm, and no lack of hiding is observed.

○-: The coating film has both the portions of formed phosphate crystals and the portions of not forming phosphate crystals.

Δ: Phosphate crystals are not grown in almost all the domains, but fine crystals are observed in some domains.

X: No phosphate crystals are grown.

Table 19 through Table 27 show the treatment conditions of respective specimens and the results of above-described performance evaluation. The samples No. 11 and No. 53 had the concentration ratio of ammonium ion to phosphoric acid ion in the treatment liquid lower than the range specified by the present invention, giving excessive amount of phosphoric acid ion, thus the friction factor was large and the chemical conversion treatment performance was poor. The samples No. 12 and No. 54 had high cation concentration in the treatment liquid, thus the coating film became non-uniform, giving poor appearance. The samples No. 29 and No. 71 contained Zn as the cationic ingredient in the treatment liquid, thus the amount of crystalline ingredient increased and the friction factor was high. Furthermore, although the samples No. 29 and No. 71 showed favorable chemical conversion treatment performance in PB-3030 which is a fluorine-base chemical conversion treatment system having high etchability, they showed poor chemical conversion treatment performance in other chemical conversion treatment liquids.

The samples No. 30 and No. 72 contained alkali metal in the cationic ingredient in the treatment liquid, thus the coating film became non-uniform and the film-thickness became irregular, which resulted in high friction factor. Furthermore, although these samples showed favorable chemical conversion treatment performance in PB-3030 which is a fluorine-base chemical conversion treatment system having high etchability, they showed poor chemical conversion treatment performance in other chemical conversion treatment liquids.

The samples No. 37, No. 38, No. 39, No. 79, No. 80, and No. 81 contained no ammonium ion in the treatment liquid, thus the friction factor became high, and the chemical conversion treatment performance was poor.

The samples No. 94, No. 95, and No. 96 had no coating film on the surface of plating layer so that the friction factor became high, though the chemical conversion treatment performance was favorable.

Compared with those Comparative Examples, Examples according to the present invention are superior in chemical conversion treatment performance, or are superior in press-formability, and give less degradation in chemical conversion treatment performance even the treatment is given under different chemical conversion treatment conditions, thus providing both the press-formability and the chemical conversion treatment performance.

TABLE 16

| No. | Cationic ingredient (α) $NH_4^+$ concentration (mol/l) | Other cation Kind | Other cation Concentration (mol/l) | Total cation concentration (mol/l) | Concentration of phosphoric acid ion (β) [as $P_2O_5$] (mol/l) | Molar ratio of [cation (α)]/[phosphoric acid ion (β)] | Classification |
|---|---|---|---|---|---|---|---|
| 1 | 0.22 | — | — | 0.22 | 0.11 | 2.0 | Example |
| 2 | 0.46 | — | — | 0.46 | 0.23 | 2.0 | Example |
| 3 | 0.90 | — | — | 0.90 | 0.45 | 2.0 | Example |
| 4 | 0.42 | — | — | 0.42 | 0.11 | 3.8 | Example |
| 5 | 0.92 | — | — | 0.92 | 0.23 | 4.0 | Example |
| 6 | 1.78 | — | — | 1.78 | 0.45 | 4.0 | Example |
| 7 | 0.63 | — | — | 0.63 | 0.11 | 5.7 | Example |
| 8 | 1.38 | — | — | 1.38 | 0.23 | 6.0 | Example |
| 9 | 2.67 | — | — | 2.67 | 0.45 | 5.9 | Example |
| 10 | 0.20 | — | — | 0.20 | 1.00 | 0.4 | Example |
| 11 | 0.20 | — | — | 0.20 | 1.50 | 0.1 | Comparative Example |
| 12 | 1.20 | — | — | 1.20 | 0.18 | 6.7 | Comparative Example |
| 13 | 0.40 | Al | 0.09 | 0.49 | 0.81 | 0.6 | Example |
| 14 | 0.40 | Al | 0.02 | 0.42 | 0.24 | 1.8 | Example |
| 15 | 0.40 | Al | 0.10 | 0.50 | 0.35 | 1.4 | Example |
| 16 | 0.40 | Fe | 0.07 | 0.47 | 0.32 | 1.5 | Example |
| 17 | 0.40 | Fe | 0.10 | 0.50 | 0.37 | 1.4 | Example |
| 18 | 0.40 | Co | 0.10 | 0.50 | 0.37 | 1.4 | Example |
| 19 | 0.40 | Co | 0.06 | 0.46 | 0.28 | 1.7 | Example |
| 20 | 0.40 | Mg | 0.07 | 0.47 | 0.27 | 1.7 | Example |

TABLE 17

| No. | Cationic ingredient (α) $NH_4^+$ concentration (mol/l) | Other cation Kind | Other cation Concentration (mol/l) | Total cation concentration (mol/l) | Concentration of phosphoric acid ion (β) [as $P_2O_5$] (mol/l) | Molar ratio of [cation (α)]/[phosphoric acid ion (β)] | Concentration of silica (γ) [as $SiO_2$] (mol/l) | Molar ratio of [silica (γ)]/[phosphoric acid ion (β)] | Classification |
|---|---|---|---|---|---|---|---|---|---|
| 21 | 0.40 | Mg | 0.13 | 0.53 | 0.26 | 2.0 | — | — | Example |
| 22 | 0.40 | Mg | 0.27 | 0.67 | 0.40 | 1.7 | — | — | Example |
| 23 | 0.40 | Ca | 0.10 | 0.50 | 2.13 | 0.4 | — | — | Example |
| 24 | 0.40 | Ti | 0.10 | 0.50 | 0.23 | 2.1 | — | — | Example |
| 25 | 0.40 | Mn | 0.07 | 0.47 | 0.22 | 2.1 | — | — | Example |
| 26 | 0.40 | Cu | 0.02 | 0.42 | 0.16 | 2.7 | — | — | Example |
| 27 | 0.40 | Mo | 0.04 | 0.44 | 0.18 | 2.4 | — | — | Example |
| 28 | 0.40 | Mo, Mg | Mo: 0.04, Mg: 0.01 | 0.45 | 0.20 | 2.3 | — | — | Example |
| 29 | 0.40 | Zn | 0.10 | 0.50 | 0.30 | 1.7 | — | — | Comparative Example |
| 30 | 0.40 | Na | 0.10 | 0.50 | 0.18 | 2.7 | — | — | Comparative Example |
| 31 | 0.22 | — | — | 0.22 | 0.11 | 2.0 | 0.1 | 0.9 | Example |
| 32 | 0.22 | — | — | 0.22 | 0.11 | 2.0 | 1.0 | 9.1 | Example |
| 33 | 0.22 | — | — | 0.22 | 0.11 | 2.0 | 0.0002 | 0.002 | Example |
| 34 | 0.22 | — | — | 0.22 | 0.11 | 2.0 | 6 | 54.5 | Example |
| 35 | 0.40 | Al | 0.09 | 0.49 | 0.81 | 0.6 | 0.2 | 0.2 | Example |
| 36 | 0.40 | Al | 0.90 | 0.49 | 0.81 | 0.6 | 0.5 | 0.6 | Example |
| 37 | 0 | Na | 0.30 | 0.30 | 0.15 | 2.0 | — | — | Comparative Example |
| 38 | 0 | Mn | 0.50 | 0.50 | 0.83 | 0.6 | — | — | Comparative Example |
| 39 | 0 | Zn | 0.40 | 0.40 | 0.80 | 0.5 | — | — | Comparative Example |

TABLE 18

| No. | Cationic ingredient (α) $NH_4^+$ concentration (mol/l) | Other cation Kind | Other cation Concentration (mol/l) | Total cation concentration (mol/l) | Concentration of phosphoric acid ion (β) [as $P_2O_5$] (mol/l) | Molar ratio of [cation (α)]/[phosphoric acid ion (β)] | Organic resin ingredient [percentage of solid matter in aqueous solution] (mass %) | Classification |
|---|---|---|---|---|---|---|---|---|
| 40 | 0.08 | — | — | 0.08 | 0.04 | 2.0 | — | Example |
| 41 | 0.04 | — | — | 0.04 | 0.02 | 2.0 | — | Example |
| 42 | 0.046 | — | — | 0.046 | 0.023 | 2.0 | — | Example |
| 43 | 0.039 | — | — | 0.039 | 0.018 | 2.2 | — | Example |
| 44 | 0.092 | — | — | 0.092 | 0.046 | 2.0 | — | Example |
| 45 | 0.14 | — | — | 0.14 | 0.07 | 2.0 | — | Example |
| 46 | 0.156 | — | — | 0.156 | 0.075 | 2.1 | — | Example |
| 47 | 0.22 | — | — | 0.22 | 0.11 | 2.0 | 2 | Example |
| 48 | 2.67 | — | — | 2.67 | 0.45 | 5.9 | 10 | Example |
| 49 | 0.04 | — | — | 0.04 | 0.20 | 0.2 | — | Example |

TABLE 19

| No. | Base sheet being treated *1 | Treatment liquid *2 | Drying temp. (° C.) *3 | Molar ratio of ingredients in coating film *5 | Coating weight ($mg/m^2$) *4 | Press-formability (friction factor) | Chemical conversion treatment performance (Evaluation 1) PB 3030 | Chemical conversion treatment performance (Evaluation 1) PB 3020 | Chemical conversion treatment performance (Evaluation 2) | Classification | |
|---|---|---|---|---|---|---|---|---|---|---|---|
| 1 | GI | 1 | 80 | 2.0 | 21 | 0.170 | ○ | ○ | ○ | Example | |
| 2 | GI | 2 | 80 | 2.0 | 54 | 0.162 | ○ | ○ | ○ | Example | |
| 3 | GI | 3 | 80 | 2.0 | 105 | 0.155 | ○ | ○ | ○− | Example | |
| 4 | GI | 4 | 80 | 3.8 | 25 | 0.172 | ○ | ○ | ○ | Example | |
| 5 | GI | 5 | 80 | 4.0 | 60 | 0.165 | ○ | ○ | ○ | Example | |
| 6 | GI | 6 | 80 | 4.0 | 120 | 0.154 | ○ | ○ | ○− | Example | |
| 7 | GI | 7 | 80 | 5.7 | 32 | 0.177 | ○ | ○ | ○ | Example | |
| 8 | GI | 8 | 80 | 6.0 | 67 | 0.166 | ○− | ○ | ○ | Example | |
| 9 | GI | 9 | 80 | 5.9 | 140 | 0.155 | ○− | ○ | ○− | Example | |
| 10 | GI | 10 | 80 | 0.4 | 300 | 0.206 | ○ | ○ | ○− | Example | |
| 11 | GI | 11 | 80 | 0.1 | 450 | 0.343 | X | X | X | Comparative Example | |
| 12 | GI | 12 | 80 | 6.7 | 52 | 0.221 | ○ | ○ | ○ | Comparative Example | ※ |

*1 GI: Hot-dip galvanized steel sheet GA: Alloyed hot-dip galvanized steel sheet
*2 Treatment liquid No. given in Tables 16 through 18
*3 Ultimate sheet temperature
*4 P coating weight
*5 Molar ratio of the amount of N ingredient (a) or the sum of the amount of N ingredient and amount of metallic elements (one or more of Mg, Al, Ca, Ti, Mn, Fe, Co. Ni, Cu, and Mo) (a') in coating film to the amount of P ingredient (b) in coating film, (the amount of N ingredient is expressed by ammonium conversion value, and the amount of P ingredient is expressed by $P_2O_5$ conversion value)
※ Poor in appearance

TABLE 20

| No. | Base sheet being treated *1 | Treatment liquid *2 | Drying temp. (° C.) *3 | Molar ratio of ingredients in coating film *5 | Coating weight ($mg/m^2$) *4 | Press-formability (friction factor) | Chemical conversion treatment performance (Evaluation 1) PB 3030 | Chemical conversion treatment performance (Evaluation 1) PB 3020 | Chemical conversion treatment performance (Evaluation 2) | Classification |
|---|---|---|---|---|---|---|---|---|---|---|
| 13 | GI | 13 | 80 | 0.6 | 290 | 0.202 | ○ | ◎ | ○− | Example |
| 14 | GI | 14 | 80 | 1.8 | 95 | 0.152 | ◎ | ◎ | ◎ | Example |
| 15 | GI | 15 | 80 | 1.4 | 110 | 0.166 | ◎ | ◎ | ○ | Example |
| 16 | GI | 16 | 80 | 1.5 | 52 | 0.156 | ◎ | ◎ | ◎ | Example |

TABLE 20-continued

| No. | Base sheet being treated *1 | Treatment liquid *2 | Drying temp. (° C.) *3 | Molar ratio of ingredients in coating film *5 | Coating weight ($mg/m^2$) *4 | Press-formability (friction factor) | Chemical conversion treatment performance (Evaluation 1) PB 3030 | PB 3020 | Chemical conversion treatment performance (Evaluation 2) | Classification |
|---|---|---|---|---|---|---|---|---|---|---|
| 17 | GI | 17 | 80 | 1.4 | 45 | 0.157 | ◎ | ◎ | ◎ | Example |
| 18 | GI | 18 | 80 | 1.4 | 72 | 0.155 | ◎ | ◎ | ◎ | Example |
| 19 | GI | 19 | 80 | 1.7 | 52 | 0.162 | ◎ | ◎ | ◎ | Example |
| 20 | GI | 20 | 80 | 1.7 | 52 | 0.155 | ○ | ◎ | ○ | Example |
| 21 | GI | 21 | 80 | 2.0 | 65 | 0.156 | ○ | ◎ | ○ | Example |
| 22 | GI | 22 | 80 | 1.7 | 72 | 0.156 | ○ | ◎ | ○ | Example |
| 23 | GI | 23 | 80 | 0.4 | 440 | 0.210 | ○− | ○− | ○− | Example |
| 24 | GI | 24 | 80 | 2.1 | 60 | 0.166 | ○ | ◎ | ○ | Example |

*1 GI: Hot-dip galvanized steel sheet GA: Alloyed hot-dip galvanized steel sheet
*2 Treatment liquid No. given in Tables 16 through 18
*3 Ultimate sheet temperature
*4 P Coating weight
*5 Molar ratio of the amount of N ingredient (a) or the sum of the amount of N ingredient and amount of metallic elements (one or more of Mg, Al, Ca, Ti, Mn, Fe, Co, Ni, Cu, and Mo) (a') in coating film to the amount of P ingredient (b) in coating film, (the amount of N ingredient is expressed by ammonium conversion value, and the amount of P ingredient is expressed by $P_2O_5$ conversion value)

TABLE 21

| No. | Base sheet being treated *1 | Treatment liquid *2 | Drying temp. (° C.) *3 | Molar ratio of ingredients in coating film *5 | Coating weight ($mg/m^2$) *4 | Press-formability (friction factor) | Chemical conversion treatment performance (Evaluation 1) PB 3030 | PB 3020 | Chemical conversion treatment performance (Evaluation 2) | Classification |
|---|---|---|---|---|---|---|---|---|---|---|
| 25 | GI | 25 | 80 | 2.0 | 55 | 0.156 | ○ | ◎ | ○ | Example |
| 26 | GI | 26 | 80 | 2.7 | 30 | 0.155 | ○ | ◎ | ○ | Example |
| 27 | GI | 27 | 80 | 2.4 | 45 | 0.157 | ○ | ◎ | ○ | Example |
| 28 | GI | 28 | 80 | 2.3 | 52 | 0.158 | ○ | ◎ | ○ | Example |
| 29 | GI | 29 | 80 | 1.7 | 60 | 0.270 | Δ | ○ | ○ | Comparative Example |
| 30 | GI | 30 | 80 | 2.7 | 36 | 0.251 | Δ | ○ | ○ | Comparative Example |
| 31 | GI | 31 | 80 | 2.0 | 26 | 0.156 | ◎ | ◎ | ◎ | Example |
| 32 | GI | 32 | 80 | 2.0 | 28 | 0.155 | ◎ | ◎ | ◎ | Example |
| 33 | GI | 33 | 80 | 2.0 | 25 | 0.169 | ◎ | ◎ | ◎ | Example |
| 34 | GI | 34 | 80 | 2.0 | 22 | 0.225 | ○ | ○ | ○ | Example |
| 35 | GI | 35 | 80 | 0.6 | 220 | 0.155 | ◎ | ◎ | ○− | Example |
| 36 | GI | 36 | 80 | 0.6 | 210 | 0.165 | ◎ | ◎ | ○− | Example |

*1 GI: Hot-dip galvanized steel sheet GA: Alloyed hot-dip galvanized steel sheet
*2 Treatment liquid No. given in Tables 16 through 18
*3 Ultimate sheet temperature
*4 P coating weight
*5 Molar ratio of the amount of N ingredient (a) or the sum of the amount of N ingredient and amount of metallic elements (one or more of Mg, Al, Ca, Ti, Mn, Fe, Co, Ni, Cu, and Mo) (a') in coating film to the amount of P ingredient (b) in coating film, (the amount of N ingredient is expressed by ammonium conversion value, and the amount of P ingredient is expressed by $P_2O_5$ conversion value)

TABLE 22

| No. | Base sheet being treated *1 | Treatment liquid *2 | Drying temp. (° C.) *3 | Molar ratio of ingredients in coating film *5 | Coating weight (mg/m$^2$) *4 | Press-formability (friction factor) | Chemical conversion treatment performance (Evaluation 1) PB 3030 | PB 3020 | Chemical conversion treatment performance (Evaluation 2) | Classification |
|---|---|---|---|---|---|---|---|---|---|---|
| 37 | GI | 37 | 80 | 2.0 | 40 | 0.221 | Δ | Δ | X | Comparative Example |
| 38 | GI | 38 | 80 | 0.6 | 195 | 0.201 | X | Δ | X | Comparative Example |
| 39 | GI | 39 | 80 | 0.5 | 230 | 0.301 | X | Δ | X | Comparative Example |
| 40 | GI | 1 | 120 | 0.5 | 25 | 0.165 | ○ | ○ | ○ | Example |
| 41 | GI | 2 | 120 | 0.5 | 56 | 0.159 | ○ | ○ | ○ | Example |
| 42 | GI | 3 | 120 | 0.5 | 105 | 0.155 | ○ | ○ | ○− | Example |
| 43 | GA | 1 | 80 | 2.0 | 21 | 0.172 | ○ | ○ | ○ | Example |
| 44 | GA | 2 | 80 | 2.0 | 55 | 0.155 | ○ | ○ | ○ | Example |
| 45 | GA | 3 | 80 | 2.0 | 110 | 0.155 | ○ | ○ | ○− | Example |
| 46 | GA | 4 | 80 | 3.8 | 28 | 0.172 | ○ | ○ | ○ | Example |
| 47 | GA | 5 | 80 | 4.0 | 62 | 0.155 | ○ | ○ | ○ | Example |
| 48 | GA | 6 | 80 | 4.0 | 125 | 0.154 | ○ | ○ | ○− | Example |

*1 GI: Hot-dip galvanized steel sheet GA: Alloyed hot-dip galvanized steel sheet
*2 Treatment liquid No. given in Tables 16 through 18
*3 Ultimate sheet temperature
*4 P coating weight
*5 Molar ratio of the amount of N ingredient (a) or the sum of the amount of N ingredient and amount of metallic elements (one or more of Mg, Al, Ca, Ti, Mn, Fe, Co, Ni, Cu, and Mo) (a') in coating film to the amount of P ingredient (b) in coating film, (the amount of N ingredient is expressed by ammonium conversion value, and the amount of P ingredient is expressed by $P_2O_5$ conversion value)

TABLE 23

| No. | Base sheet being treated *1 | Treatment liquid *2 | Drying temp. (° C.) *3 | Molar ratio of ingredients in coating film *5 | Coating weight (mg/m$^2$) *4 | Press-formability (friction factor) | Chemical conversion treatment performance (Evaluation 1) PB 3030 | PB 3020 | Chemical conversion treatment performance (Evaluation 2) | Classification | |
|---|---|---|---|---|---|---|---|---|---|---|---|
| 49 | GA | 7 | 80 | 5.7 | 33 | 0.175 | ○ | ○ | ○ | Example | |
| 50 | GA | 8 | 80 | 6.0 | 65 | 0.161 | ○− | ○ | ○− | Example | |
| 51 | GA | 9 | 80 | 5.9 | 140 | 0.155 | ○− | ○ | ○ | Example | |
| 52 | GA | 10 | 80 | 0.4 | 302 | 0.201 | ○ | ○ | ○ | Example | |
| 53 | GA | 11 | 80 | 0.1 | 450 | 0.343 | X | X | X | Comparative Example | |
| 54 | GA | 12 | 80 | 6.7 | 52 | 0.221 | ○ | ○ | ○ | Comparative Example | ※ |
| 55 | GA | 13 | 80 | 0.6 | 290 | 0.222 | ○ | ◎ | ○− | Example | |
| 56 | GA | 14 | 80 | 1.8 | 98 | 0.155 | ◎ | ◎ | ○ | Example | |
| 57 | GA | 15 | 80 | 1.4 | 120 | 0.165 | ◎ | ◎ | ○− | Example | |
| 58 | GA | 16 | 80 | 1.5 | 55 | 0.156 | ◎ | ◎ | ◎ | Example | |
| 59 | GA | 17 | 80 | 1.4 | 48 | 0.157 | ◎ | ◎ | ◎ | Example | |
| 60 | GA | 18 | 80 | 1.4 | 79 | 0.155 | ◎ | ◎ | ◎ | Example | |

*1 GI: Hot-dip galvanized steel sheet GA: Alloyed hot-dip galvanized steel sheet
*2 Treatment liquid No. given in Tables 16 through 18
*3 Ultimate sheet temperature
*4 P coating weight
*5 Molar ratio of the amount of N ingredient (a) or the sum of the amount of N ingredient and amount of metallic elements (one or more of Mg, Al, Ca, Ti, Mn, Fe, Co, Ni, Cu, and Mo) (a') in coating film to the amount of P ingredient (b) in coating film, (the amount of N ingredient is expressed by ammonium conversion value, and the amount of P ingredient is expressed by $P_2O_5$ conversion value)
※ Poor in appearance

TABLE 24

| No. | Base sheet being treated *1 | Treatment liquid *2 | Drying temp. (° C.) *3 | Molar ratio of ingredients in coating film *5 | Coating weight ($mg/m^2$) *4 | Press-formability (friction factor) | Chemical conversion treatment performance (Evaluation 1) PB 3030 | PB 3020 | Chemical conversion treatment performance (Evaluation 2) | Classification |
|---|---|---|---|---|---|---|---|---|---|---|
| 61 | GA | 19 | 80 | 1.7 | 50 | 0.162 | ◎ | ◎ | ◎ | Example |
| 62 | GA | 20 | 80 | 1.7 | 56 | 0.155 | ○ | ◎ | ◎ | Example |
| 63 | GA | 21 | 80 | 2.0 | 62 | 0.156 | ○ | ◎ | ◎ | Example |
| 64 | GA | 22 | 80 | 1.7 | 70 | 0.156 | ○ | ◎ | ◎ | Example |
| 65 | GA | 23 | 80 | 0.4 | 420 | 0.221 | ○− | ○ | ○− | Example |
| 66 | GA | 24 | 80 | 2.1 | 62 | 0.166 | ○ | ◎ | ○ | Example |
| 67 | GA | 25 | 80 | 2.1 | 56 | 0.156 | ○ | ◎ | ○ | Example |
| 68 | GA | 26 | 80 | 2.7 | 32 | 0.155 | ○ | ◎ | ○ | Example |
| 69 | GA | 27 | 80 | 2.4 | 48 | 0.157 | ○ | ◎ | ○ | Example |
| 70 | GA | 28 | 80 | 2.3 | 55 | 0.158 | ○ | ◎ | ○ | Example |
| 71 | GA | 29 | 80 | 1.7 | 65 | 0.262 | Δ | ○ | Δ | Comparative Example |
| 72 | GA | 30 | 80 | 2.7 | 37 | 0.252 | Δ | ○ | Δ | Comparative Example |

*1 GI: Hot-dip galvanized steel sheet GA: Alloyed hot-dip galvanized steel sheet
*2 Treatment liquid No. given in Tables 16 through 18
*3 Ultimate sheet temperature
*4 P coating weight
*5 Molar ratio of the amount of N ingredient (a) or the sum of the amount of N ingredient and amount of metallic elements (one or more of Mg, Al, Ca, Ti, Mn, Fe, Co, Ni, Cu, and Mo) (a') in coating film to the amount of P ingredient (b) in coating film, (the amount of N ingredient is expressed by ammonium conversion value, and the amount of P ingredient is expressed by $P_2O_5$ conversion value)

TABLE 25

| No. | Base sheet being treated *1 | Treatment liquid *2 | Drying temp. (° C.) *3 | Molar ratio of ingredients in coating film *5 | Coating weight ($mg/m^2$) *4 | Press-formability (friction factor) | Chemical conversion treatment performance (Evaluation 1) PB 3030 | PB 3020 | Chemical conversion treatment performance (Evaluation 2) | Classification |
|---|---|---|---|---|---|---|---|---|---|---|
| 73 | GA | 31 | 80 | 2.0 | 28 | 0.155 | ◎ | ◎ | ◎ | Example |
| 74 | GA | 32 | 80 | 2.0 | 30 | 0.156 | ◎ | ◎ | ◎ | Example |
| 75 | GA | 33 | 80 | 2.0 | 28 | 0.168 | ◎ | ◎ | ◎ | Example |
| 76 | GA | 34 | 80 | 2.0 | 25 | 0.225 | ○ | ○ | ○ | Example |
| 77 | GA | 35 | 80 | 0.6 | 210 | 0.156 | ◎ | ◎ | ○− | Example |
| 78 | GA | 36 | 80 | 0.6 | 220 | 0.169 | ◎ | ◎ | ○− | Example |
| 79 | GA | 37 | 80 | 2.0 | 42 | 0.231 | Δ | Δ | X | Comparative Example |
| 80 | GA | 38 | 80 | 0.6 | 199 | 0.225 | X | Δ | X | Comparative Example |
| 81 | GA | 39 | 80 | 0.5 | 235 | 0.307 | X | Δ | X | Comparative Example |
| 82 | GA | 1 | 120 | 0.5 | 29 | 0.163 | ○ | ○ | ○ | Example |
| 83 | GA | 2 | 120 | 0.4 | 58 | 0.158 | ○ | ○ | ○ | Example |
| 84 | GA | 3 | 120 | 0.4 | 110 | 0.156 | ○ | ○ | ○− | Example |

*1 GI: Hot-dip galvanized steel sheet GA: Alloyed hot-dip galvanized steel sheet
*2 Treatment liquid No. given in Tables 16 through 18
*3 Ultimate sheet temperature
*4 P coating weight
*5 Molar ratio of the amount of N ingredient (a) or the sum of the amount of N ingredient and amount of metallic elements (one or more of Mg, Al, Ca, Ti, Mn, Fe, Co, Ni, Cu, and Mo) (a') in coating film to the amount of P ingredient (b) in coating film, (the amount of N ingredient is expressed by ammonium conversion value, and the amount of P ingredient is expressed by $P_2O_5$ conversion value)

TABLE 26

| No. | Base sheet being treated *1 | Treatment liquid *2 | Drying temp. (° C.) *3 | Molar ratio of ingredients in coating film *5 | Coating weight (mg/m$^2$) *4 | Press-formability (friction factor) | Chemical conversion treatment performance (Evaluation 1) PB 3030 | PB 3020 | Chemical conversion treatment performance (Evaluation 2) | Classification |
|---|---|---|---|---|---|---|---|---|---|---|
| 85 | EG | 1 | 80 | 2.0 | 28 | 0.190 | ○ | ○ | ○ | Example |
| 86 | EG | 2 | 80 | 2.0 | 58 | 0.168 | ○ | ○ | ○ | Example |
| 87 | EG | 3 | 80 | 2.0 | 110 | 0.165 | ○ | ○ | ○– | Example |
| 88 | EG | 13 | 80 | 0.6 | 295 | 0.203 | ○ | ◎ | ○– | Example |
| 89 | EG | 14 | 80 | 1.8 | 98 | 0.158 | ◎ | ◎ | ○– | Example |
| 90 | EG | 15 | 80 | 1.4 | 120 | 0.168 | ◎ | ◎ | ○– | Example |
| 91 | Zn—Fe | 13 | 80 | 0.6 | 250 | 0.168 | ○ | ◎ | ○– | Example |
| 92 | Zn—Ni | 13 | 80 | 0.6 | 301 | 0.155 | ○ | ◎ | ○– | Example |
| 93 | Zn—Al | 13 | 80 | 0.6 | 280 | 0.221 | ○ | ◎ | ○– | Example |
| 94 | GA | | (not treated) | | | 0.252 | ○ | ○ | ○– | Comparative Example |
| 95 | GI | | (not treated) | | | 0.276 | ○ | ○ | ○ | Comparative Example |
| 96 | EG | | (not treated) | | | 0.300 | ◎ | ◎ | ○ | Comparative Example |

*1 GI: Hot-dip galvanized steel sheet GA: Alloyed hot-dip galvanized steel sheet
*2 Treatment liquid No. given in Tables 16 through 18
*3 Ultimate sheet temperature
*4 P coating weight
*5 Molar ratio of the amount of N ingredient (a) or the sum of the amount of N ingredient and amount of metallic elements (one or more of Mg, Al, Ca, Ti, Mn, Fe, Co, Ni, Cu, and Mo) (a') in coating film to the amount of P ingredient (b) in coating film, (the amount of N ingredient is expressed by ammonium conversion value, and the amount of P ingredient is expressed by $P_2O_5$ conversion value)

TABLE 27

| No. | Base sheet being treated *1 | Treatment liquid *2 | Drying temp. (° C.) *3 | Molar ratio of ingredients in coating film *5 | Coating weight (mg/m$^2$) *4 | Amount of resin in coating film (mg/m$^2$) | Press-formability (friction factor) | Chemical conversion treatment performance (Evaluation 1) PB 3030 | PB 3020 | Chemical conversion treatment performance (Evaluation 2) | Classification |
|---|---|---|---|---|---|---|---|---|---|---|---|
| 97 | GI | 40 | 80 | 2.0 | 10 | — | 0.181 | ○ | ○ | ○ | Example |
| 98 | GI | 41 | 80 | 2.0 | 5 | — | 0.21 | ○ | ○ | ○ | Example |
| 99 | GI | 42 | 80 | 2.0 | 7 | — | 0.191 | ○ | ○ | ○ | Example |
| 100 | GI | 43 | 80 | 2.2 | 4 | — | 0.22 | ○ | ○ | ○ | Example |
| 101 | GI | 44 | 80 | 2.0 | 12 | — | 0.175 | ○ | ○ | ○ | Example |
| 102 | GI | 45 | 80 | 2.0 | 15 | — | 0.17 | ○ | ○ | ○ | Example |
| 103 | GI | 46 | 80 | 2.1 | 20 | — | 0.165 | ○ | ○ | ○ | Example |
| 104 | GI | 47 | 80 | 2.0 | 31 | 200 | 0.145 | ○ | ○ | ○ | Example. |
| 105 | GI | 48 | 80 | 5.9 | 120 | 950 | 0.144 | ○ | ○ | ○– | Example |
| 106 | GI | 49 | 140 | 0.01 | 120 | — | 0.154 | ○ | ○ | ○– | Example |

EXAMPLE 2

Example 2 used zinc-base plated steel sheets given below.

(1) GA: An alloyed hot-dip galvanized steel sheet (10 mass % Fe and balance of Zn) having 45 g/m$^2$ of coating weight on each side thereof.

(2) GI: A hot-dip galvanized steel sheet having 90 g/m$^2$ of coating weight on each side thereof.

The surface of plating layer on each of the zinc-base plated steel sheets was subjected to the treatment described below. The zinc-base plated steel sheet being treated was preliminarily treated by the alkali degreasing to remove press-oil from the surface thereof.

As of the aqueous solutions for forming coating film, the ones which contained Fe ion as the metallic ion were prepared by dissolving iron citrate and ammonium primary phosphate in deionized water to a specified concentration thereof. Also there were used aqueous solutions prepared to have the respective compositions given in Table 13 by adding ion(II)sulfate and orthophosphoric acid in deionized water, followed by adding sulfuric ion-laid iron(II) phosphate and citric acid thereto to a specific concentration the reach.

Each of the treatment liquids (at room temperature) given in Table 28 was applied onto the surface of the above-described zinc-base plated steel sheet using roll coater or bar coater, and was heated to dry to form a coating film. The coating weight of the formed film was adjusted depending on the concentration of the composition and the applying conditions (roll-pressing pressure, rotational speed, count of bar coater, and other variables).

The determination of the coating weight of the coating film and the determination of the amount of N ingredient and the P ingredient in the coating film were conducted in the same procedure as that of Example 1.

As Comparative Examples, conventional application type prephosphate treatment was given to the surface of zinc-base plated steel sheets varying the coating weight. The coating weight of prephosphate of application type was determined by dissolving the coating film in a solution prepared by dissolving 20 g of ammonium dichromate and 490 g of 25% ammonia water in 1 liter of ion-exchanged water, then by calculating the weight change before and after dissolving. The P amount in the coating film was determined by FX in the same procedure with that used in the evaluation of film-removability described later.

The performance evaluation on thus prepared zinc-base plated steel sheets was given as follows.

(1) Press-Formability

The procedure of evaluation was the same with that in Example 1.

(2) Chemical Conversion Treatment Performance

The procedure of evaluation was the same with that in

EXAMPLE 1

(3) Film-Removability During Degreasing

Each sample (150 mm×70 mm) of the zinc-base plated steel sheets of Examples (according to the present invention) and of Comparative Examples was treated by applying press-oil "NOX-RUST 550HN" (manufactured by PARKER INDUSTRIES, INC.) onto the surface thereof. After that, the sample was treated by alkali-degreasing under the condition given below. The P amount in the coating film of the tested sample was quantified by FX on separate pieces, each having 48 mm in diameter, taken from the position sandwiching the tested sample, and by calculating the average value of the two separate pieces.

After degreasing the sample, a portion of 48 mm in diameter at near center of the sample was cut to quantify the P amount at that portion by FX. From the above-described original P amount and the P amount after degreasing, the film-removal rate was calculated using the formula given below.

Film-removal rate=1−[(P amount after degreasing)/(Original P value)].

Condition of Alkali Degreasing

Assuming the state of degradation in degreasing liquid, immersion method was applied to conduct degreasing using the alkali degreasing liquid "FC44800" (manufactured by Nihon Parkerizing Co., Ltd.) with the addition of 5 g/l of rust-preventive oil "NOX-RUST 550HN" (manufactured by Nihon Parkerizing Co., Ltd.) The immersion time was 120 seconds, and the temperature of degreasing liquid was 43° C. The degreasing was carried out by the immersion treatment using a 30 liter cylindrical vessel with propeller agitator (300 rpm).

(4) Adhesiveness

After removing the rust-preventive oil from the sample (25 mm×200 mm) by solvent degreasing, the rinse-oil "PRETON R352L" (manufactured by SUGIMURA Chemical Industrial Co., Ltd.) was applied thereon. Two pieces of the sample were paired to prepare a set. A polyvinylchloride hemming adhesive was applied onto each sample over a range of 25 mm×140 mm, (not applying to 50 mm distance from sample edge). After that, two sample pieces were adhered to each other via a spacer having 0.15 mm in thickness. The adhered pair of samples was dried at 160° C. for 10 minutes, then was allowed to stand at normal temperature for 24 to 72 hours. Then, the adhered pair of samples was tested by a tensile tester until they were separated from the T-shape state, and the average strength of the sample under tension was determined.

Table 29 and Table 30 show the treatment condition of each specimen and the result of above-described performance evaluation. Compared with Comparative Examples, Examples (according to the present invention) are superior not only in chemical conversion treatment performance and press-formability but also in film-removability and adhesiveness.

TABLE 28

| | Cationic ingredient (α) | | | | Concentration of phosphoric | Molar ratio of [cation | | | |
|---|---|---|---|---|---|---|---|---|---|
| | $NH_4^+$ | Other cation | | Total cation | acid ion (β) | (α)]/ | Carboxylic acid | | |
| No. | concentration (mol/l) | Kind | Concentration (mol/l) | concentration (mol/l) | [as $P_2O_5$] (mol/l) | [phosphoric acid ion (β)] | Kind | Concentration (mol/l) | Classification |
| 1 | 0.56 | Fe | 0.13 | 0.69 | 0.28 | 2.5 | Citric acid | 0.13 | Example |
| 2 | 0.56 | Fe | 0.26 | 0.82 | 0.28 | 2.9 | Citric acid | 0.26 | Example |
| 3 | 0.37 | Fe | 0.09 | 0.46 | 0.19 | 2.4 | Citric acid | 0.09 | Example |
| 4 | 0.37 | Fe | 0.18 | 0.55 | 0.19 | 2.9 | Citric acid | 0.18 | Example |
| 5 | 0.37 | Fe | 0.07 | 0.44 | 0.19 | 2.3 | Citric acid | 0.07 | Example |
| 6 | 0.19 | Fe | 0.09 | 0.28 | 0.19 | 1.5 | Citric acid | 0.09 | Example |
| 7 | 0.19 | Fe | 0.13 | 0.32 | 0.28 | 0.7 | Citric acid | 0.13 | Example |
| 8 | 0.08 | Fe | 0.13 | 0.21 | 0.28 | 0.3 | Citric acid | 0.13 | Example |
| 9 | 0.04 | Fe | 0.13 | 0.17 | 0.28 | 0.1 | Citric acid | 0.13 | Example |
| 10 | 0.56 | Fe | 0.13 | 0.69 | 0.28 | 2.5 | Oxalic acid | 0.13 | Example |

TABLE 28-continued

| No. | Cationic ingredient (α) $NH_4^+$ concentration (mol/l) | Other cation Kind | Other cation Concentration (mol/l) | Total cation concentration (mol/l) | Concentration of phosphoric acid ion (β) [as $P_2O_5$] (mol/l) | Molar ratio of [cation (α)]/[phosphoric acid ion (β)] | Carboxylic acid Kind | Carboxylic acid Concentration (mol/l) | Classification |
|---|---|---|---|---|---|---|---|---|---|
| 11 | 0.45 | Fe | 0.02 | 0.47 | 0.28 | 1.7 | (not added) | | Example |
| 12 | 0.37 | Al | 0.09 | 0.46 | 0.19 | 1.9 | Citric acid | 0.09 | Example |

TABLE 29

| No. | Base sheet being treated *1 | Treatment liquid *2 | Drying temp. (° C.) *3 | Molar ratio of ingredients in coating film *5 | Coating weight ($mg/m^2$) *4 | Press-formability (friction factor) | Chemical conversion treatment performance (Evaluation 1) PB 3030 | PB 3020 |
|---|---|---|---|---|---|---|---|---|
| 1 | GA | 1 | 80 | 2.5 | 78 | 0.155 | ◎ | ◎ |
| 2 | GA | 2 | 80 | 2.9 | 80 | 0.154 | ◎ | ◎ |
| 3 | GA | 3 | 80 | 2.4 | 55 | 0.152 | ◎ | ◎ |
| 4 | GA | 4 | 80 | 2.9 | 48 | 0.153 | ◎ | ◎ |
| 5 | GA | 5 | 80 | 2.3 | 39 | 0.155 | ◎ | ◎ |
| 6 | GA | 6 | 80 | 1.5 | 42 | 0.152 | ◎ | ◎ |
| 7 | GA | 7 | 80 | 0.7 | 76 | 0.153 | ◎ | ◎ |
| 8 | GA | 8 | 80 | 0.3 | 78 | 0.152 | ◎ | ◎ |
| 9 | GA | 9 | 80 | 0.1 | 69 | 0.155 | ◎ | ◎ |
| 10 | GA | 10 | 80 | 2.5 | 77 | 0.154 | ◎ | ◎ |
| 11 | GA | 11 | 80 | 1.7 | 68 | 0.153 | ◎ | ◎ |
| 12 | GA | 12 | 80 | 1.9 | 49 | 0.152 | ◎ | ◎ |
| 13 | GI | 1 | 80 | 2.5 | 82 | 0.160 | ◎ | ◎ |
| 14 | GI | 2 | 80 | 2.9 | 79 | 0.156 | ◎ | ◎ |

| No. | Chemical conversion treatment performance (Evaluation 2) | Film-removability (film-removal rate) | Adhesiveness (kgf/25 mm) | Classification |
|---|---|---|---|---|
| 1 | ◎ | 0.85 | 10.2 | E |
| 2 | ◎ | 0.87 | 11.0 | E |
| 3 | ◎ | 0.85 | 10.5 | E |
| 4 | ◎ | 0.91 | 10.2 | E |
| 5 | ◎ | 0.82 | 10.8 | E |
| 6 | ◎ | 0.83 | 10.3 | E |
| 7 | ◎ | 0.85 | 10.2 | E |
| 8 | ◎ | 0.86 | 10.1 | E |
| 9 | ◎ | 0.83 | 10.3 | E |
| 10 | ◎ | 0.72 | 10.2 | E |
| 11 | ○ | 0.58 | 10.3 | E |
| 12 | ○ | 0.83 | 5.2 | E |
| 13 | ◎ | 0.92 | 10.2 | E |
| 14 | ◎ | 0.99 | 10.5 | E |

E: Example
C: Comparative example
*1 GI: Hot-dip galvanized steel sheet GA: Alloyed hot-dip galvanized steel sheet
*2 Treatment liquid No. given in Tables 16 through 18
*3 Ultimate sheet temperature
*4 P coating weight
*5 Molar ratio of the amount of N ingredient (a) or the sum of the amount of N ingredient and amount of metallic elements (one or more of Mg, Al, Ca, Ti, Mn, Fe, Co, Ni, Cu, and Mo) (a') in coating film to the amount of P ingredient (b) in coating film, (the amount of N ingredient is expressed by ammonium conversion value, and the amount of P ingredient is expressed by $P_2O_5$ conversion value)

TABLE 30

| No. | Base sheet being treated *1 | Treatment liquid *2 | Drying temp. (° C.) *3 | Molar ratio of ingredients in coating film *5 | Coating weight ($mg/m^2$) *4 | Press-formability (friction factor) | Chemical conversion treatment performance (Evaluation 1) PB 3030 | PB 3020 |
|---|---|---|---|---|---|---|---|---|
| 15 | GI | 3 | 80 | 2.4 | 49 | 0.158 | ◎ | ◎ |
| 16 | GI | 4 | 80 | 2.9 | 52 | 0.157 | ◎ | ◎ |
| 17 | GI | 5 | 80 | 2.3 | 45 | 0.163 | ◎ | ◎ |
| 18 | GI | 6 | 80 | 1.5 | 39 | 0.152 | ◎ | ◎ |
| 19 | GI | 7 | 80 | 0.7 | 82 | 0.162 | ◎ | ◎ |
| 20 | GI | 8 | 80 | 0.3 | 79 | 0.159 | ◎ | ◎ |
| 21 | GI | 9 | 80 | 0.1 | 72 | 0.154 | ◎ | ◎ |
| 22 | GI | 10 | 80 | 2.5 | 69 | 0.158 | ◎ | ◎ |
| 23 | GI | 11 | 80 | 1.7 | 72 | 0.157 | ◎ | ◎ |
| 24 | GI | 12 | 80 | 1.9 | 41 | 0.156 | ◎ | ◎ |
| 25 | GA | Application type prephosphate (coating weight: 0.5 $g/m^2$, P amount: 49 $mg/m^2$) | | | | 0.154 | ○ | ○ |
| 26 | GA | Application type prephosphate (coating weight: 1.0 $g/m^2$, P amount: 103 $mg/m^2$) | | | | 0.155 | Δ | ○ |
| 27 | GI | Application type prephosphate (coating weight: 0.5 $g/m^2$, P amount: 51 $mg/m^2$) | | | | 0.168 | ○ | ○ |

| No. | Chemical conversion treatment performance (Evaluation 2) | Film-removability (film-removal rate) | Adhesiveness (kgf/25 mm) | Classification |
|---|---|---|---|---|
| 15 | ◎ | 0.98 | 10.3 | E |
| 16 | ◎ | 0.93 | 10.8 | E |
| 17 | ◎ | 0.92 | 10.6 | E |
| 18 | ◎ | 0.89 | 10.5 | E |
| 19 | ◎ | 0.92 | 10.6 | E |
| 20 | ◎ | 0.88 | 10.2 | E |
| 21 | ◎ | 0.93 | 10.1 | E |
| 22 | ◎ | 0.78 | 10.8 | E |
| 23 | ○ | 0.63 | 10.2 | E |
| 24 | ○ | 0.86 | 5.3 | E |
| 25 | Δ | 0.16 | 3.5 | C |
| 26 | X | 0.22 | 2.9 | C |
| 27 | Δ | 0.39 | 3.6 | C |

E: Example
C: Comparative example
*1 GI: Hot-dip galvanized steel sheet GA: Alloyed hot-dip galvanized steel sheet
*2 Treatment liquid No. given in Table 16 through Table 18
*3 Ultimate sheet temperature
*4 P coating weight
*5 Molar ratio of the amount of N ingredient (a) or the sum of the amount of N ingredient and amount of metallic elements (one or more of Mg, Al, Ca, Ti, Mn, Fe, Co, Ni, Cu, and Mo) (a') in coating film to the amount of P ingredient (b), (the amount of N ingredient is expressed by ammonium conversion value, and the amount of P ingredient is expressed by $P_2O_5$ conversion value)

What is claimed is:

1. A zinc-base plated steel sheet comprising:

a zinc-base plating layer;

a composite coating film on the zinc-base plating layer, said composite coating film containing a P ingredient, a N ingredient and at least one metallic element selected from the group consisting of Mg, Al, Ca, Ti, Mn, Fe, Co, Ni, Cu and Mo, as components for structuring the composite coating film;

said N ingredient and said at least one metallic element selected from the group consisting of Mg, Al, Ca, Ti, Mn, Fe, Co, Ni, Cu and Mo having a total amount (a), said P ingredient having an amount (b);

a molar ratio of (a)/(b) being from 0.2 to 6;

the P ingredient being in an amount expressed by a $P_2O_5$ conversion value, and the N ingredient being in an amount expressed by an ammonium conversion value; and the composite coating film having a coating weight of 5 to 300 $mg/m^2$ as the amount of the P ingredient.

2. The zinc-base plated steel sheet according to claim 1, wherein the composite coating film contains the P ingredient and the N ingredient in a form selected from the group consisting of a nitrogen compound, a phosphorus-base compound, and a nitrogen-phosphorus-base compound.

3. The zinc-base plated steel sheet according to claim 1, wherein the composite coating film contains at least Fe as the metallic element.

4. The zinc-base plated steel sheet according to claim 3, wherein the P ingredient has the amount (b) and the Fe has an amount (c); and the composite coating film has a molar ratio of (c)/(b) of 0.2 or more and less than 0.95.

5. The zinc-base plated steel sheet according to claim 1, wherein the composite coating film contains Al as the metallic element.

6. The zinc-base plated steel sheet according to claim 1, wherein the composite coating film further contains silica;

the P ingredient has the amount(b) and the silica has an amount (d), the amount (d) being expressed by a $P_2O_5$ conversion value;

the composite coating film has a molar ratio of (d)/(b) being 0.01 to 50.

7. The zinc-base plated steel sheet according to claim 1, wherein the composite coating film further contains a resin selected from the group consisting of a water-soluble resin and a water-dispersible resin, in an amount of 0.01 to 1000 $mg/m^2$.

8. The zinc-base plated steel sheet according to claim 1, wherein the molar ratio of (a)/(b) is 0.4.

9. The zinc-base plated steel sheet according to claim 1, wherein the composite coating film has a coating weight of 30 to 120 $mg/m^2$.

10. A method for producing a zinc-base plated steel sheet comprising:

applying an aqueous solution containing a cationic ingredient and a phosphoric acid ingredient onto a surface of a plating layer on a zinc-base plated steel sheet; and drying the applied aqueous solution, without washing with water, to form a coating film;

the cationic ingredient consisting essentially of at least one metallic ion selected from the group consisting of Mg, Al, Ca, Ti, Mn, Fe, Co, Ni, Cu, Mo and $NH_4^+$;

the aqueous solution containing at least $NH_4^+$ as the cationic ingredient;

the cationic ingredient having a total amount ($\alpha$) and the phosphoric acid ingredient having an amount ($\beta$), the phosphoric acid being expressed by a $P_2O_5$ conversion value;

the aqueous solution having a molar ratio of ($\alpha$)/($\beta$) of from 0.2 to 6.

11. The method according to claim 10, wherein the aqueous solution contains, in addition to $NH_4^+$, at least Fe as a cationic ingredient.

12. The method according to claim 10, wherein the aqueous solution contains, in addition to $NH_4^+$, at least Al as a cationic ingredient.

13. The method according to claim 12, wherein the aqueous solution has a molar concentration ratio of ($\epsilon$)/($\beta$) of 1/10 or more and less than 2/3, ($\beta$) being an amount of the phosphoric acid ingredient, ($\delta$) being an amount of Al, and the phosphoric acid being expressed by a $P_2O_5$ conversion value.

14. The method according to claim 10, wherein the aqueous solution further contains silica in an amount ($\gamma$), and the aqueous solution has a molar ratio of ($\gamma$)/($\beta$) of from 0.01 to 50, ($\beta$) being an amount of the phosphoric acid ingredient, the silica being expressed by a $SiO_2$ conversion value, and the phosphoric acid being expressed by a $P_2O_5$ conversion value.

15. The method according to claim 10, wherein the aqueous solution further contains at least one resin selected from the group consisting of a water-soluble resin and a water-dispersible resin.

16. The method according to claim 10, wherein the aqueous solution further contains carboxylic acid.

17. The method according to claim 16, wherein the carboxylic acid is oxycarboxylic acid.

18. The method according to claim 17, wherein the oxycarboxylic acid is citric acid.

19. The method according to claim 10, wherein the molar ratio of ($\alpha$)/($\beta$) is 0.2 or more and less than 1.

20. The method according to claim 15, wherein the resin is contained in a coating weight of 0.01 to 1000 $mg/m^2$.

* * * * *